US006889015B2

(12) United States Patent
Shimura

(10) Patent No.: US 6,889,015 B2
(45) Date of Patent: May 3, 2005

(54) APPARATUS AND METHOD OF FORMING PATCH IMAGE FOR OPTIMIZING DENSITY CONTROL FACTOR

(75) Inventor: Hidetsugu Shimura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 10/627,996

(22) Filed: Jul. 28, 2003

(65) Prior Publication Data

US 2004/0057739 A1 Mar. 25, 2004

(30) Foreign Application Priority Data

Jul. 29, 2002 (JP) ..... 2002-219483
Jul. 29, 2002 (JP) ..... 2002-219722

(51) Int. Cl.[7] ..... G03G 15/00

(52) U.S. Cl. ..... 399/49; 399/53; 399/72

(58) Field of Search ..... 399/38, 39, 49, 399/53, 72, 46

(56) References Cited

U.S. PATENT DOCUMENTS 5,559,587 A 9/1996 Ogata et al.
5,940,654 A * 8/1999 Uchiyama et al. ..... 399/49
6,226,466 B1 * 5/2001 Ojima et al. ..... 399/49
6,516,162 B1 * 2/2003 Ino et al. ..... 399/49

FOREIGN PATENT DOCUMENTS

JP 7-36231 A 2/1995
JP 2957859 B2 7/1999

* cited by examiner

*Primary Examiner*—Hoan Tran
(74) *Attorney, Agent, or Firm*—Sughrue Mion, PLLC

(57) ABSTRACT

For optimization of a direct current developing bias Vavg, a patch image Ivn is formed whose length is longer than a circumferential length L0 of a photosensitive member. From an average value of sensor outputs sampled over the length L0 of the patch image, a toner density of the patch image Ivn is calculated and a value corresponding to an average value ODavg of optical densities OD is accordingly found. This cancels an influence of density variations appearing in association with rotating cycles of the photosensitive member exerted over a patch image.

36 Claims, 35 Drawing Sheets

DISTRIBUTION OF PARTICLE DIAMETER

CHANGE IN OD VALUE

FIG. 14A:

HIGH-DENSITY PATCH IMAGE

| TONER CHARACTER INFORMATION ="0" | | DEVELOPER ROLLER ROTATING TIME (sec) | | | |
|---|---|---|---|---|---|
| | | ~1325 | ~3975 | ~6625 | ~10600 |
| DOT COUNT VALUE | ~1000000 | 0.990 | 0.988 | 0.984 | 0.982 |
| | ~2000000 | 0.988 | 0.984 | 0.982 | 0.982 |
| | ~6666666 | 0.984 | 0.982 | 0.982 | 0.982 |
| | ~12000000 | 0.982 | 0.982 | 0.982 | 0.982 |

FIG. 14B:

LOW-DENSITY PATCH IMAGE

| TONER CHARACTER INFORMATION ="0" | | DEVELOPER ROLLER ROTATING TIME (sec) | | | |
|---|---|---|---|---|---|
| | | ~1325 | ~3975 | ~6625 | ~10600 |
| DOT COUNT VALUE | ~1000000 | 0.185 | 0.182 | 0.181 | 0.180 |
| | ~2000000 | 0.182 | 0.181 | 0.180 | 0.180 |
| | ~6666666 | 0.181 | 0.180 | 0.180 | 0.180 |
| | ~12000000 | 0.180 | 0.180 | 0.180 | 0.180 |

APPARATUS AND METHOD OF FORMING PATCH IMAGE FOR OPTIMIZING DENSITY CONTROL FACTOR

BACKGROUND OF THE INVENTION

1. Field of the Invention

The present invention relates to an image forming apparatus and an image forming method. In the apparatus, an electrostatic latent image is formed on an image carrier and toner moves to a surface of the image carrier from a toner carrier which carries the toner to thereby visualize the electrostatic latent image and form a toner image.

2. Description of the Related Art

Known as image forming apparatuses, such as copier machines, printers and facsimile machines, to which electrophotographic techniques are applied are two types: those apparatuses of the contact developing type according to which an image carrier and a toner carrier are held abutting on each other; and those apparatuses of the non-contact developing type according to which an image carrier and a toner carrier are held away from each other. Of these, in an image forming apparatus of the contact developing type, a toner carrier is applied a developing bias with a direct current voltage or a voltage which is obtained by superimposing an alternating current voltage upon a direct current voltage. When toner carried by a surface of the toner carrier contacts an electrostatic latent image which is formed on an image carrier, the toner partially moves toward the image carrier in accordance with a surface potential of the electrostatic latent image, and a toner image is consequently formed.

Meanwhile, in an image forming apparatus of the non-contact developing type, an alternating voltage serving as a developing bias is applied upon a toner carrier. This causes an alternating field develop in a gap between the toner carrier and an image carrier. Toner transfers onto the electrostatic latent image owing to the function of the alternating field, and a toner image is consequently formed.

In such an image forming apparatus, an image density of a toner image may cyclically change because of variable factors related to a structure of the apparatus. The variable factors may include eccentricity, deformation, a scratch on a surface and the like of a toner carrier or an image carrier, for instance. Further, in an image forming apparatus in which a surface of an image carrier is formed by a photosensitive member and this surface is exposed with a light beam so that an electrostatic latent image is formed. An image density cyclically changes in some cases due to a variation in sensitivity of the photosensitive member within the surface of the image carrier, a change in temperature of the photosensitive member, etc.

Hence, a density of a toner image formed as a patch image, too, changes not only because of settings of density control factors but also in accordance with the density changes described above. When an influence of such a density change is contained in a value which is detected as a patch image density, it is not possible to correctly grasp a correlation between the density control factors and an image density. This further makes it difficult to set the density control factors to appropriate values even despite optimization of the density control factors based on patch image densities.

In a conventional image forming apparatus, density control factors are set based on a density of a patch image without sufficiently considering the influence of density changes attributed to a structure of the apparatus over a patch image density. This may lead to a consequence that an image is formed under an image forming condition which is not an originally intended optimal condition. This may sometimes prevent formation of a toner image which has a sufficient image quality.

SUMMARY OF THE INVENTION

A major object of the present invention is to provide an image forming apparatus and an image forming method according with which it is possible to suppress an influence of a density change of a patch image attributed to a variable factor which is related to a structure of the apparatus, and to stably form a toner image which has an excellent image quality.

According a first aspect of the present invention, a low-density patch image formed under a low-density side image forming condition, which makes an image density the lowest among multiple levels of an image forming condition, has a length which is equal to or longer than a circumferential length of an image carrier in a patch length direction which corresponds to a direction in which the image carrier moves, density detecting means detects a density in a portion of the low-density patch image which corresponds to the circumferential length of the image carrier, and a toner density of the low-density patch image is calculated.

According a second aspect of the present invention, at least one or more of patch images has a length along a patch length direction, which corresponds to a direction in which an image carrier moves, is equal to or longer than a circumferential length of the image carrier; and toner densities of the patch images are found as density detecting means detects densities in portions of the patch images which correspond to the circumferential length of the image carrier.

According a third aspect of the present invention, control means controls an image forming condition based on an image density of a patch image which is formed in a patch image area on an image carrier; and while the patch image area moves passed a developing position, a toner carrier rotates one round or more.

According a fourth aspect of the present invention, control means forms a patch image within an area of a surface of an image carrier which faces a predetermined area on a toner carrier at a developing position, and controls an image forming condition based on an image density of the patch image.

According a fifth aspect of the present invention, while a density control factor, which influences an image density, set to be variable over multiple levels, a patch image is formed at each level of an image forming condition, density detecting means detects toner densities of patch images, and the density control factor is optimized based on the detection results; and under at least one selective image forming condition among the multiple levels of the image forming condition, the patch image is formed covering all of a plurality of detection areas which are at mutually different positions on an outer circumferential surface of an image carrier in a circumferential direction of the image carrier, each one of a plurality of detection areas has a length which corresponds to a circumferential length of the toner carrier in a patch length direction which corresponds to a direction in which the image carrier moves, and toner densities within the detection areas are detected, and a toner density of the patch image is calculated.

According a sixth aspect of the present invention, toner densities at a plurality of positions in a patch image which serve as detection areas are detected, and a toner density of the patch image is calculated based on the toner densities in a plurality of detection areas; and each one of the plurality of detection areas has a length which corresponds to a circumferential length of a toner carrier in a patch length direction which corresponds to a direction in which an image carrier moves.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 14A and 14B are drawings which show examples of look-up tables which are for calculating a control target value;

DETAILED DESCRIPTION OF THE EMBODIMENTS (I) Structure of Apparatus

Figure 1:
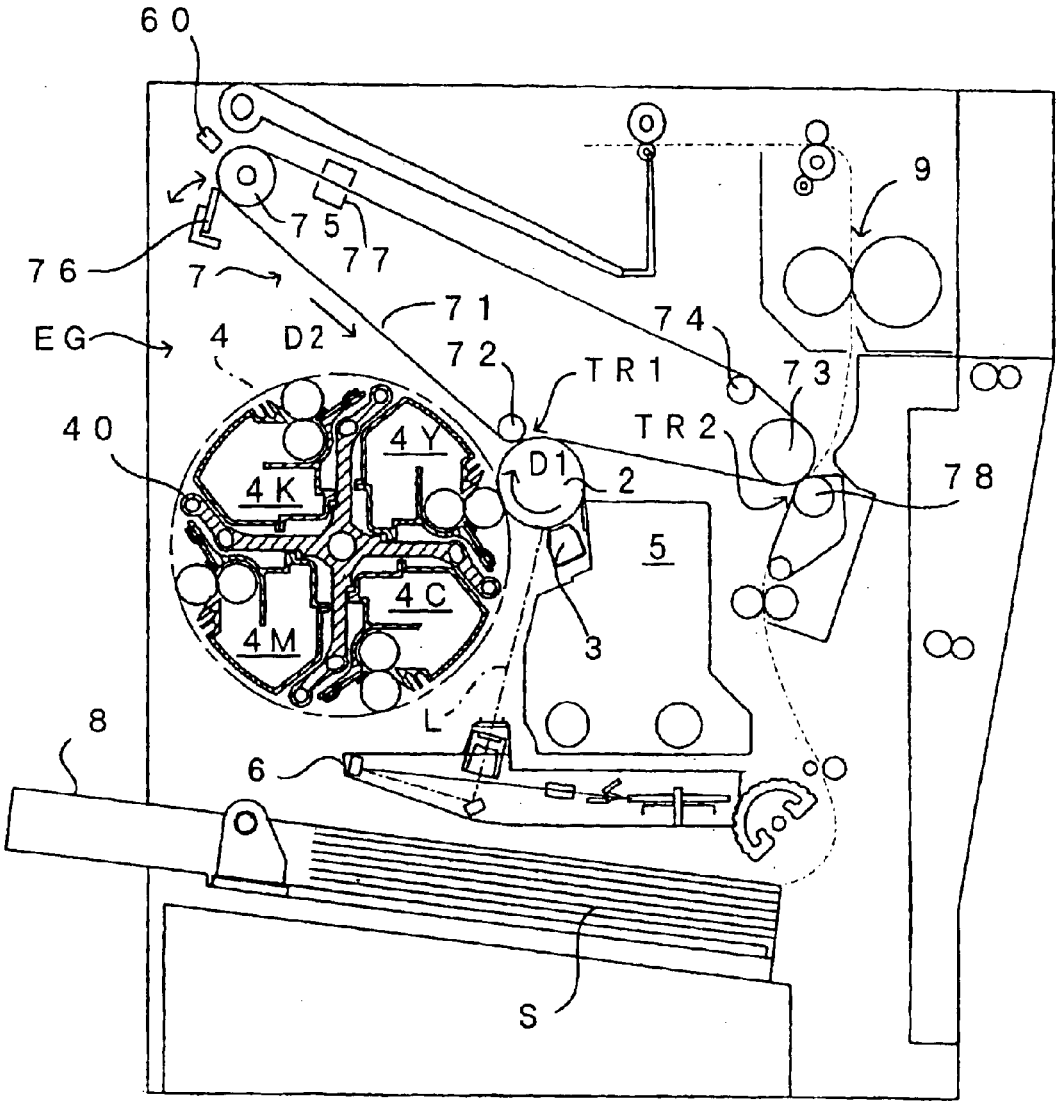
FIG. 1 is a drawing of a first embodiment of an image forming apparatus according to the present invention.
Figure 2:
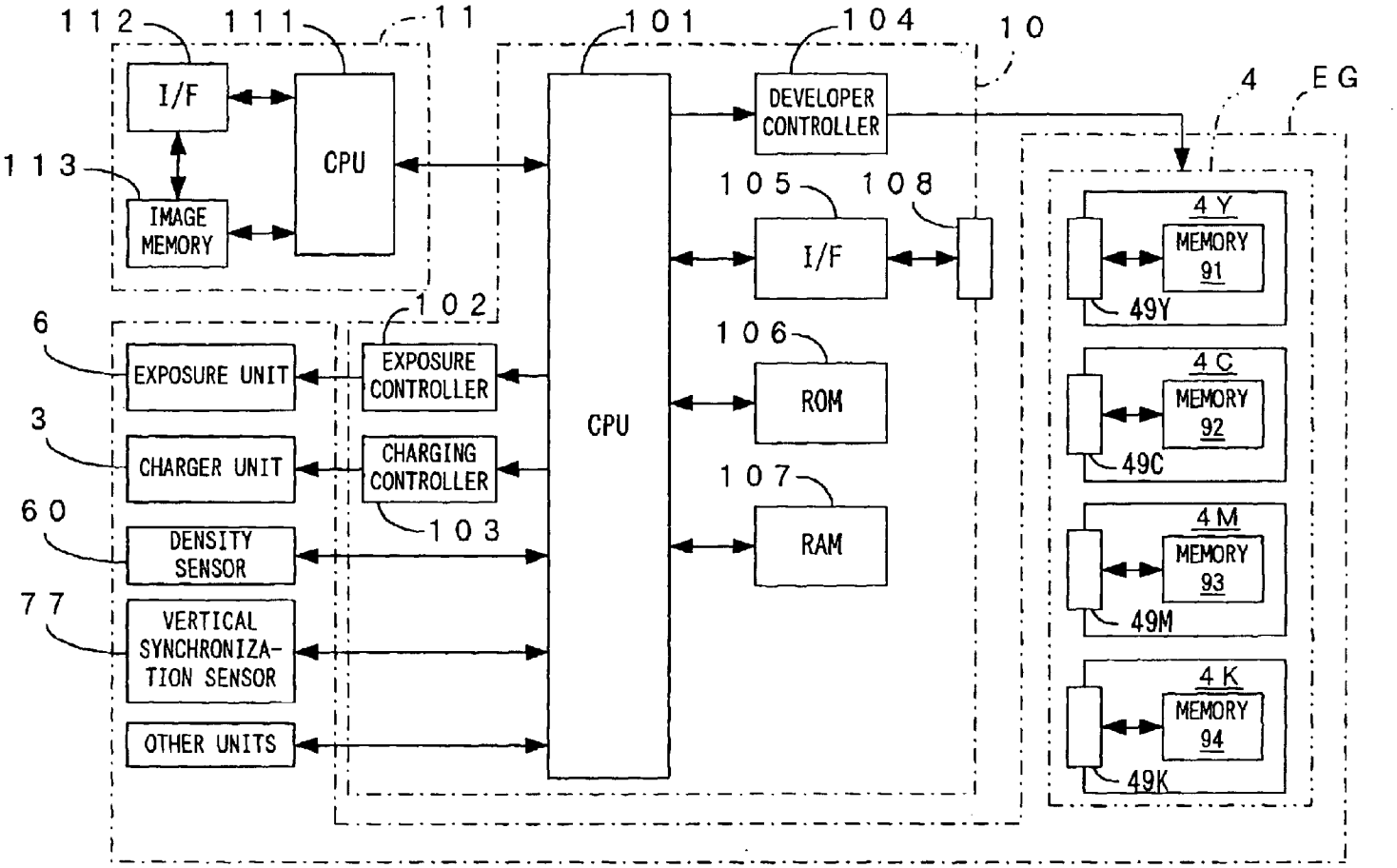
FIG. 2 is a block diagram of an electric structure of the image forming apparatus which is shown in FIG. 1.

FIG. 1 is a drawing of a first embodiment of an image forming apparatus according to the present invention. FIG. 2 is a block diagram of an electric structure of the image forming apparatus which is shown in FIG. 1. This image forming apparatus is an apparatus which superposes toner in four colors of yellow (Y), magenta (M), cyan (C) and black (K) and accordingly forms a full-color image, or uses only toner in black (K) and accordingly forms a monochrome image. In this image forming apparatus, when an image signal is fed to a main controller 11 from an external apparatus such as a host computer in response to an image formation request from a user, an engine controller 10 controls respective portions of an engine EG in accordance with an instruction received from the main controller 11 and an image which corresponds to the image signal is formed on a sheet S.

In the engine EG a photosensitive member 2 is disposed so that the photosensitive member 2 can freely rotate in the arrow direction D1 in FIG. 1. Around the photosensitive member 2, a charger unit 3, a rotary developer unit 4 and a cleaner 5 are disposed in the rotation direction D1. A charging controller 103 applies a charging bias upon the charger unit 3, whereby an outer circumferential surface of the photosensitive member 2 is electrified uniformly to a predetermined surface potential.

An exposure unit 6 emits a light beam L toward the outer circumferential surface of the photosensitive member 2 which is thus charged by the charger unit 3. The exposure unit 6, thus functioning as "exposure means" of the present invention, makes the light beam L expose on the photosensitive member 2 in accordance with a control instruction fed from an exposure controller 102 and forms an electrostatic latent image corresponding to the image signal. For instance, when an image signal is fed to a CPU 111 of the main controller 11 via an interface 112 from an external apparatus such as a host computer, a CPU 101 of the engine controller 10 outputs a control signal corresponding to the image signal at predetermined timing, the exposure unit 6 emits the light beam L upon the photosensitive member 2, and an electrostatic latent image corresponding to the image signal is formed on the photosensitive member 2. Further, when a patch image which will be described later is to be formed in accordance with a necessity, a control signal corresponding to a patch image signal which expresses a predetermined pattern is fed from the CPU 101 to the exposure controller 102, and an electrostatic latent image corresponding to this pattern is formed on the photosensitive member 2. In this fashion, the photosensitive member 2 functions as an "image carrier" of the present invention, according to this embodiment.

The developer unit 4 develops thus formed electrostatic latent image with toner. In other words, the developer unit 4 comprises: a support frame 40 which is disposed for free rotation about a shaft; a rotation driver not shown; and a yellow developer 4Y, a cyan developer 4C, a magenta developer 4M and a black developer 4K which are freely attachable to and detachable from the support frame 40 and house toner of the respective colors. A developer controller 104 controls the developer unit 4 as shown in FIG. 2. The developer unit 4 is driven into rotations based on a control instruction from the developer controller 104, and the developers 4Y, 4C, 4M and 4K are selectively positioned at a predetermined developing position facing the photosensitive member 2 and supply the toner of the selected color onto the surface of the photosensitive member 2. As a result, the electrostatic latent image on the photosensitive member 2 is visualized with the toner of the selected color. Shown in FIG. 1 is a state that the yellow developer 4Y is positioned at the developing position.

Figure 3:
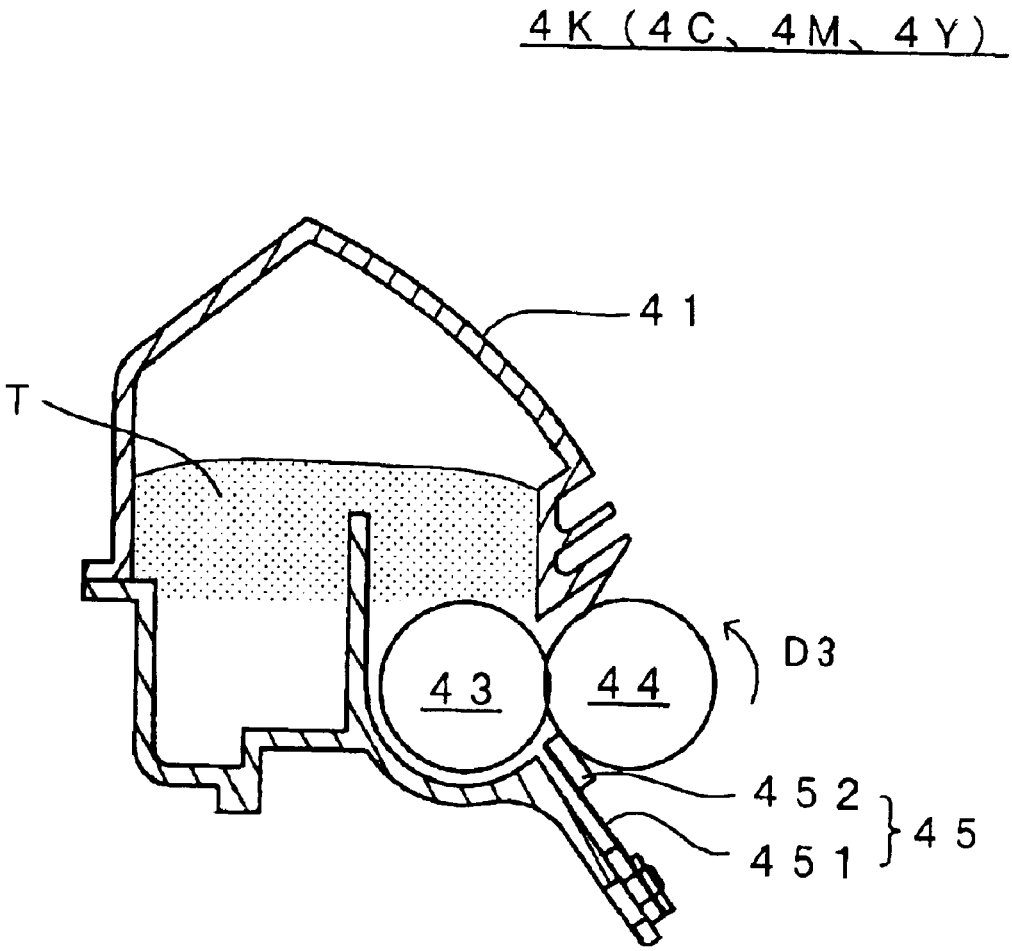
FIG. 3 is a cross sectional view of a developer of the image forming apparatus.

Since the developers 4Y, 4C, 4M and 4K all have the same structure, a structure of the developer 4K will now be described in more detail with reference to FIG. 3. The other developers 4Y, 4C and 4M remain the same in structure and function. FIG. 3 is a cross sectional view of the developer of the image forming apparatus. In this developer 4K, a supply roller 43 and a developer roller 44 are axially attached to a housing 41 which houses toner T inside. As the developer 4K is positioned at the developing position described above, the developer roller 44 which functions as a "toner carrier" of the present invention abuts on the photosensitive member 2 or gets positioned at an opposed position with a predetermined gap from the photosensitive member 2, and the rollers 43 and 44 rotate in a predetermined direction as they are engaged with the rotation driver (not shown) which is disposed to the main section. The developer roller 44 is made as a cylinder of metal, such as iron, copper and aluminum, or an alloy such as stainless steel, or so as to receive a developing bias as described later. As the two rollers 43 and 44 rotate while remaining in contact, the black toner is rubbed against a surface of the developer roller 44 and a toner layer having predetermined thickness is accordingly formed on the surface of the developer roller 44.

Further, in the developer 4K, a restriction blade 45 is disposed which restricts the thickness of the toner layer formed on the surface of the developer roller 44 into the predetermined thickness. The restriction blade 45 comprises a plate-like member 451 of stainless steel, phosphor bronze or the like and an elastic member 452 of rubber, a resin material or the like attached to a front edge of the plate-like member 451. A rear edge of the plate-like member 451 is fixed to the housing 41, which ensures that the elastic member 452 attached to the front edge of the plate-like member 451 is positioned on the upstream side to the rear edge of the plate-like member 451 in a rotation direction D3 of the developer roller 44. The elastic member 452 elastically abuts on the surface of the developer roller 44, thereby restricting the toner layer formed on the surface of the developer roller 44 finally into the predetermined thickness.

Toner particles which form the toner layer formed on the surface of the developer roller 44 are charged, due to friction with the supply roller 43 and the restriction blade 45. Although the example described below assumes that the toner has been negatively charged, it is possible to use toner which becomes positively charged as potentials at the respective portions of the apparatus are appropriately changed.

The toner layer thus formed on the surface of the developer roller 44 is gradually transported, owing to the rotations of the developer roller 44, to an opposed position facing the photosensitive member 2 on which surface the electrostatic latent image has been formed. As the developing bias from the developer controller 104 is applied upon the developer roller 44, the toner carried on the developer roller 44 partially adheres to respective portions within the surface of the photosensitive member 2 in accordance with surface potentials in these portions. The electrostatic latent image on the surface of the photosensitive member 2 is visualized as a toner image in this toner color in this manner. In this embodiment, the developer controller 104 functions as "bias applying means" of the present invention.

While the developing bias applied upon the developer roller 44 may be a direct current voltage or a developing bias which is obtained by superimposing an alternating current voltage upon a direct current voltage, in an image forming apparatus of the non-contact developing type in which the photosensitive member 2 and the developer roller 44 in particular are located away from each other and toner transfers between the two for the purpose of development with the toner, it is preferable for efficient toner transfer that the developing bias has a voltage waveform which is obtained by superimposing an alternating current voltage, such as a sine wave, a chopping wave and a square wave, upon a direct current voltage. Although the value of a direct current voltage and the amplitude, the frequency, the duty ratio and the like of an alternating current voltage may have any desired values, in the following description, a direct current component (average value) of the developing bias will be referred to as an average developing bias Vavg, regardless of whether the developing bias contains an alternating current component.

A preferable example of the developing bias described above used in an image forming apparatus of the non-contact developing type will now be described. For instance, the waveform of the developing bias is obtained by superimposing an alternating current voltage having a square wave upon a direct current voltage, the frequency of the square wave is 3 kHz and a peak-to-peak voltage Vpp is 1400 V. In addition, as described later, although it is possible to change the developing bias Vavg as one of density control factors in this embodiment. The developing bias may be changed in the variable range of (−110 V) to (−330 V) for example, considering an influence over an image density, a variation in characteristics of the photosensitive member 2, etc. These numerical figures are not limited to those mentioned above, but should rather be appropriately changed in accordance with the structure of the apparatus.

In addition, as shown in FIG. 2, memories 91 through 94, which store data regarding a production batch and/or the history of use of the developers, characteristics of the toner inside and the like, are disposed to the respective developers 4Y, 4C, 4M and 4K. Connectors 49Y, 49C, 49M and 49K are disposed to the respective developers 4Y, 4C, 4M and 4K. These are selectively connected with a connector 108 which is disposed to the main section in accordance with a necessity, allow that data are transferred between the CPU 101 and the respective memories 91 through 94 via an interface 105, and thus manage various types of information on the developers such as management of consumables. While data are sent and received with the connector 108 of the main section and the connector 49Y and the like of the developers mechanically fit with each other in this embodiment, the data transfer may be non-contact data transfer using other electromagnetic means such as radio communications. Further, the memories 91 through 94 which store data unique to the respective developers 4Y, 4C, 4M and 4K are preferably non-volatile memories which are capable of saving the unique data even when a power source is OFF, when the developers have been detached from the main section or on other occasions. Flash memories, ferroelectric memories, EEPROMs and the like may be used as such non-volatile memories.

The structure of the apparatus will be described continuously, referring to FIG. 1 again. The toner image developed by the developer unit 4 in the manner described above is primarily transferred onto an intermediate transfer belt 71 of a transfer unit 7 in a primary transfer region TR1. The transfer unit 7 comprises the intermediate transfer belt 71 which runs across a plurality of rollers 72 through 75, and a driver (not shown) which drives a roller 73 into rotations to thereby drive the intermediate transfer belt 71 into rotations in a predetermined rotation direction D2. At a position facing the roller 73 across the intermediate transfer belt 71, a secondary transfer roller 78 is disposed which is attached to and detached from a surface of the belt 71 by an electromagnetic clutch not shown. For transfer of a color image onto the sheet S, toner images in the respective colors on the photosensitive member 2 are superposed one atop the other on the intermediate transfer belt 71, thereby forming a color image. Further, on the sheet S unloaded from a cassette 8 and transported to a secondary transfer region TR2 which is located between the intermediate transfer belt 71 and the secondary transfer roller 78, the color image is secondarily transferred. The sheet S now seating thus formed color image is transported to a discharging tray which is disposed to a top surface portion of the main section of the apparatus via a fixing unit 9. In this embodiment, the intermediate transfer belt 71 functions as an "intermediate member" of the present invention.

Discharger unit not shown resets a surface potential of the photosensitive member 2 as it is after the primary transfer of the toner image onto the intermediate transfer belt 71. After removal of the toner remaining on the surface of the photosensitive member 2 by a cleaner 5, the charger unit 3 electrifies the photosensitive member 2.

When it is necessary to further form images, the operation above is repeated, a necessary number of images are accordingly formed, and the series of image forming operation ends. The apparatus remains on standby until a new image signal is received, and for the purpose of suppressing an energy consumption in the standby state, the apparatus switches from the standby operation to a suspended state. In short, the photosensitive member 2, the developer roller 44, the intermediate transfer belt 71 and the like stop rotating and the application of the developing biases upon the developer roller 44 and the charger unit 3 is stopped, whereby the apparatus enters the operation-suspended state.

Further, a cleaner 76, a density sensor 60 and a vertical synchronization sensor 77 are disposed in the vicinity of the roller 75. Of these, the cleaner 76 can move freely to be attached to and detached from the roller 75, owing to the electromagnetic clutch not shown. In a condition that the cleaner 76 has moved to the roller 75, a blade of the cleaner 76 abuts on the surface of the intermediate transfer belt 71 which runs around the roller 75 and removes the toner which remains adhering to the outer circumferential surface of the intermediate transfer belt 71 after the secondary transfer. Meanwhile, the vertical synchronization sensor 77 is a sensor which detects a reference position of the intermediate transfer belt 71, and functions as a vertical synchronization sensor which is for obtaining a synchronizing signal which is outputted in relation to rotations of the intermediate transfer belt 71, namely, a vertical synchronizing signal Vsync. In this apparatus, the operations of the respective portions of the apparatus are controlled based on the vertical synchronizing signal Vsync, to thereby time the operations of the respective portions to each other and to accurately superimpose toner images of the respective colors one atop the other. In addition, the density sensor 60 is disposed facing the surface of the intermediate transfer belt 71, and has such a structure which permits the density sensor 60 to measure a density of a patch image which is formed on the outer circumferential surface of the intermediate transfer belt 71. In this embodiment, the density sensor 60 functions as an "density detecting means" of the present invention.

In FIG. 2, denoted at 113 is an image memory which is disposed to the main controller 11 to store an image signal which is fed from an external apparatus such as a host computer via the interface 112. Denoted at 106 is a ROM which stores a calculation program executed by the CPU 101, control data for control of the engine EC; etc. Denoted at 107 is a RAM which temporarily stores a calculation result derived by the CPU 101, other data, etc.

Figure 4:
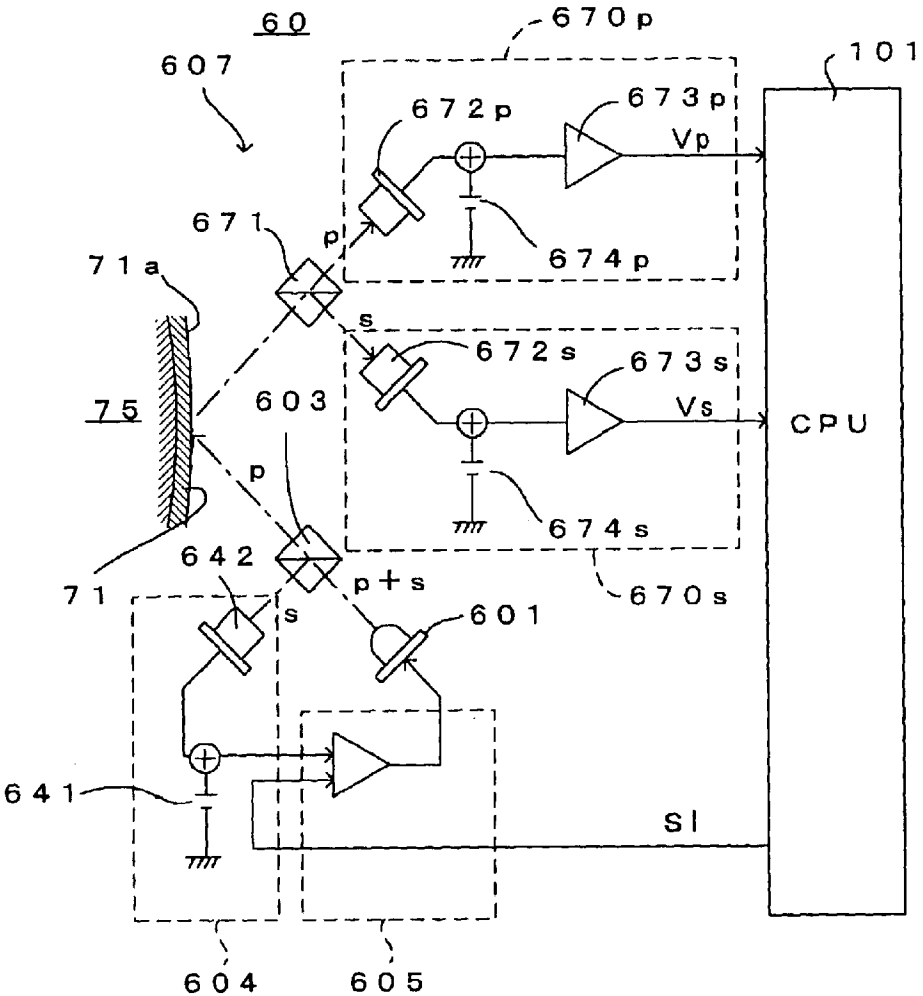
FIG. 4 is a drawing which shows a structure of a density sensor.

FIG. 4 is a drawing which shows a structure of the density sensor. The density sensor 60 comprises a light emitter element 601, such as an LED, which functions as "light emitting means" of the present invention and which irradiates light upon a wound area 71*a* which corresponds to a surface area of the intermediate transfer belt 71 which lies on the roller 75. Disposed to the density sensor 60 are a polarizer beam splitter 603, a light receiver unit for monitoring irradiated light amount 604 and an irradiated light amount adjusting unit 605, for the purpose of adjusting the irradiated light amount of irradiation light in accordance with a light amount control signal Slc which is fed from the CPU 101 as described later.

The polarizer beam splitter 603 is, as shown in FIG. 4, disposed between the light emitter element 601 and the intermediate transfer belt 71. The polarizer beam splitter 603 splits light emitted from the light emitter element 601 into p-polarized light, whose polarizing direction is parallel to the surface of incidence of the irradiation light on the intermediate transfer belt 71, and s-polarized light whose polarizing direction is perpendicular to the surface of incidence of the irradiation light. The p-polarized light impinges as it is upon the intermediate transfer belt 71, while the s-polarized light impinges upon the light receiver unit 604 for monitoring irradiated light amount after emitted from the polarizer beam splitter 603, so that a signal which is in proportion to the irradiated light amount is outputted to the irradiated light amount adjusting unit 605 from a light receiver element 642 of the light receiver unit 604.

Based on the signal from the light receiver unit 604 and a light amount control signal Slc from the CPU 101 of the engine controller 10, the irradiated light amount adjusting unit 605 feedback-controls the light emitter element 601 and adjusts the irradiated light amount of the light irradiated upon the intermediate transfer belt 71 from the light emitter element 601 into a value which corresponds to the light amount control signal Slc. The irradiated light amount can thus be changed and adjusted appropriately within a wide range according to this embodiment.

In addition, an input offset voltage 641 is applied to the output side of the light receiver element 642 of the light receiver unit 604 for monitoring irradiated light amount, and the light emitter element 601 is maintained turned off unless the light amount control signal Slc exceeds a certain signal level according to this embodiment. This prevents the light emitter element 601 from erroneously turning on because of a noise, a temperature drift, etc.

As the light amount control signal Slc having a predetermined level is fed to the irradiated light amount adjusting unit 605 is fed from the CPU 101, the light emitter element 601 turns on and p-polarized light is irradiated as irradiation light upon the intermediate transfer belt 71. The p-polarized light is reflected by the intermediate transfer belt 71. Of light components of the reflection light, a reflection light amount detector unit 607 detects the light amount of the p-polarized light and the light amount of the s-polarized light respectively, and signals corresponding to the respective light amounts are outputted to the CPU 101.

As shown in FIG. 4, the reflection light amount detector unit 607 comprises a polarized light beam splitter 671, a light receiver unit 670*p* and a light receiver unit 670*s*. The polarized light beam splitter 671 is disposed on an optical path of the reflection light. The light receiver unit 670*p* receives p-polarized light transmitted by the polarization light beam splitter 671 and outputs a signal which corresponds to the light amount of the p-polarized light. And the light receiver unit 670*s* receives spolarized light split by the polarization light beam splitter 671 and outputs a signal which corresponds to the light amount of the s-polarized light. In the light receiver unit 670*p*, a light receiver element 672*p* receives the p-polarized light from the polarization light beam splitter 671, and after an amplifier circuit 673*p* amplifies an output from the light receiver element 672*p*, an amplified signal is outputted as a signal Vp which corresponds to the light amount of the p-polarized light to the CPU 101. Meanwhile, like the light receiver unit 670*p*, the light receiver unit 670*s* comprises a light receiver unit 672*s* and an amplifier circuit 673*s* and outputs a signal Vs which corresponds to the light amount of the s-polarized light. Hence, it is possible to independently calculate the light amounts of the mutually different two component light (the p-polarized light and the s-polarized light) among the light components of the reflection light.

Further, in this embodiment, output offset voltages 674*p* and 674*s* are respectively applied to the output side of the light receiver elements 672*p* and 672*s*, and even when outputs from the respective light receiver elements are zero, that is, even when the reflection light amounts are zero, the amplifier circuits 673*p* and 673*s* reach a predetermined positive potential. This permits to output appropriate output voltages which correspond to the reflection light amounts while avoiding a dead zone in the vicinity of the zero inputs to the amplifier circuits 673*p* and 673*s*.

The signals representing these output voltages Vp and Vs are fed to the CPU 101 via an A/D converter circuit not shown, and the output voltages Vp and Vs are sampled at predetermined time intervals (which are 8 msec in this embodiment). Based on the results of the sampling, the CPU 101 adjusts density control factors for stabilization of an image density, such as the developing bias and the exposure energy, which affect an image density.

The adjustment operation is executed at proper timing which may be the time of turning on of the power source of the apparatus, immediately after any of the units has been exchanged, etc. To be more specific, while changing the density control factors above over multiple stages for each one of the toner colors, the image forming operation is executed in accordance with an image signal which is image data which correspond to a predetermined patch image pattern and are stored in advance in the ROM 106, whereby a small test image (patch image) corresponding to the image signal is formed. The density sensor 60 then detects a patch image density, and each density control factor is adjusted so that an optimal image forming condition to achieve a desired image density based on the result of the detection will be obtained. Adjustment operation of the density control factors will now be described.

(2) Adjustment Operation

Figure 5:
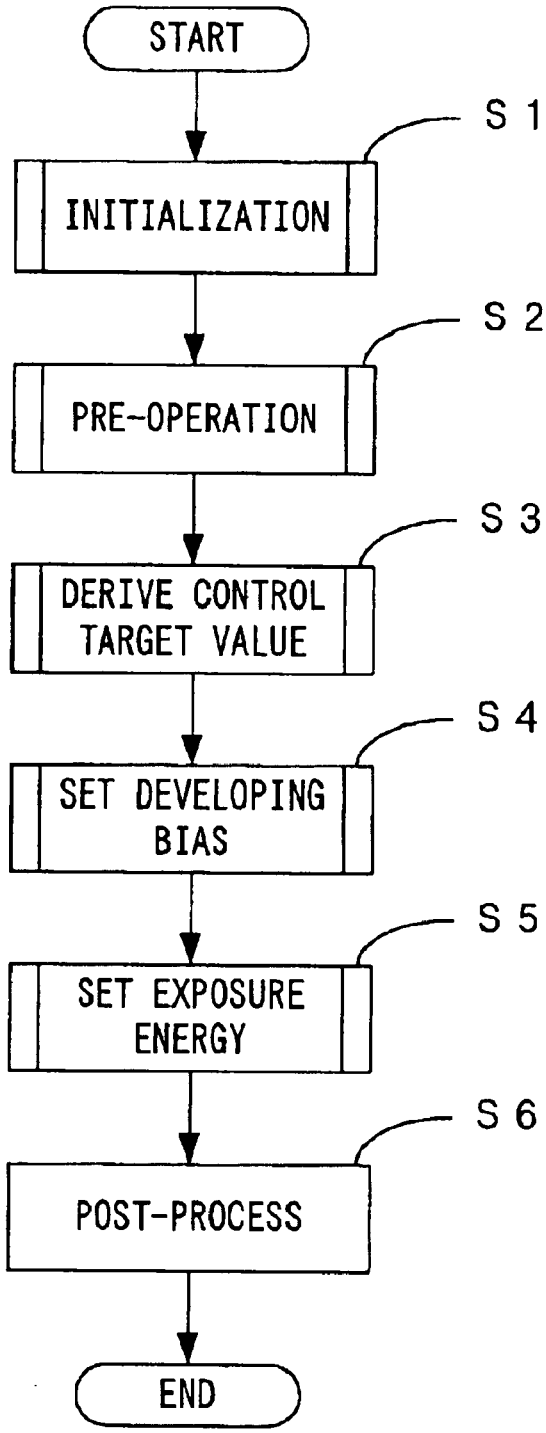
FIG. 5 is a flow chart which shows the outline of optimization of a density control factor in the first embodiment.

FIG. 5 is a flow chart which shows the outline of the adjustment operation of the density control factors in this embodiment. The operation includes six sequences in the following order: initialization (Step S1); a pre-operation (Step S2); a process of deriving a control target value (Step S3); a developing bias setting process (Step S4); an exposure energy setting process (Step S5); and a post-process (Step S6). In these sequences, steps S3 through S5 correspond to an "optimization" of the present invention. Detailed operations in the respective sequences will now be described.

A. Initialization

Figure 6:
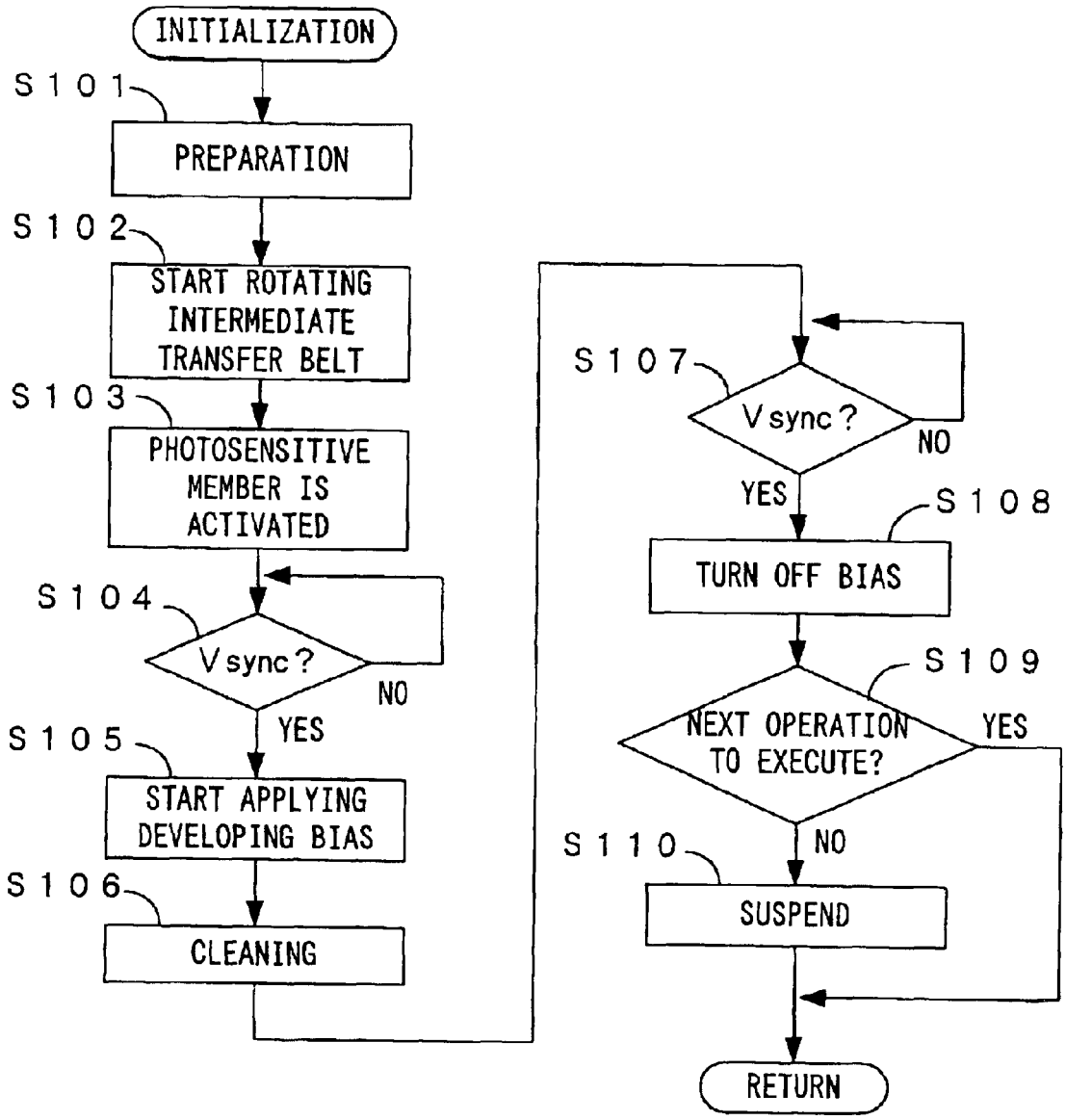
FIG. 6 is a flow chart which shows initialization in the apparatus of FIG. 1.

FIG. 6 is a flow chart which shows initialization in this embodiment. During the initialization, first, as preparation (Step S101), the developer unit 4 is driven into rotations and positioned at a so-called home position, and the cleaner 76 and the secondary transfer roller 78 are moved to positions away from the intermediate transfer belt 71 using the electromagnetic clutch. In this condition, driving of the intermediate transfer belt 71 is started (Step S102) and the photosensitive member 2 is driven into rotations and static elimination is started so that the photosensitive member 2 is activated (Step S103).

As the vertical synchronizing signal Vsync which is indicative of the reference position of the intermediate transfer belt 71 is detected and rotations of the intermediate transfer belt 71 is accordingly confirmed (Step S104), application of predetermined biases upon the respective portions of the apparatus is started (Step S105). That is, the charging controller 103 applies the electrifying bias upon the charger unit 3 to thereby electrify the photosensitive member 2 to a predetermined surface potential, and a bias generator not shown then applies a predetermined primary transfer bias upon the intermediate transfer belt 71.

In this condition, the intermediate transfer belt 71 is cleaned (Step S106). In short, the cleaner 76 abuts on the surface of the intermediate transfer belt 71 and the intermediate transfer belt 71 is then rotated approximately one round in this condition, thereby removing the toner, dirt and the like which remain adhering to the surface of the intermediate transfer belt 71. The secondary transfer roller 78 applied with a cleaning bias then abuts on the intermediate transfer belt 71. The cleaning bias has the opposite polarity to that of a secondary transfer bias which is applied upon the secondary transfer roller 78 during execution of an ordinary image forming operation. Hence, the toner which remains adhering to the secondary transfer roller 78 moves to the surface of the intermediate transfer belt 71, and the cleaner 76 removes the toner off from the surface of the intermediate transfer belt 71. As the cleaning of the intermediate transfer belt 71 and the secondary transfer roller 78 ends in this fashion, the secondary transfer roller 78 is moved away from the intermediate transfer belt 71 and the cleaning bias is turned off. Upon receipt of the next vertical synchronizing signal Vsync (Step S107), the electrifying bias and the primary transfer bias are turned off (Step S108).

Further, in this embodiment, the CPU 101 can execute initialization not only when adjustment of density control factors is to be performed but instead when needed independently of other processing. So, when the next process is to be executed following this (Step S109), the initialization is ended in the condition that the process has been executed up to the step S108 described above, and the next process is carried out. When the next process is not in a plan, as a suspend process (Step S110), the cleaner 76 is moved away from the intermediate transfer belt 71, and the static eliminating process and the drive-rotations of the intermediate transfer belt 71 is stopped. In this case, it is preferable that the intermediate transfer belt 71 is stopped in such a manner that the reference position of the intermediate transfer belt 71 is immediately before an opposed position facing the vertical synchronization sensor 77. This is because the state the intermediate transfer belt 71 is rotating is confirmed by means of detection of the vertical synchronizing signal Vsync when the intermediate transfer belt 71 is in rotations in subsequent processing, and it is therefore possible to determine in a short period of time whether there is abnormality based on whether the vertical synchronizing signal Vsync is detected immediately after the start of the driving in the manner described above.

B. Pre-operation

Figure 7:
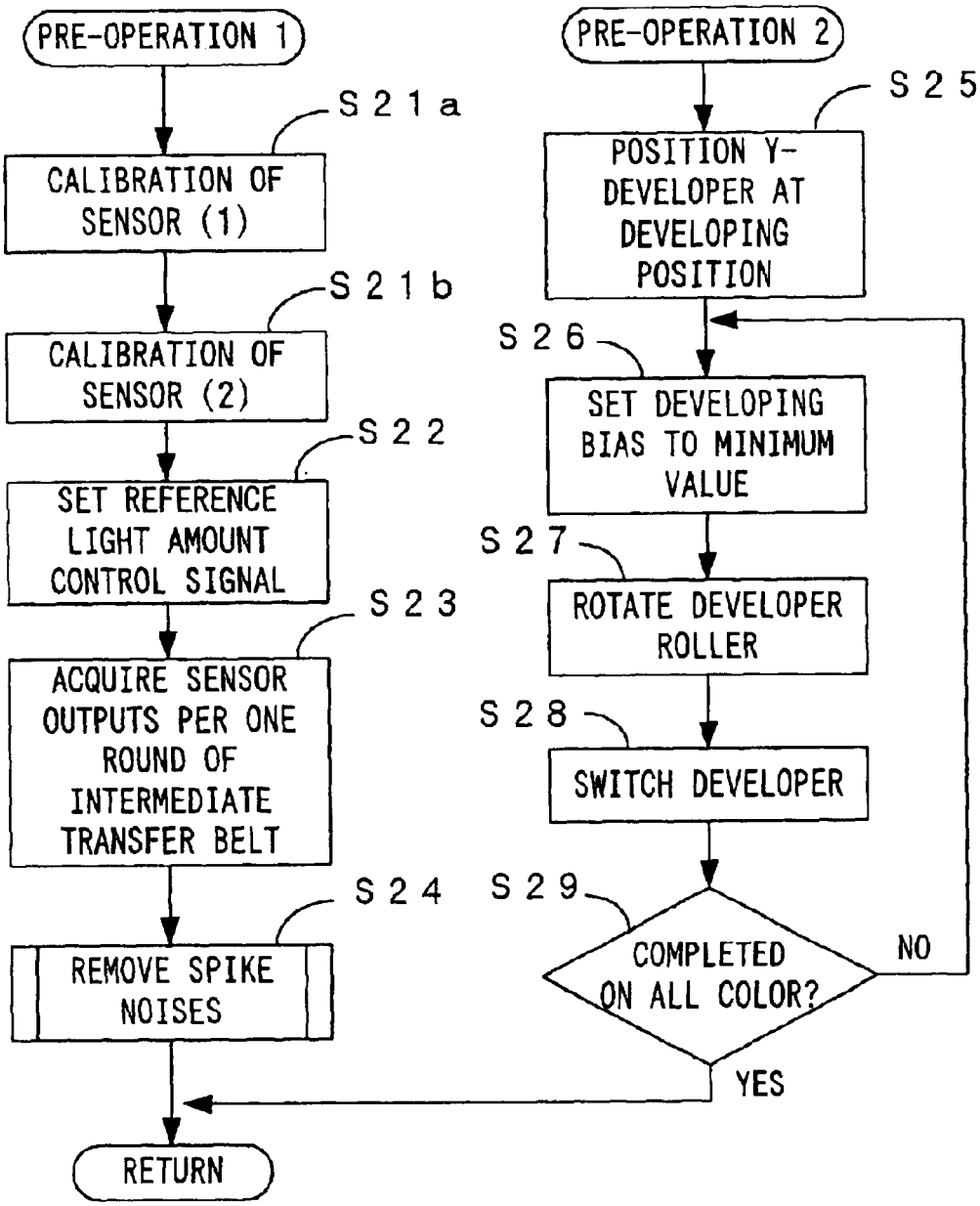
FIG. 7 is a flow chart which shows a pre-operation in the apparatus of FIG. 1.

FIG. 7 is a flow chart which shows a pre-operation in this embodiment. During the pre-operation, as pre-processing prior to formation of a patch image which will be described later, two processes are performed in parallel. More specifically, in parallel to adjustment of operating conditions for the respective portions of the apparatus in an effort to accurately optimize the density control factors (a pre-operation 1), the developer rollers 44 disposed to the respective developers 4Y, 4C, 4M and 4K are rotated idle (a pre-operation 2).

B-1. Setting Operating Conditions (Pre-operation 1)

During the left-hand side flow (the pre-operation 1) in FIG. 7, first, the density sensor 60 is calibrated (Step S21*a*, Step S21*b*). The calibration (1) at the step S21*a* requires to detect the output voltages Vp and Vs from the light receiver units 670*p* and 670*s* as they are when the light emitter element 601 of the density sensor 60 is OFF, and to store these as dark outputs Vpo and Vso. Next, during the calibration (2) at the step S21*b*, the light amount control signal Slc to be fed to the light emitter element 601 is changed so as to achieve two types of ON-states which are a low light amount and a high light amount, and the output voltage Vp from the light receiver unit 670*p* with each light amount is detected. From these three values, a reference light amount of the light emitter element 601 is calculated which ensures that the output voltage Vp in a toner adhesion-free state will be at a predetermined reference level (which is a value obtained by adding the dark output Vpo to 3 V in this embodiment). A level of the light amount control signal Slc which ensures that the light amount of the light emitter element 601 will be the reference light amount is thus calculated, and the calculated value is set as a reference light amount control signal (Step S22). Following this, when it becomes necessary to turn on the light emitter element 601, the CPU 101 outputs the reference light amount control signal to the irradiated light amount adjusting unit 605 and the light emitter element 601 is feedback-controlled so as to emit light always in the reference light amount.

The output voltages Vp and Vs as they are when the light emitter element 601 is OFF are stored as "dark outputs" of this sensor system. As these values are subtracted from the output voltages Vp and Vs at the time of detection of a density of a toner image, an influence of the dark outputs is eliminated and the density of the toner image is detected at a high accuracy, as described later.

An output signal from the light receiver element 672*p* with the light emitter element 601 turned on is dependent upon the amount of reflection light from the intermediate transfer belt 71. But as described later, since the condition of the surface of the intermediate transfer belt 71 is not always optically uniform, for the purpose of calculating the output in such a condition, it is desirable to calculate an average value across one round of the intermediate transfer belt 71. Further, while it is not necessary to detect output signals representing one round of the intermediate transfer belt 71 when the light emitter element 601 is OFF, in order to reduce a detection error, it is preferable to average out output signals obtained at more than one points.

In this embodiment, since the surface of the intermediate transfer belt 71 is white, reflectance of light is high. The reflectance however decreases when the toner in any color adheres on the intermediate transfer belt 71. Hence, in this embodiment, as the amount of the toner adhering to the surface of the intermediate transfer belt 71 increases, the output voltages Vp and Vs from the light emitter units decrease from the reference level. And therefore, it is possible to estimate the amount of the adhering toner, and further an image density of a toner image, from the values of the output voltages Vp and Vs.

In addition, since the reflection characteristics are different between color (Y, C, M) toner and black (K) toner, this embodiment requires to calculate a density of a patch image formed with black toner described later based on the light amount of p-polarized light included in reflection light from the patch image, but to calculate a density of a patch image formed with color toner based on a light amount ratio of p-polarized light and s-polarized light. Hence, it is possible to accurately calculate an image density over a wide dynamic range.

Referring back to FIG. 7, the pre-operation will be continuously described. The condition of the surface of the intermediate transfer belt 71 is not always optically uniform, and fused toner during use may gradually lead to discoloration, dirt, etc. To prevent a change in surface condition of the intermediate transfer belt 71 from causing an error in detection of a density of a toner image, this embodiment requires to acquire a foundation profile covering one round of the intermediate transfer belt 71, namely, information regarding shading on the surface of the intermediate transfer belt 71 which does not carry a toner image. To be more specific, the light emitter element 601 is made emit light in the reference light amount calculated earlier, the intermediate transfer belt 71 is made rotate one round while sampling the output voltages Vp and Vs from the light receiver units 670*p* and 670*s* (Step S23), and the sample data (the number of samples in this embodiment: 312) are stored as a foundation profile in a RAM 107. With the shading in the respective areas on the surface of the intermediate transfer belt 71 grasped in advance in this fashion, it is possible to more accurately estimate a density of a toner image which is formed on the intermediate transfer belt 71.

Figure 8A:
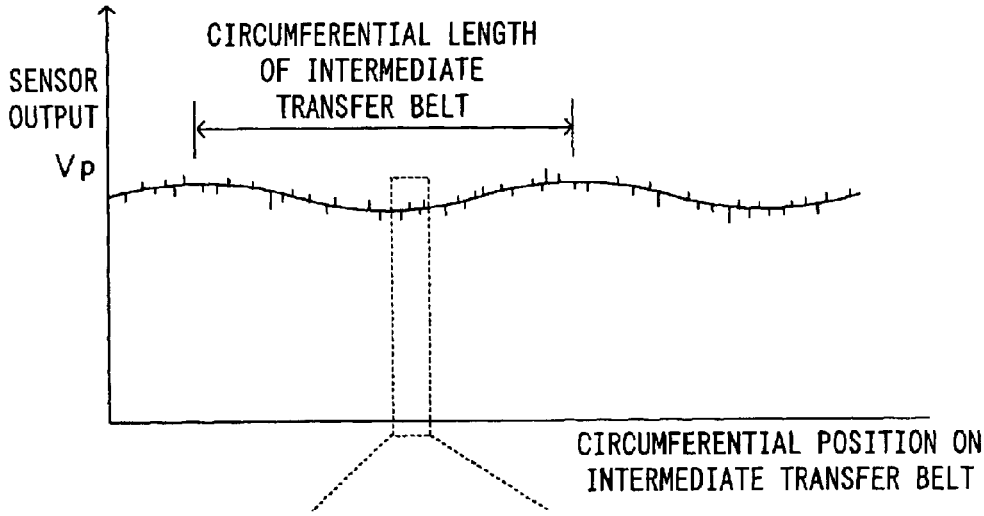
FIGS. 8A and 8B are drawings which show an example of a foundation profile of an intermediate transfer belt.
Figure 8B:
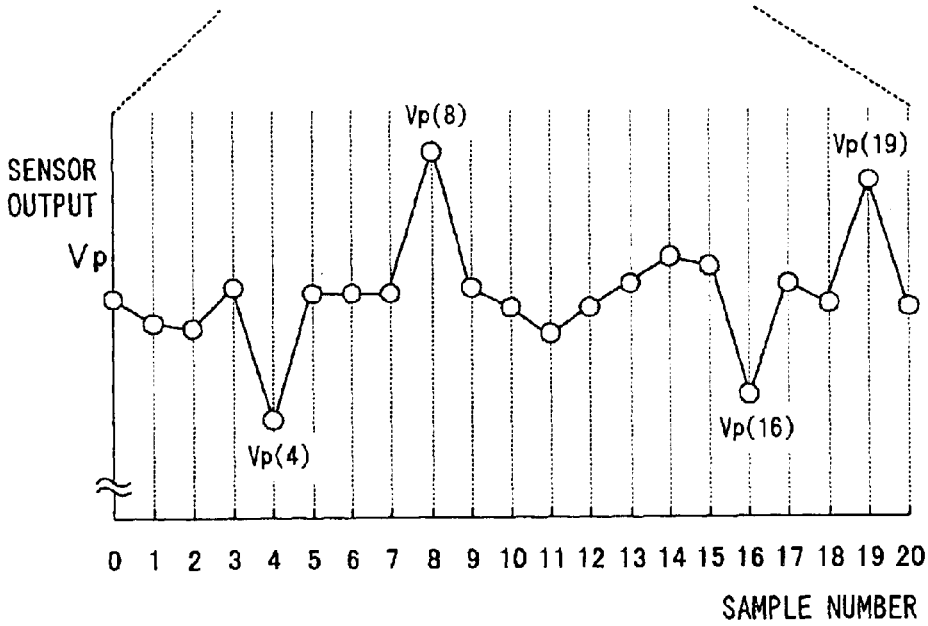

By the way, in some cases, changes in reflectance due to a very small scars or dirt on the roller 75 and the intermediate transfer belt 71, and further, spike-like noises attributed to an electric noise mixed in a sensor circuit may get superimposed on the output voltages Vp and Vs from the density sensor 60 described above. FIGS. 8A and 8B are drawings which show an example of the foundation profile of the intermediate transfer belt. When one detects with the density sensor 60 and plots the amount of reflection light from the surface of the intermediate transfer belt 71 over one round or more of the intermediate transfer belt 71, the output voltage Vp from the density sensor 60 cyclically changes in accordance with the circumferential length or the rotating cycles of the intermediate transfer belt 71, and further, narrow spike-like noises may sometimes get superimposed over the waveform of the output voltage Vp. These noises may possibly contain both a component which is in synchronization to the rotating cycles and an irregular component which is not in synchronization to the rotating cycles. FIG. 8B shows a part of such a sample data string as it is enlarged. In FIG. 8B, two data pieces denoted at Vp(8) and Vp(19) among the respective sample data pieces are dominantly larger than the other data pieces and two data pieces denoted at Vp(4) and Vp(16) are dominantly smaller than the other data pieces because of superimposition of the noises. Although only the p-polarized light component among the two outputs from the sensor is described here, a similar concept applies to the s-polarized light component, too.

A detectable spot diameter of the density sensor 60 is about 2 to 3 mm for instance, while discoloration, dirt and the like of the intermediate transfer belt 71 are generally in a size of a larger range. Hence, one can conclude that these local spikes in the data are due to the influence of the noises described above. When a foundation profile, a density of a patch image or the like is calculated based on such sample data which contain superimposed noises and density control factors are set in accordance with the result of the calculation, it may become impossible to set each density control factor always to a proper condition and an image quality may deteriorate.

Noting this, as shown in FIG. 7, after sampling the outputs from the sensor over one round of the intermediate transfer belt 71 at the step S23, the spike noises are removed in this embodiment (Step S24).

Figure 9:
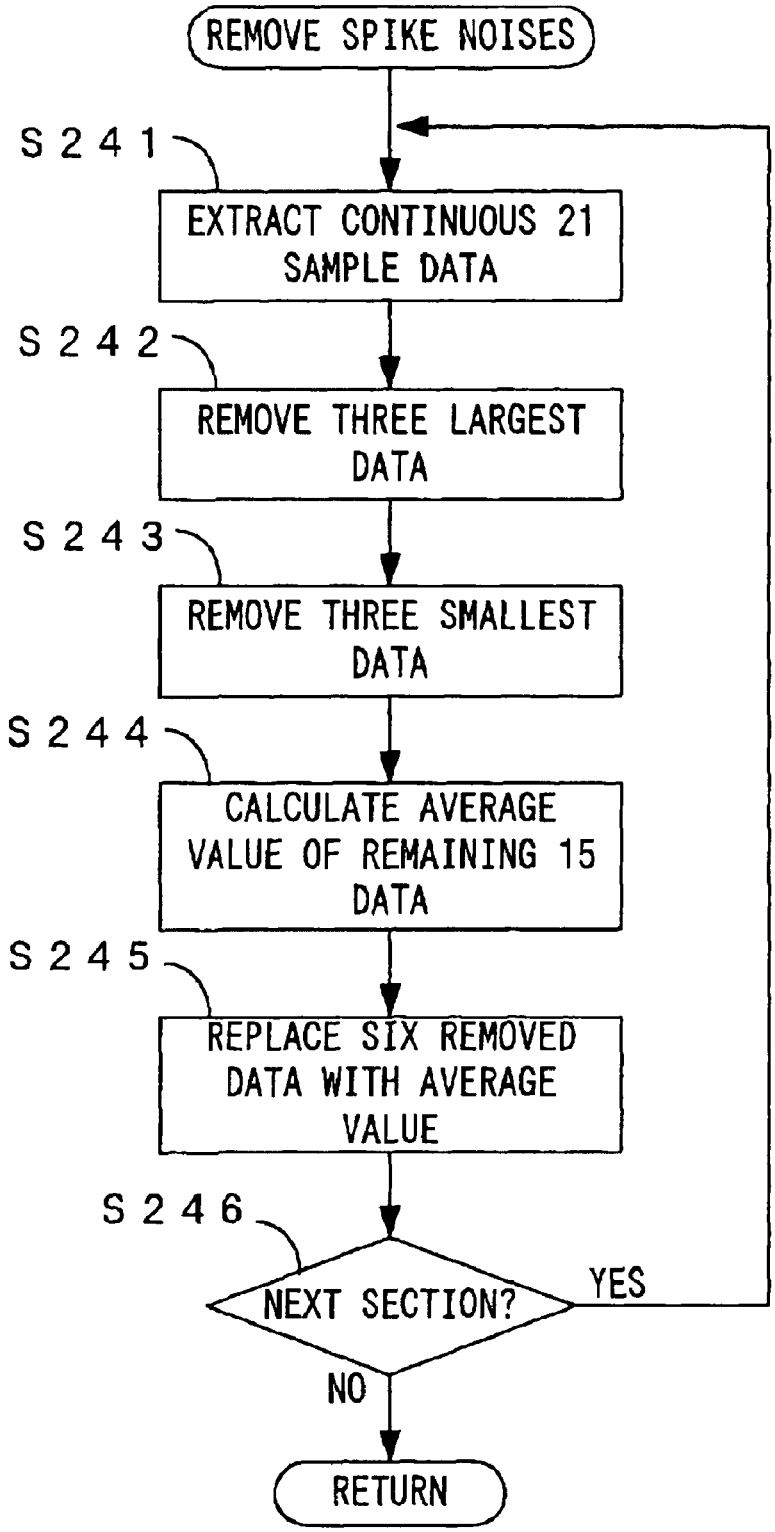
FIG. 9 is a flow chart which shows a spike noise removing process in the apparatus of FIG. 1.

FIG. 9 is a flow chart which shows a spike noise removing process in this embodiment. During the spike noise removing process, of an acquired sample data string as it is "raw," that is, as it has not been processed, a continuous local section (whose length corresponds to 21 samples in this embodiment) is extracted (Step S241), and after removing data pieces having the three highest and the three lowest levels from the 21 sample data pieces contained in this section (Step S242, Step S243), an arithmetic average of the remaining 15 data pieces is calculated (Step S244). The average value is regarded as an average level in this section, and the six data pieces removed at the steps S242 and S243 are replaced with the average value, whereby a noise-free "corrected" sample data string is obtained (Step S245). Further, the steps S241 through S245 are repeated for the next section as well when necessary, thereby removing spike noises (Step S246).

Figure 10:
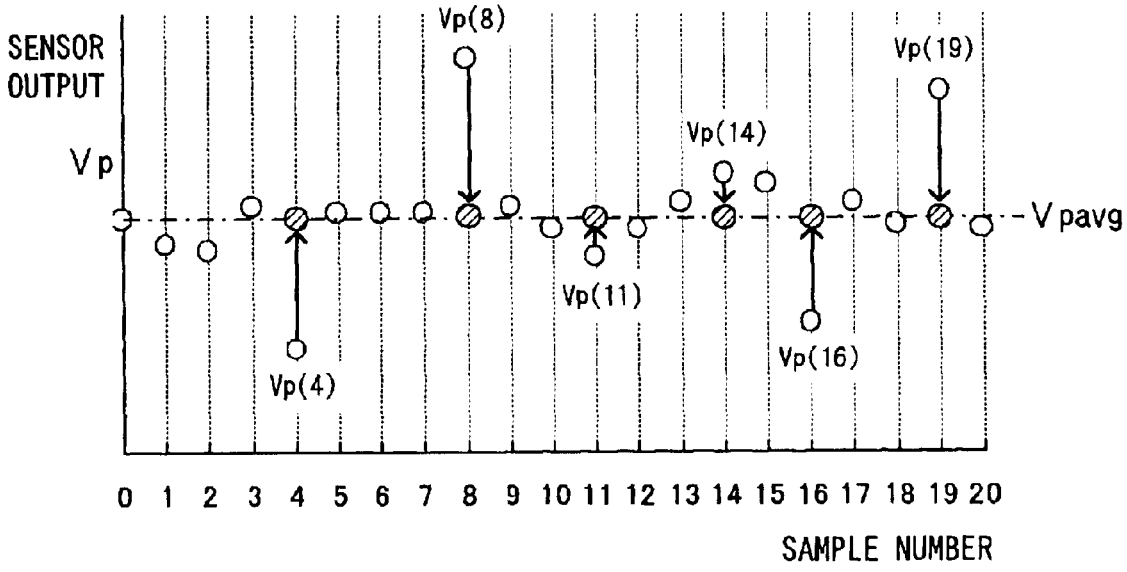
FIG. 10 is a drawing which shows spike noise removal in the apparatus of FIG. 1.

Removal of spike noises during the process above will now be described in more detail on the data string shown in FIG. 8B, while referring to FIG. 10. FIG. 10 is a drawing which shows spike noise removal in this embodiment. In the data string shown in FIG. 8B, the influence of the noises seems to be visible over the two data pieces Vp(8) and Vp(19) which are dominantly larger than the other data pieces and the two data pieces Vp(4) and Vp(16) which are dominantly smaller than the other data pieces. Since the spike noise removing process requires to remove the three largest sample data pieces (Step S242 in FIG. 9), those which are to be removed are the three data pieces Vp(8), Vp(14) and Vp(19) including the two data pieces which seem to contain the noises. In a similar manner, the three data pieces Vp(4), Vp(11) and Vp(16) including the two data pieces which seem to contain the noises are also removed (Step S243 in FIG. 9). As these six data pieces are replaced with the average value Vpavg of the other 15 data pieces (denoted at the shadowed circles) as shown in FIG. 10, the spike noises which used to be contained in the original data are removed.

For spike noise removal, the number of samples to be extracted and the number of data pieces to be removed are not limited to those described above but may be any desired numbers. However, since it becomes impossible to obtain a sufficient noise removing effect and an error may intensify depending on a choice of these numbers, it is desirable to carefully determine these numerical figures in view of the following points.

That is, extraction of too short a section of a data string as compared to the frequency of noises pushes up the possibility that noises are not included in the section within which spike noise removal will be executed and increases the number of calculations, and therefore, is not efficient. On the other hand, extraction of too long a section ends up in averaging out even significant variations in sensor output, namely, variations which represent a density change of an object of detection, and thus makes it impossible to correctly calculate a density profile despite the original purpose.

Further, since the frequency of noises is not constant, uniform removal of a predetermined number of largest or smallest data pieces from an extracted data string may result in removal of data such as data pieces Vp(11) and Vp(14) which do not contain noises, or on the contrary, may fail to sufficiently remove noises. Even when a few noise-free data components get removed, as shown in FIG. 10, since a difference between the data pieces Vp(11) and Vp(14) and the average value Vpavg is relatively small, an error attributed to replacement of these data pieces with the average value Vpavg is small. On the other hand, when the noise-containing data pieces are left not removed, replacement of the other data pieces with an average value calculated including these noise-containing data pieces may increase an error. Hence, it is desirable to calculate a ratio of the number of data pieces to be removed to the number of extracted sample data pieces such that the ratio will be comparable to or slightly higher than the frequency of noises created in the actual apparatus.

The spike noise removing process in this embodiment is designed as described above, based on the empirical fact that the frequency of data pieces shifted to be larger than an originally intended profile due to an influence of noises was about the same as the frequency of data pieces shifted to be smaller than the originally intended profile due to the influence of the noises and that the frequency of the noises themselves was about 25% or lower (five or fewer samples out of 21 samples) as shown in FIG. 8A.

Various other methods than the one described above may be used as a method of removing spike noises. For instance, it is possible to remove spike-like noises by processing "raw" sample data obtained through sampling with conventional low-pass filtering. However, since conventional filtering changes not only noise-containing data but also neighboring data from original values although it is possible to make a noise waveform less sharp, a large error may arise depending on the state of noises.

On the contrary, according to this embodiment, since the corresponding number of largest or smallest data pieces to the frequency of noises are replaced with an average value in sample data and the other data pieces are left unchanged, it is less likely that such an error will arise.

The spike noise removing process is executed not only for calculation of the foundation profile described above, but is performed also on sample data which were acquired as the amount of reflection light for the purpose of calculating an image density of a toner image as described later.

B-2. Idling of Developer (Pre-operation 2)

It is known that when the power source is OFF or even when the power source is ON, if there has been continuation of the operation-suspended state without any image forming operation performed over a long period of time before the next image forming operation, an image may have a cyclic density variation. This phenomenon will be hereinafter referred to "shutdown-induced banding." The inventors of the present invention have found that the cause of shutdown-induced banding is because toner fixedly adheres to the developer roller 44 after left carried on the developer roller 44 of each developer for a long time and because the layer of the toner on the developer roller 44 gradually becomes uneven as the amount of the adhering toner and the retention force of the adhering toner are not uniform on the surface of the developer roller 44. For instance, in the developer 4K according to this embodiment shown in FIG. 3, when the developer roller 44 has stopped rotating, the supply roller 43 or the restriction blade 45 abuts locally on the developer roller 44, with the toner rests on the developer roller 44 under pressure. Further, while a portion of the surface located inside the housing 41 is covered with a great amount of the toner and the toner T rests on the developer roller 44 under pressure with the supply roller 43 abutting on, a portion of the surface located outside the housing 41 is exposed to air as it carries a thin layer of the toner. The condition of the surface of the developer roller 44 is thus uneven in the circumferential direction of the developer roller 44.

Noting this, for the purpose of eliminating shutdown-induced banding before formation of a patch image, each developer roller 44 is rotated idle in the image forming apparatus according to this embodiment. As the right-hand side flow (the pre-operation 2) in FIG. 7 shows, first, the yellow developer 4Y is positioned at the developing position facing the photosensitive member 2 (Step S25), and after setting the average developing bias Vavg to a value having the smallest absolute value within a variable range of the average developing bias (Step S26), the developer roller 44 is rotated at least one round using the rotation driver (not shown) which is disposed to the main section (Step S27). Following this, while rotating the developer unit 4 and thereby switching the developer (Step S28), the other developers 4C, 4M and 4K are positioned at the developing position in turn and the developer roller 44 disposed to each developer is rotated one round or more. As each developer roller 44 is rotated idle one round or more in this manner, a toner layer on the surface of each developer roller 44 is peeled off and re-formed by the supply roller 43 and the restriction blade 45. Hence, thus re-formed more uniform toner layer is used for subsequent formation of a patch image, which makes it less likely to see a density variation attributed to shutdown-induced banding.

During the pre-operation 2 described above, the average developing bias Vavg is set so as to have the smallest absolute value at the step S26. The reason is as follows.

As described later, with respect to the average developing bias Vavg serving a density control factor which affects an image density, the larger the absolute value |Vavg| of the average developing bias Vavg is, the higher a density of a formed toner image becomes. This is because the larger the absolute value |Vavg| becomes, a potential difference increases which develops between an area in the electrostatic latent image on the photosensitive member 2 exposed with the light beam L, namely, the surface area which the toner is to adhere to, and the developer roller 44, and the movement of the toner from the developer roller 44 is further facilitated. However, at the time of acquisition of the foundation profile of the intermediate transfer belt 71, a such toner movement is not desirable. This is because as the toner which has moved from the developer roller 44 to the photosensitive member 2 transfers onto the intermediate transfer belt 71 within the primary transfer region TR1, the transferred toner changes the amount of reflection light from the intermediate transfer belt 71, and it becomes impossible to correctly calculate the foundation profile.

In this embodiment, as described later, the average developing bias Vavg can be changed over stages within a predetermined variable range, as one of density control factors. Noting this, with the average developing bias Vavg set to a value having the smallest absolute value within the variable range, such a state is realized which least likely leads to a movement of toner from the developer roller. 44 to the photosensitive member 2, and adhesion of the toner to the intermediate transfer belt 71 is suppressed to minimum. For a similar reason, in an apparatus in which a developing bias contains an alternating current component, it is preferable that the amplitude of the developing bias is set to be smaller than an amplitude for ordinary image formation. For example, as described earlier, in an apparatus requiring the peak-to-peak voltage Vpp of the developing bias to be 1400 V, the peak-to-peak voltage Vpp may be about 1000 V. In an apparatus using a duty ratio of the developing bias, the electrifying bias and the like for instance as density control factors, too, it is preferable that the density control factors are set appropriately so as to realize a condition which less likely leads to a movement of toner as that described above.

Further, this embodiment requires to simultaneously execute the pre-operation 1 and the pre-operation 2 described above parallel to each other, for the purpose of shortening a processing time. In other words, while the pre-operation 1 demands, for acquisition of the foundation profile, to rotate the intermediate transfer belt 71 idle at least one round or more preferably three rounds including two rounds needed for calibration of the sensor, it is preferable to rotate the developer roller 44 idle as much as possible also during the pre-operation 2. Since these processes can be executed independently of each other, parallel execution makes it possible to shorten a period of time needed for the entire operation while ensuring time needed for each one of these processes. In this embodiment, two pre-operation processes, namely, the pre-operation 1 which includes "preceding processing" of the present invention and the pre-operation 2 which includes "idling" of the present invention, are executed in parallel.

C. Derive Control Target Value

In the image forming apparatus according to this embodiment, as described later, two types of toner images are formed as patch images and each density control factor is adjusted so that densities of these toner images will have a density target value. The target value is not a constant value but may be changed in accordance with an operating state of the apparatus. The reason is as follows.

As described earlier, in the image forming apparatus according to this embodiment, the amount of reflection light from a toner image which has been visualized on the photosensitive member 2 and primarily transferred on the surface of the intermediate transfer belt 71 is detected, and an image density of the toner image is estimated. While there are widely used conventional techniques for calculating an image density from the amount of reflection light from a toner image, as described below in detail, a correlation between the amount of reflection light from a toner image carried on the intermediate transfer belt 71 (or the sensor outputs Vp and Vs which correspond to the light amount) and an optical density (OD value) of a toner image formed on the sheet S which is a final recording medium is not determined uniformly but changes slightly depending on the conditions of the apparatus, the toner, etc. In short, a "toner density" of a patch image estimated from sensor outputs does not strictly match with the true "image density" of a formed image. Because of this, even when each density control factor is controlled such that a "toner density" based on sensor outputs will be constant as customarily practiced, an "image density" of an image finally formed on the sheet S varies depending on the condition of toner.

Figure 11A:
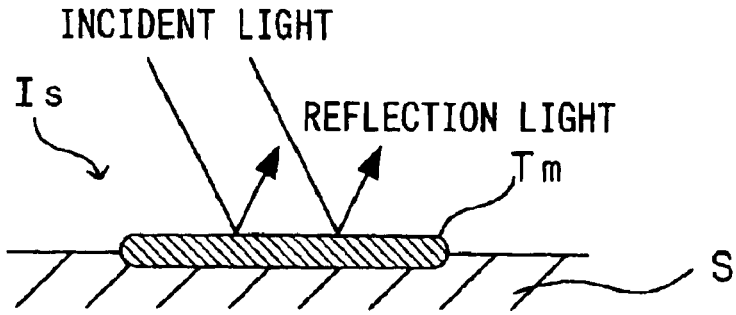
FIGS. 11A, 11B and 11C are schematic diagrams which show a relationship between a particle diameter of toner and the amount of reflection light.
Figure 11B:
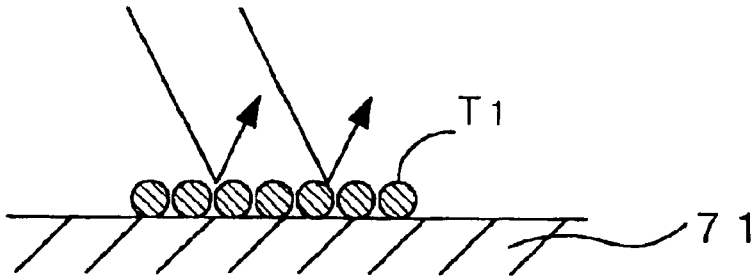
Figure 11C:
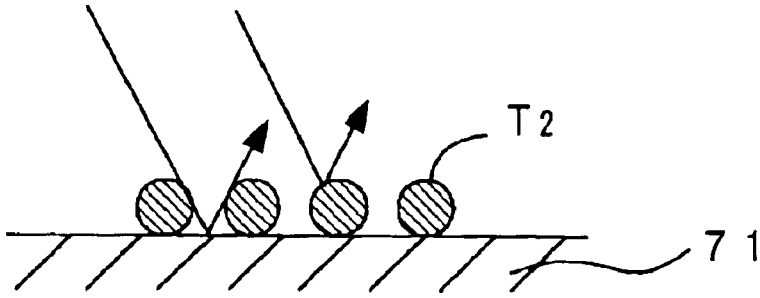

One cause that the sensor outputs fail to match with an OD value on the sheet S is that toner fused on the sheet S after a fixing process reflects differently from toner merely adhering to the surface of the intermediate transfer belt 71 without getting fixed to the surface of the intermediate transfer belt 71. FIGS. 11A, 11B and 11C are schematic diagrams which show a relationship between a particle diameter of toner and the amount of reflection light. As shown in FIG. 11A, in an image is eventually formed on the sheet S, toner Tm melted by heat and pressure during the fixing process has fused on the sheet S. Hence, while an optical density (OD value) of the image represents the amount of reflection light as it is with the toner fused, the value of the optical density is determined mainly by a toner density on the sheet S (which can be expressed as a toner mass per unit surface area for instance).

On the contrary, in the case of the toner image on the intermediate transfer belt 71 which has not been through the fixing process, toner particles merely adhere to the surface of the intermediate transfer belt 71. Hence, even when the toner density is the same (That is, even when the OD value after the fixing is the same.), the amount of reflection light is not necessarily the same between a state that toner T1 having a small particle diameter shown in FIG. 11B has adhered in a high density and a state that toner T2 having a large particle diameter shown in FIG. 11C has adhered in a low density and the surface of the intermediate transfer belt 71 is locally exposed. In other words, even when the amount of reflection light from the pre-fixing toner image is the same, a post-fixing image density (OD value) does not always become the same. The experiment conducted by the inventors of the present invention has identified that in general, when the amount of reflection light is the same, if a ratio of toner having a large particle diameter to toner particles which form a toner image, a post-fixing image density tends to be high.

Figure 12A:
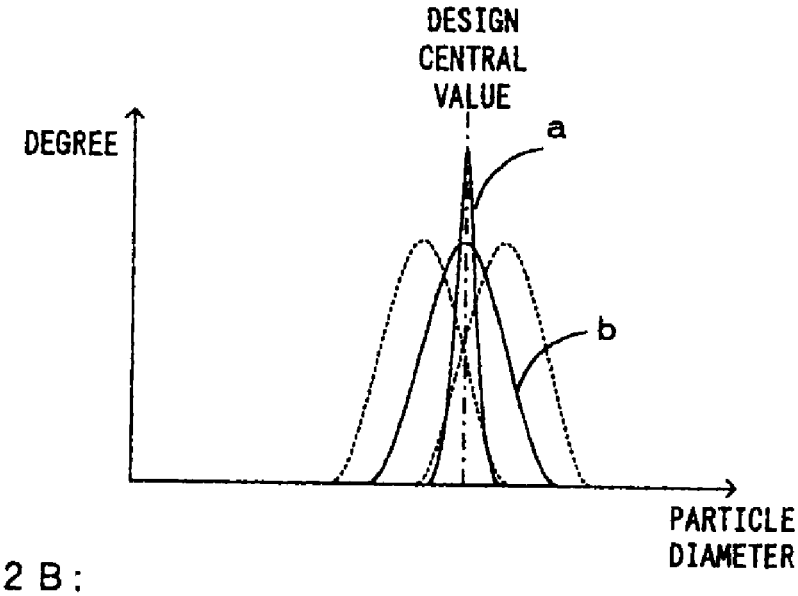
FIGS. 12A and 12B are drawings which show how a toner particle diameter distribution and a change in OD value relate to each other.
Figure 12B:
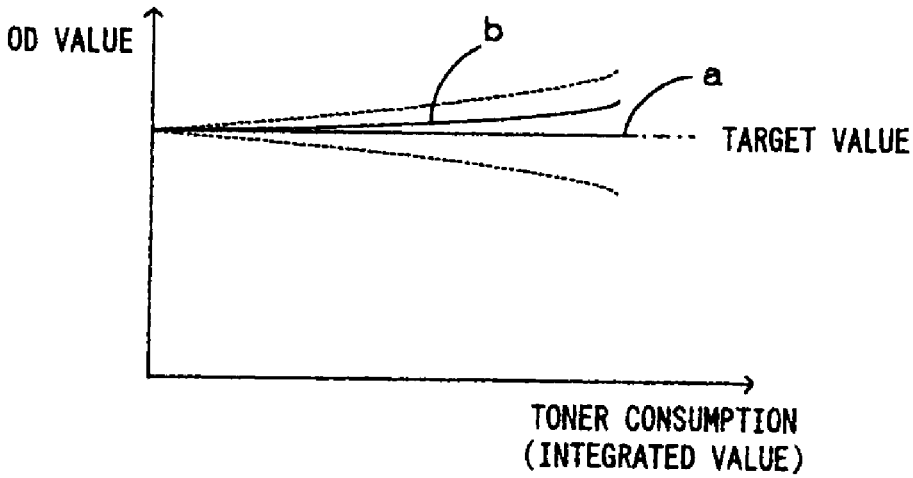

In this manner, a correlation between an OD value on the sheet S and the amount of reflection light from a toner image on the intermediate transfer belt 71 changes in accordance with the condition of toner, and particularly, a distribution of toner particle diameters. FIGS. 12A and 12B are drawings which show how a particle diameter distribution of toner and a change in OD value relate to each other. It is ideal that particle diameters of toner particles housed for formation of a toner image in the respective developers are all aligned to a design central value. However, as shown in FIG. 12A, in reality, the particle diameters are distributed in various manners depending on the type of the toner, a method of manufacturing the toner and the like of course. Even in the case of toner manufactured to meet the same specifications, the distribution slightly changes for each production batch and each product.

Since the mass, the electrification amount and the like of toner having various particle diameters are different, when an image is formed with the toner having such a particle diameter distribution, use of these toner is not uniform. Rather, such toner whose particle diameters are suitable to the apparatus is selectively used, and the other toner are left in the developers without used very much. Hence, as the toner consumption increases, the particle diameter distribution of the toner remaining in the developers changes.

As described earlier, since the amount of reflection light from a pre-fixing toner image changes in accordance with the diameters of the particles which form the toner, even though each density control factor is adjusted so that the amount of reflection light will be constant, a density of an image fixed on the sheet S does not always become constant. FIG. 12B shows a change in optical density (OD value) of an image on the sheet S which was formed while controlling each density control factor so that the amount of reflection light from a toner image, namely, the output voltages from the density sensor 60 will be constant. In the event that the toner particle diameters are well aligned in the vicinity of the design central value as denoted at the curve a in FIG. 12A, even when the consumption of the toner in the developers advances, the OD value is maintained approximately at a target value, as denoted at the curve a in FIG. 12B. On the contrary, as denoted at the curve b in FIG. 12A, when toner whose particle diameter distribution is wider is used, although toner whose particle diameters are close to the design central value is mainly used and an OD value almost the same as a target value is obtained initially as denoted at the curve b in FIG. 12B, as the toner consumption increases, the proportion of the popular toner decreases, toner having larger particle diameters starts to be used for formation of an image, and the OD value gradually increases. Further, as denoted at the dotted curves in FIG. 12A, a median value of the distribution is sometimes off the design value from the beginning depending on a production batch of the toner or the developers, and the OD value on the sheet S accordingly changes in various manners as more toner is used as denoted at the dotted curves in FIG. 12B.

Factors which influence a characteristic of toner include, in addition to a particle diameter distribution of the toner described above, the condition of pigment dispersion within mother particles of the toner, a change in electrifying characteristic of the toner owing to the condition of mixing of the toner mother particles and an additive, etc. Since a toner characteristic slightly varies among products, an image density on the sheet S is not always constant and the extent of a density change varies depending on toner which is used. Hence, in a conventional image forming apparatus in which each density control factor is controlled so that output voltages from a density sensor will be constant, a variation in image density because of a variation in toner characteristic is unavoidable and it therefore is not always possible to obtain a satisfactory image quality.

Figure 13:
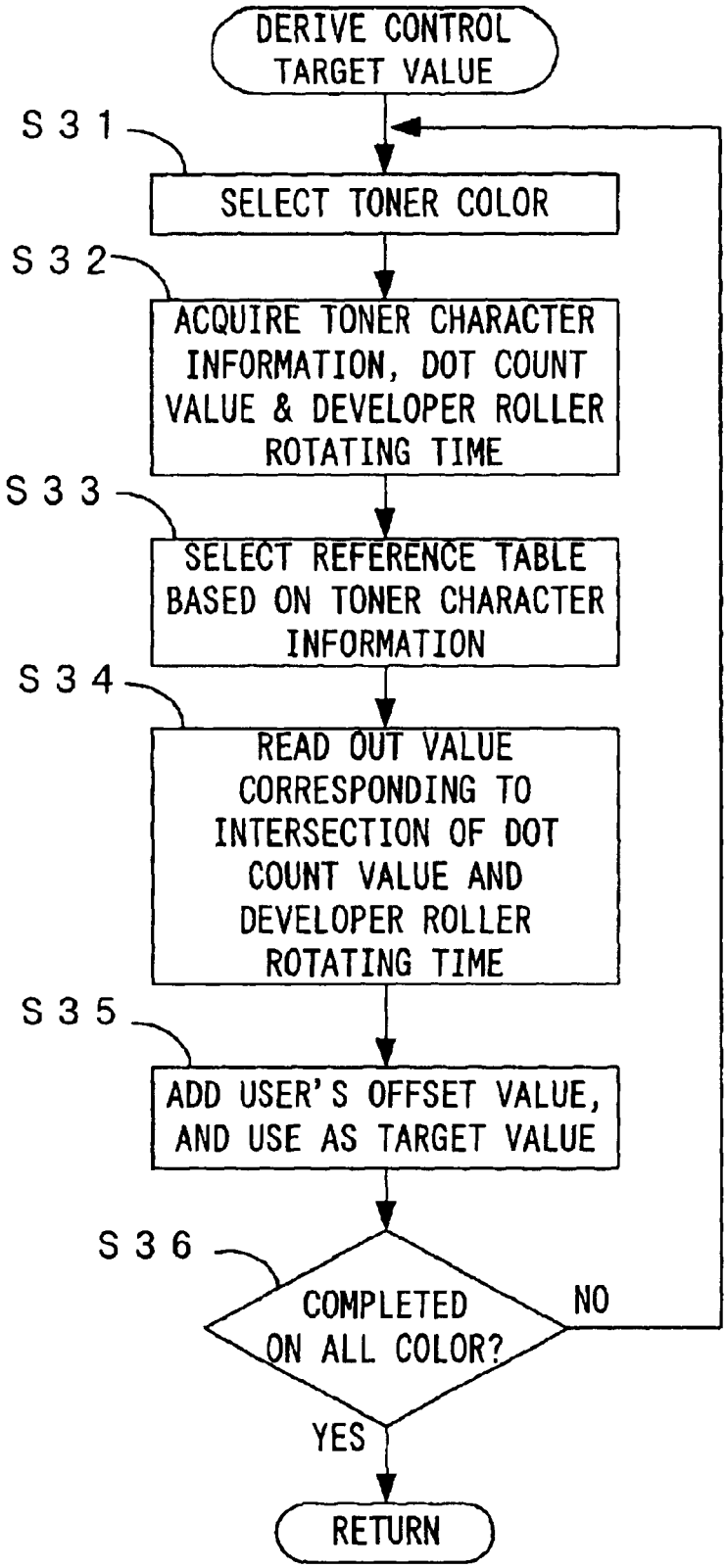
FIG. 13 is a flow chart which shows a process of deriving a control target value in the apparatus of FIG. 1.

Noting this, in this embodiment, with respect to each one of two types of patch images described later, a control target value for an image density evaluation value (described later) which represents the image density is set in accordance with an operating state of the apparatus, and each density control factor is adjusted so that the evaluation value for each patch image will be the control target value, whereby an image density on the sheet S is maintained constant. FIG. 13 is a flow chart which shows a process of deriving the control target values in this embodiment. In this process, for each toner color, a control target value suiting the condition of use of the toner, namely, an initial characteristic such as a particle diameter distribution of the toner upon introduction into the developers, and the amount of the toner which remains the developer, are calculated. First, one of the toner colors is selected (Step S31), and the CPU 101 acquires, as information for estimating the condition of use of the toner, "toner character information" regarding the selected toner color, a "dot count" value which expresses the number of dots formed by the exposure unit 6 and information regarding a "developer roller rotating time (Step S32)". Although the description here relates to an example that a control target value corresponding to the black color is calculated, the description should remain similar on the other toner colors, too.

"Toner character information" is data written in a memory 94 which is disposed to the developer 4K in accordance with characteristics of the toner which is housed in the developer 4K. In this apparatus, noting that various characteristics such as the particle diameter distribution of the toner described above are different among different production batches, the characteristics of the toner are classified into eight types. The type of the toner is then determined based on an analysis during production, and 3-bit data representing the type are fed as toner character information to the developer 4K. This data are read out from the memory 94 when the developer 4K is mounted to the developer unit 4 and stored in the RAM 107 of the engine controller 10.

Meanwhile, a "dot count value" is information for estimating the amount of the toner which remains within the developer 4K. While to calculate from an integrated value of the number of formed images is the simplest method of estimating the remaining amount of the toner, it is difficult to learn about an accurate remaining amount with this method since the amount of the toner consumed by formation of one image is not constant. On the other hand, the number of dots formed by the exposure unit 6 on the photosensitive member 2 is indicative of the number of dots which are visualized on the photosensitive member 2 with the toner, the number of dots more accurately represents the consumed amount of the toner. Noting this, in this embodiment, the number of dots as it is when the exposure unit 6 has formed an electrostatic latent image on the photosensitive member 2 which is to be developed by the developer 4K is counted and stored in the RAM 107. Thus stored dot count value is used as information which represents the amount of the toner which remains within the developer 4K.

In addition, a "developer roller rotating time" is information for estimating in more detail the characteristics of the toner which remains within the developer 4K. As described earlier, there is the toner layer on the surface of the developer roller 44, and some of the toner moves onto the photosensitive member 2 and development is realized. At this stage, on the surface of the developer roller 44, the toner which has not contributed to the development is transported to an abutting position on the supply roller 43 and peeled off by the supply roller 43, thereby forming a new toner layer. As adhesion to and peeling off from the developer roller 44 is repeated in this manner, the toner is fatigued and the characteristics of the toner gradually change. Such a change in toner characteristics intensifies as the developer roller 44 rotates further. Hence, even when the amounts of toner remaining within the developer 4K is the same, there sometimes is a difference in characteristics between fresh toner which has not been used yet and old toner which has repeatedly adhered and has been peeled off. Densities of images formed using these toner may not necessarily be the same.

Noting this, in this embodiment, the condition of the toner housed inside the developer 4K is estimated based on a combination of two pieces of information, one being a dot count value which represents a remaining toner amount and the other being a developer roller rotating time which represents the extent of a change in toner characteristics, and a control target value is set more finely in accordance with the toner condition in order to stabilize an image quality.

These pieces of information are used also for the purpose of enhancing the ease of maintenance through management of the states of wear-out of the respective portions of the apparatus. That is, one dot count corresponds to a toner amount of 0.015 mg. When 12000000 dot counts are reached, the consumption of the toner is about 180 g, which means that almost all of the toner stored in each developer has been used up. With respect to a developer roller rotating time, an integrated value of 10600 sec derived from the developer roller rotating time corresponds to 8000 pages of continuous printing in the JIS (Japanese Industrial Standard) A4 size, and therefore, it is not preferable to continue formation of images any more considering an image quality. In this embodiment, therefore, when any one of these pieces of information reaches the value above, a message indicative of the end of the toner appears in a display not shown to thereby encourage a user to exchange the developers.

From these information regarding the operating state of the apparatus thus acquired, a control target value suiting the operating state is determined. This embodiment requires to calculate in advance through experiments optimal control target values which are proper to toner character information which expresses the type of the toner and to characteristics of the remaining toner estimated based on a combination of the dot count value and the developer roller rotating time. These values are stored as look-up tables by toner type in the ROM 106 of the engine controller 10. Based on thus acquired toner character information, the CPU 101 selects one table which is to be referred to in accordance with the type of the toner (Step S33), and reads out from the table a value which corresponds to the combination of the dot count value and the developer roller rotating time at that time (Step S34).

Further, in the image forming apparatus according to this embodiment, as a user enters an input through a predetermined operation on an operation part not shown, a density of an image to be formed is increased or decreased within a predetermined range in accordance with the user's preference or when such is necessary. In short, every time the user increases or decreases the image density by one notch in response to the value thus read out from the look-up table described above, a predetermined offset value which may be 0.005 per notch for instance is added or subtracted, and the result of this is set as a control target value Akt for the black color at that time and stored in the RAM 107 (Step S35). The control target value Akt for the black color is determined in this manner.

FIGS. 14A and 14B are drawings which show examples of look-up tables which are for calculating a control target value. This table is a table which is referred to when toner whose color is black and whose characteristics belong to "type 0" is to be used. This embodiment uses, for each one of two types of patch images, one for a high density and the other for a low density as described later, and for each toner color, eight types of tables which respectively correspond to eight types of toner characteristics, and these tables are stored in the ROM 106 of the engine controller 10. Shown in FIG. 14A is an example of a table which corresponds to a high-density patch image, while shown in FIG. 14B is an example of a table which corresponds to a low-density patch image.

When the toner character information acquired at the step S32 described above expresses the "type 0" for example, at the following step S33, the table shown in FIGS. 14A and 14B corresponding to the toner character information "0" is selected respectively out from the eight types of tables. The control target value Akt is then calculated based on thus acquired dot count value and developer roller rotating time. For example, for a high-density patch image, when the dot count value is 1500000 counts and the developer roller rotating time is 2000 sec, the value 0.984 which corresponds to the combination of these two is found to be the control target value Akt with reference to FIG. 14A. Further, when a user has set the image density one notch higher than a standard level, the value 0.989 which is obtained by adding 0.005 to this value is the control target value Akt. In a similar manner, it is possible to calculate a control target value for a low-density patch image.

The control target value Akt calculated in this fashion is stored in the RAM 107 of the engine controller 10. During later setting of each density control factor, it is ensured that an evaluation value calculated based on the amount of reflection light from a patch image matches with this control target value.

As described above, the control target value is calculated for the toner color through execution of the steps S31 through S35 described above. The process above is repeated for each toner color (Step S36), and control target values Ayt, Act and Amt and the control target value Akt on all toner colors are found. The subscripts y, c, m and k represent the respective toner colors, i.e., yellow, cyan, magenta and black, while the subscript t expresses that these values are control target values.

D. Setting of Developing Bias

In this image forming apparatus, the average developing bias Vavg fed to the developer roller 44 and an energy E per unit surface area of the exposure beam L which exposes the photosensitive member 2 (hereinafter referred to simply as "exposure energy") are variable, and with these values adjusted, an image density is controlled. The following describes an example that optimal values of these two are calculated while changing the average developing bias Vavg over six stages of V0 to V6 from the low level side and changing the exposure energy E over four stages of a level 0 to a level 3 from the low level side. The variable ranges and the number of stages in each variable range, however, may be changed appropriately in accordance with the specifications of the apparatus. In an apparatus wherein the variable range of the average developing bias Vavg described above is from (−110 V) to (−330 V), the lowest level V0 corresponds to (−110 V) with the smallest absolute voltage value and the highest level VS corresponds to (−330 V) with the largest absolute voltage value.

Figure 15:
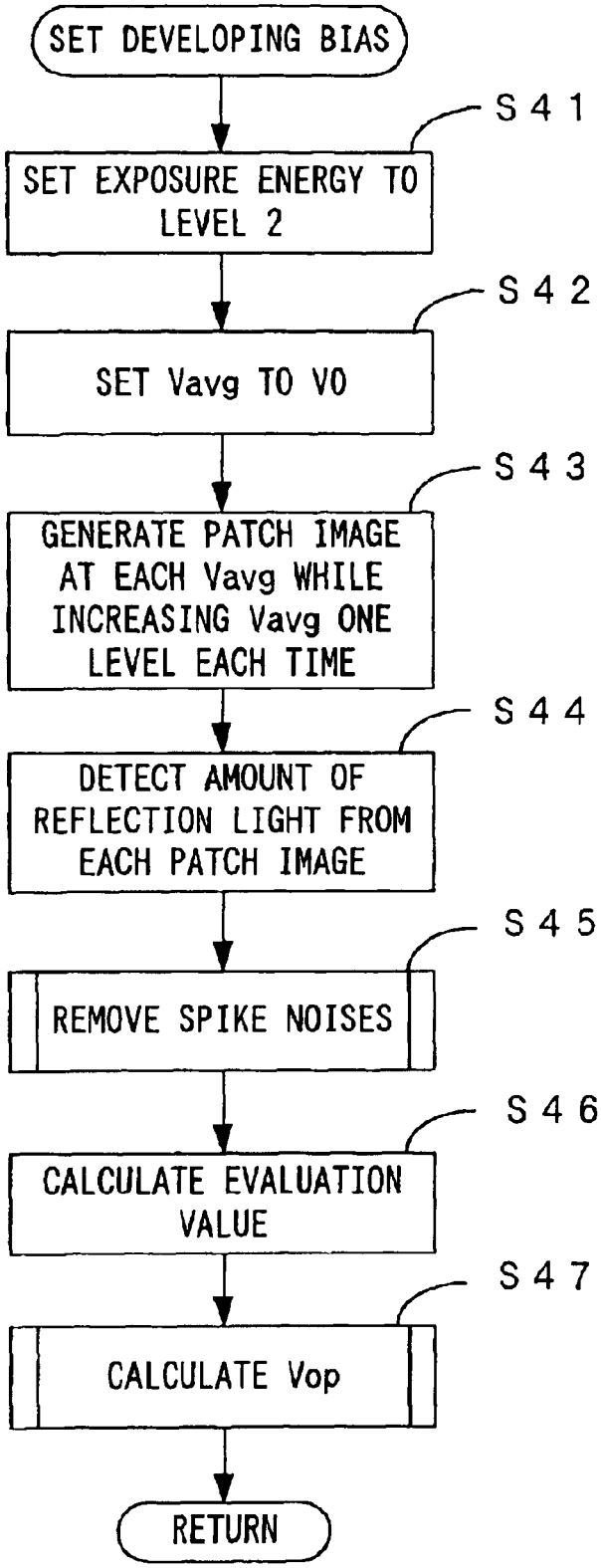
FIG. 15 is a flow chart which shows a developing bias setting process in the apparatus of FIG. 1.
Figure 16:
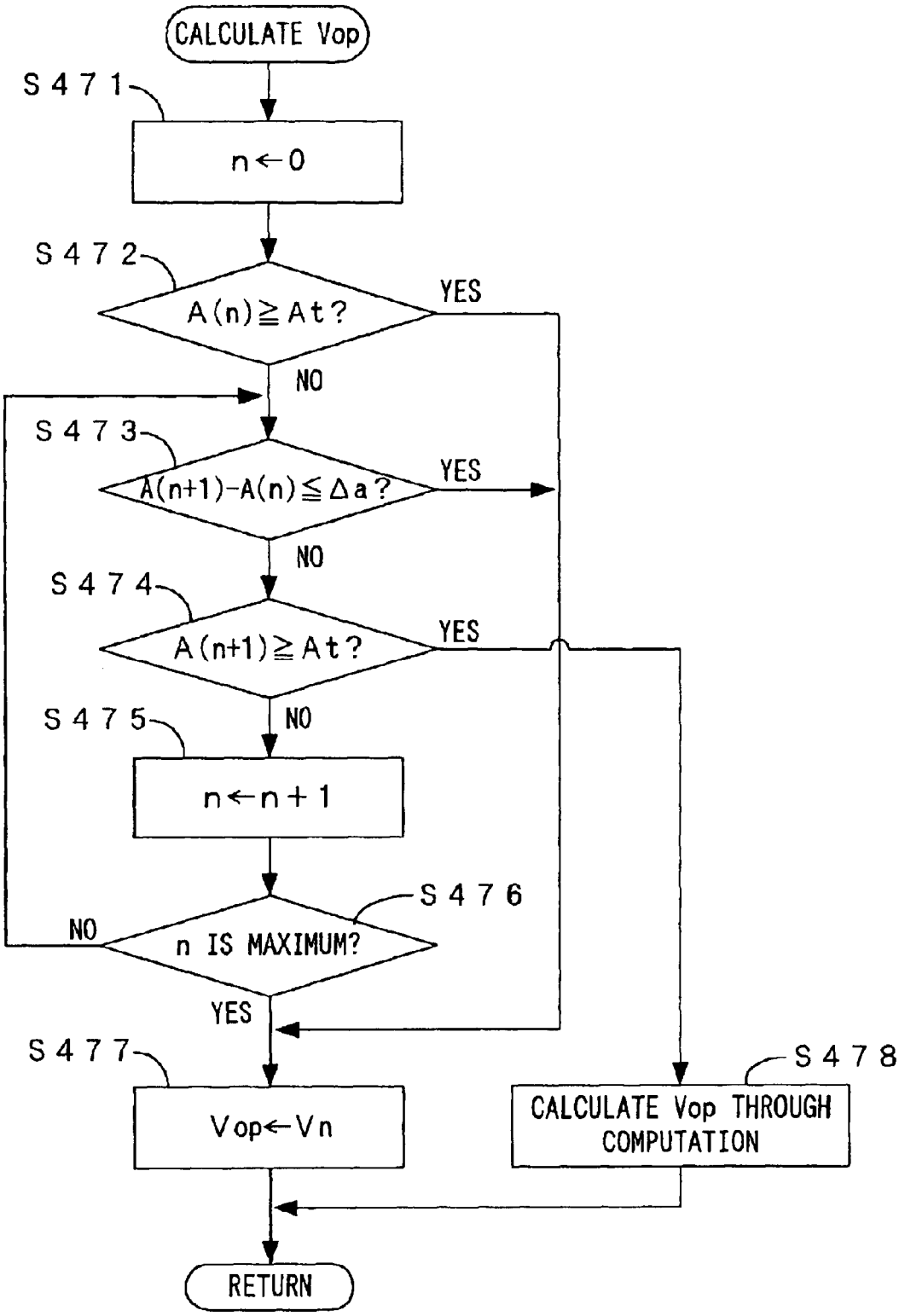
FIG. 16 is a flow chart which shows a process of calculating an optimal value of developing bias in the apparatus of FIG. 1.

FIG. 15 is a flow chart which shows a developing bias setting process in this embodiment, and FIG. 16 is a drawing which shows a high-density patch image. During this process, first, the exposure energy E is set to the level 2 (Step S41), and while increasing the average developing bias Vavg from the lowest level V0 by one level each time, a solid image which is to serve a high-density patch image is formed with each bias value (Step S42, Step S43).

In the event that there is no particular consideration given on shapes of patch images, positions at which the patch images are formed and the like, an influence of eccentricity, distortion and the like of the photosensitive member 2 and/or an influence of eccentricity, distortion and the like of the developer rollers 44 manifest themselves and change a detection value of a patch image density. In contrast, when shapes of patch images, positions at which the patch images are formed and the like are improved as in a preferred embodiment described later, it is possible to suppress an influence of a density change of a patch image and stably form a toner image which has an excellent image quality. This will be described in detail later.

As for the patch images Iv0 through Iv5 thus formed each with the average developing bias Vavg, the voltages Vp and Vs outputted from the density sensor 60 in accordance with the amounts of reflection light from the surfaces of the patch images are sampled (Step S44). In this embodiment, at 74 points (corresponding to the circumferential length L0 of the photosensitive member 2) as for the patch images Iv0 through Iv4 having the length L1 and at 21 points (corresponding to the circumferential length of the developer roller 44) as for the patch image Iv5 which has the length L3, sample data are obtained from the output voltages Vp and Vs from the density sensor 60 at sampling cycles of 8 msec. In a similar manner to that during derivation of the foundation profile (FIG. 7) described earlier, removal of spike noises from the sample data is executed(Step S45). And then, an "evaluation value" on each patch image is calculated (Step S46) from the resulting data after the removal of dark outputs of the sensor system, an influence of the foundation profile and the like.

As described earlier, the density sensor 60 of this apparatus exhibits a characteristic that an output level with no toner adhering to the intermediate transfer belt 71 is the largest but decreases as the amount of the toner increases. Further, an offset due to the dark outputs has been superimposed on the output. Therefore, the output voltage data from the sensor as they directly are hard to be handled as information which is for evaluating the amount of the adhering toner. Noting this, in this embodiment, thus obtained data are processed into such data which express the amount of the adhering toner, that is, converted into an evaluation value, so as to make it easy to execute the subsequent processing.

A method of calculating the evaluation value will now be more specifically described, in relation to an example of a patch image in the black color. Of six patch images developed with the black toner, an evaluation value Ak(n) for an n-th patch image Ivn (where n=0, 1, . . . , 5) is calculated from the formula below:

$$Ak(n)=1-\{Vpmeank(n)-Vpo\}/\{Vpmean_b-Vpo\}$$

The respective terms included in the formula mean the following.

First, the term Vpmeank(n) denotes a noise-removed average value of sample data outputted from the density sensor 60 as the output voltage Vp, which corresponds to the p-polarized light component of reflection light from the n-th patch image Ivn, and thereafter sampled. That is, a value Vpmeank(0) corresponding to the first patch image Iv0 for instance denotes an arithmetic average of 74 pieces of sample data which were detected as the output voltage Vp from the density sensor 60 over the length L0 of this patch image, subjected to spike noise removal and stored in the RAM 107. The subscript k appearing in each term of the formula above expresses that these values are on the black color.

Meanwhile, the term Vpo denotes a dark output voltage from the light receiver unit 670*p* acquired during the pre-operation 1 described earlier with the light emitter element 601 turned off. As the dark output voltage Vpo is subtracted from the sampled output voltage, it is possible to calculate a density of a toner image at a high accuracy while eliminating an influence of the dark output.

Further, the term Vpmean_b denotes an average value of sample data which were, of the foundation profile data stored in the RAM 107 obtained earlier, detected at the same positions as positions at which the 74 pieces of sample data used for the calculation of Vpmeank(n) were detected.

Hence, in a condition that no toner has adhered at all as a patch image to the intermediate transfer belt 71, Vpmeank (n)=Vpmean_b holds satisfied and the evaluation value Ak(n) accordingly becomes zero. On the other hand, in a condition that the surface of the intermediate transfer belt 71 is completely covered with the black toner and the reflectance is zero, Vpmeank(n)=Vpo holds satisfied and hence the evaluation value Ak(n)=1.

When the evaluation value Ak(n) is used instead of using the value of the sensor output voltage Vp as it directly is, it is possible to measure an image density of a patch image at a high accuracy while canceling an influence due to the condition of the surface of the intermediate transfer belt 71. In addition, because of correction in accordance with the shading of the patch image on the intermediate transfer belt 71, it is possible to further improve the accuracy of measuring the image density. In addition, this permits to normalize the density of the patch image Ivn using a value ranging from the minimum value 0, which expresses a state that no toner has adhered, to the maximum value 1, which expresses a state that the surface of the intermediate transfer belt 71 is covered with high-density toner, and accordingly express the density of the patch image Ivn, which is convenient to estimate a toner image density during the subsequent processing.

As for the other toner color than black, that is, the yellow color (Y), the cyan color (C) and the magenta color (M), since the reflectance is higher than on the black color and the amount of reflection light is not zero even when the surface of the intermediate transfer belt 71 is covered with toner, there may be a case that a density can not be accurately expressed using the evaluation value obtained in the manner above. In this embodiment therefore, used as sample data at the respective positions for calculation of evaluation values Ay(n), Ac(n) and Am(n) for these toner colors is not the output voltage Vp corresponding to the p-polarized light component but is a value PS which is obtained by dividing a value obtained by subtracting the dark output Vpo from the output voltage Vp by a value obtained by subtracting the dark output Vso from the output voltage Vs corresponding to the s-polarized light component, that is, PS=(Vp−Vpo)/(Vs−Vso), which makes it possible to accurately estimate image densities also in these toner colors. In addition, as in the case of the black color, a sensor output obtained at the surface of the intermediate transfer belt 71 prior to toner adhesion is considered, thereby canceling an influence exerted by the condition of the surface of the intermediate transfer belt 71. Further, owing to correction in accordance with the shading of a patch image on the intermediate transfer belt 71, it is possible to further improve the accuracy of measuring an image density.

For example, as for the cyan color (C), the evaluation value Ac(n) is calculated from:

$$Ac(n)=1-\{PSmeanc(n)-Pso\}/\{PSmean_b-Pso\}$$

The symbol PSmeanc(n) denotes an average value of noise-removed PS values calculated from the sensor outputs Vp and Vs at the respective positions of the n-th patch image Ivn in the cyan color. Meanwhile, the symbol Pso denotes a value PS which corresponds to the sensor outputs Vp and Vs as they are in a condition that the surface of the intermediate transfer belt 71 is completely covered with the color toner, and is the minimum possible value of PS. Further, the symbol PSmean_b denotes an average value of the values PS calculated from the sensor outputs Vp and Vs as they are sampled as a foundation profile at the respective positions on the intermediate transfer belt 71.

When the evaluation values for the color toner are defined as described above, as in the case of the black color described earlier, it is possible to normalize the density of the patch image Ivn using a value ranging from the minimum value 0, which expresses a state that no toner has adhered to the intermediate transfer belt 71 (and that PSmeanc(n)=PSmean_b is satisfied), to the maximum value 1, which expresses a state that the intermediate transfer belt 71 is covered completely with the toner (and that PSmeanc (n)=PSo is satisfied), and express the density of the patch image Ivn.

As the densities of the patch images (to be more specific, the evaluation values for the patch images) are thus calculated, an optimal value Vop of the average developing bias Vavg is calculated based on these values (Step S47). FIG. 16 is a flow chart which shows a process of calculating the optimal value of the developing bias in this embodiment. This process remain unchanged in terms of content among the toner colors, and therefore, the subscripts (y, c, m, k) expressing evaluation values and corresponding to the toner colors are omitted in FIG. 16. However, the evaluation values and target values for the evaluation values may of course be different value among the different toner colors.

First, a parameter n is set to 0 (Step S471), and an evaluation value A(n), namely A(0), is compared with a control target value At (Akt for the black color for instance) which was calculated earlier (Step S472). At this stage, the evaluation value A(0) being equal to or larger than the control target value At means that an image density over a target density has been obtained with the average developing bias Vavg set to the minimum value V0. Hence, there is no need to study a higher developing bias, and the process is ended acknowledging that the minimum developing bias V0 at this stage is the optimal value Vop (Step S477).

On the contrary, when the evaluation value A(0) is yet to reach the control target value At, an evaluation value A(1) for a patch image Iv1 formed with a developing bias V1 which is one level higher is read out, a difference from the evaluation value A(0) is calculated, and whether thus calculated difference is equal to or smaller than a predetermined value Δa is judged (Step S473). In the event that the difference between the two is equal to or smaller than the predetermined value Δa, in a similar fashion to the above, the average developing bias V0 is acknowledged as the optimal value Vop. The reason for this will be described in detail later.

On the other hand, when the difference between the two is larger than the predetermined value Δa, the process proceeds to a step S474 and the evaluation value A(1) is compared with the control target value At. At this stage, when the evaluation value A(1) is the same as or over the control target value At, since the control target value At is larger than the evaluation value A(0) but is equal to or smaller than the evaluation value A(1), that is since $A(0) < At \leqq A(1)$, the optimal value Vop of the developing bias for obtaining the target image density must be between the developing biases V0 and V1. In short, $V0 < Vop \leqq V1$.

In such a case, the process proceeds to a step S478 to calculate the optimal value Vop through computation. While various methods may be used as the calculation method, an example may be to approximate a change in evaluation value in accordance with the average developing bias Vavg as a proper function within a section from V0 to V1 and thereafter to use, as the optimal value Vop, such an average developing bias Vavg with which a value derived from the function is the control target value At. Of these various methods, while the simplest one is a method which requires to linearly approximate an evaluation value change, when the variable range of the average developing bias Vavg is properly selected, it is possible to calculate the optimal value Vop at a sufficient accuracy. Of course, although the optimal value Vop may be calculated by other method, e.g., using a more accurate approximate function, this is not always practical considering a detection error of the apparatus, a variation among apparatuses, etc.

On the other hand, in the event that the control target value At is larger than the evaluation value A(1) at the step S474, n is incremented by 1 (Step S475) and the optimal value Vop is calculated while repeating the steps S473 through S475 described above until n reaches the maximum value (Step S476). In the meantime, when calculation of the optimal value Vop has not succeeded, i.e., when any one of the evaluation values corresponding to the six patch images has not reached the target value, even after n has reached the maximum value (n=5) at the step S476, the developing bias V5 which makes the density largest is used as the optimal value Vop (Step S477).

As described above, in this embodiment, each one of the evaluation values A(0) through A(5) corresponding to the respective patch images Iv0 through Iv5 is compared with the control target value At and the optimal value Vop of the developing bias for achieving the target density is calculated based on which one of the two is larger than the other. But at the step S473, as described earlier, when a difference between the evaluation values A(n) and A(n+1) corresponding to continuous two patch images is equal to or smaller than the predetermined value Δa, the developing bias Vn is used as the optimal value Vop. The reason is as follows.

As shown in FIG. 17B, the apparatus exhibits a characteristic that while an image density OD on the sheet S increases as the average developing bias Vavg increases, the growth rate of the image density decreases in an area where the average developing bias Vavg is relative large, but gradually saturates. This is because as toner has adhered at a high density to a certain extent, an image density will not greatly increase even though the amount of the adhering toner increases further. To increase the average developing bias Vavg to further increase an image density in an area wherein the growth rate of the image density is small ends up in excessively increasing the toner consumption although a very large increase in density can not be expected, and as such, is not practical. On the contrary, in such an area, with the average developing bias Vavg set as low as possible just to an extent which tolerates a density change, it is possible to remarkably reduce the toner consumption while suppressing a drop in image density to minimum.

Noting this, in this embodiment, in a range where the growth rate of the image density in response to the average developing bias Vavg is smaller than a predetermined value, a value as low as possible is used as the optimal value Vop. To be more specific, when a difference between the evaluation values A(n) and A(n+1) respectively expressing the densities of the patch images Ivn and Iv(n+1) formed with the average developing bias Vavg set to the two types of biases Vn and Vn+1 respectively is equal to or smaller than the predetermined value Δa, the lower developing bias, namely, the value Vn is set as the optimal value Vop. As for the value Δa, it is desirable that when there are two images on which evaluation values are different by Δa from each other, the value Δa is selected such that the density difference between the two will not be easily recognized with eyes or will be tolerable in the apparatus.

This prevents the average developing bias Vavg from being set to an unnecessarily high value although there is almost no increase in image density, thereby trading the image density off with the toner consumption.

The optimal value Vop of the average developing bias Vavg with which a predetermined solid image density will be obtained is thus set to any value which is within the range from the minimum value V0 to the maximum value V5. For improvement in image quality, this image forming apparatus ensures that a potential difference is always constant (325 V for instance) between the average developing bias Vavg and a surface potential in "non-scanning portion", or a portion within an electrostatic latent image on the photosensitive member 2 to which toner will not adhere in accordance with an image signal. As the optimal value Vop of the average developing bias Vavg is determined in the manner above, the electrifying bias applied upon the charger unit 3 by the charging controller 103, too, is changed in accordance with the optimal value Vop, whereby the potential difference mentioned above is maintained constant.

E. Setting Exposure Energy

Figure 17:
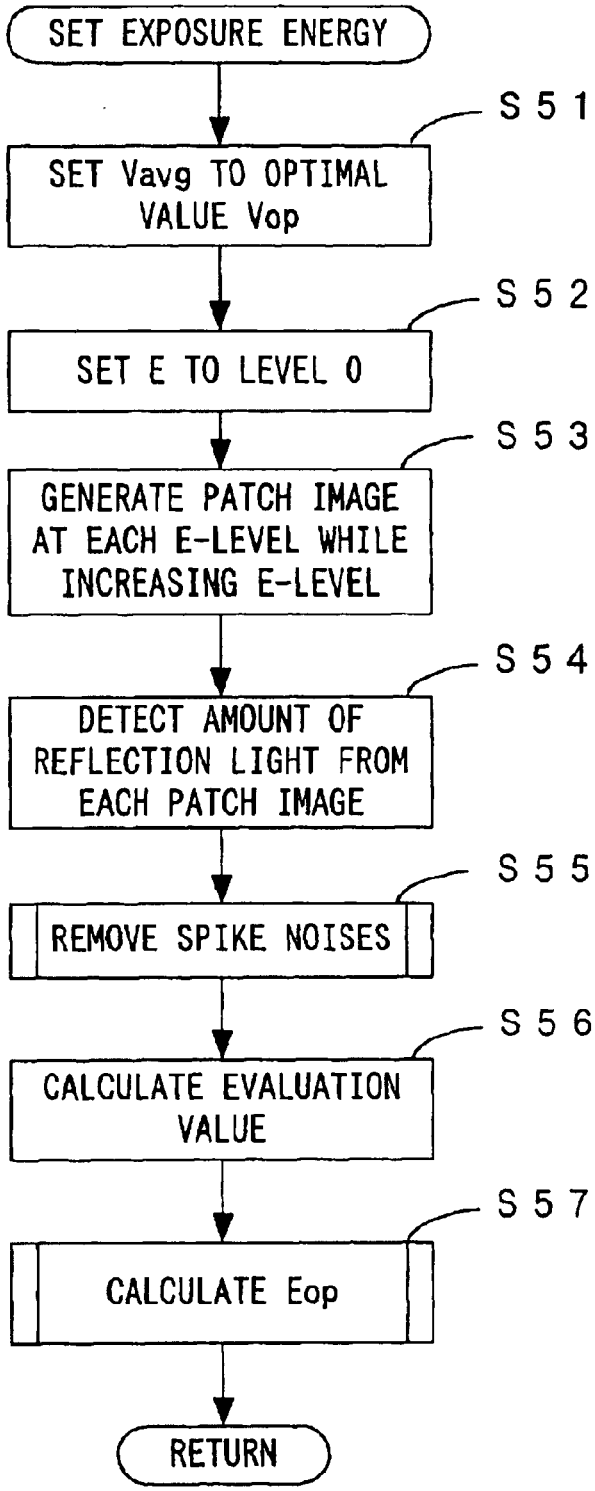
FIG. 17 is a flow chart which shows a process of setting an exposure energy in the apparatus of FIG. 1.

Following this, the exposure energy E is set to an optimal value. FIG. 17 is a flow chart which shows a process of setting the exposure energy in this embodiment. As shown in FIG. 17, the content of this process is basically the same as that of the developing bias setting process described earlier (FIG. 15). That is, first, the average developing bias Vavg is set to the optimal value Vop calculated earlier (Step S51), and while increasing the exposure energy E from the lowest level 0 by one level each time, a patch image is formed at each level (Step S52, Step S53). The sensor outputs Vp and Vs corresponding to the amount of reflection light from each patch image are sampled (Step S54), spike noises are removed from the sample data (Step S55), an evaluation value expressing a density of each patch image is calculated (Step S56), and the optimal value Eop of the exposure energy is calculated based on the result (Step S57).

During this process (FIG. 17), only differences from the developing bias setting process described earlier (FIG. 15) are patterns and the number of patch images to be formed and a calculation of the optimal value Eop of the exposure energy from evaluation values. The two processes are almost the same regarding the other aspects. These differences will now be described mainly.

In this image forming apparatus, while an electrostatic latent image corresponding to an image signal is formed as the surface of the photosensitive member 2 is exposed with the light beam L, in the case of a high-density image such as a solid image which has a relatively large area to be exposed, even when the exposure energy E is changed, a potential profile of the electrostatic latent image does not change very much. On the contrary, for instance, in a low-density image such as a line image and a halftone image in which areas to be exposed are scattered like spots on the surface of the photosensitive member 2, the potential profile of the image greatly changes depending on the exposure energy E. Such a change in potential profile leads to a change in density of a toner image. In other words, a change in exposure energy E does not affect a high-density image very much but largely affects a density of a low-density image.

Noting this, in this embodiment, first, a solid image is formed as a high-density patch image in which an image density is less influenced by the exposure energy E, and the optimal value of the average developing bias Vavg is calculated based on the density of the high-density patch image. Meanwhile, for calculation of the optimal value of the exposure energy E, a low-density patch image is formed. Hence, the exposure energy setting process uses a patch image having a different pattern from that of the patch image (FIG. 16) formed during the developing bias setting process.

While an influence of the exposure energy E over a high-density image is small, if a variable range of the exposure energy E is excessively wide, a density change of the high-density image increases. To prevent this, the variable range of the exposure energy E preferably ensures that a change in surface potential of an electrostatic latent image corresponding to a high-density image (which is a solid image for example) in response to a change in exposure energy from the minimum (level 0) to the maximum (level 3) is within 20 V, or more preferably, within 10 V.

Figure 18:
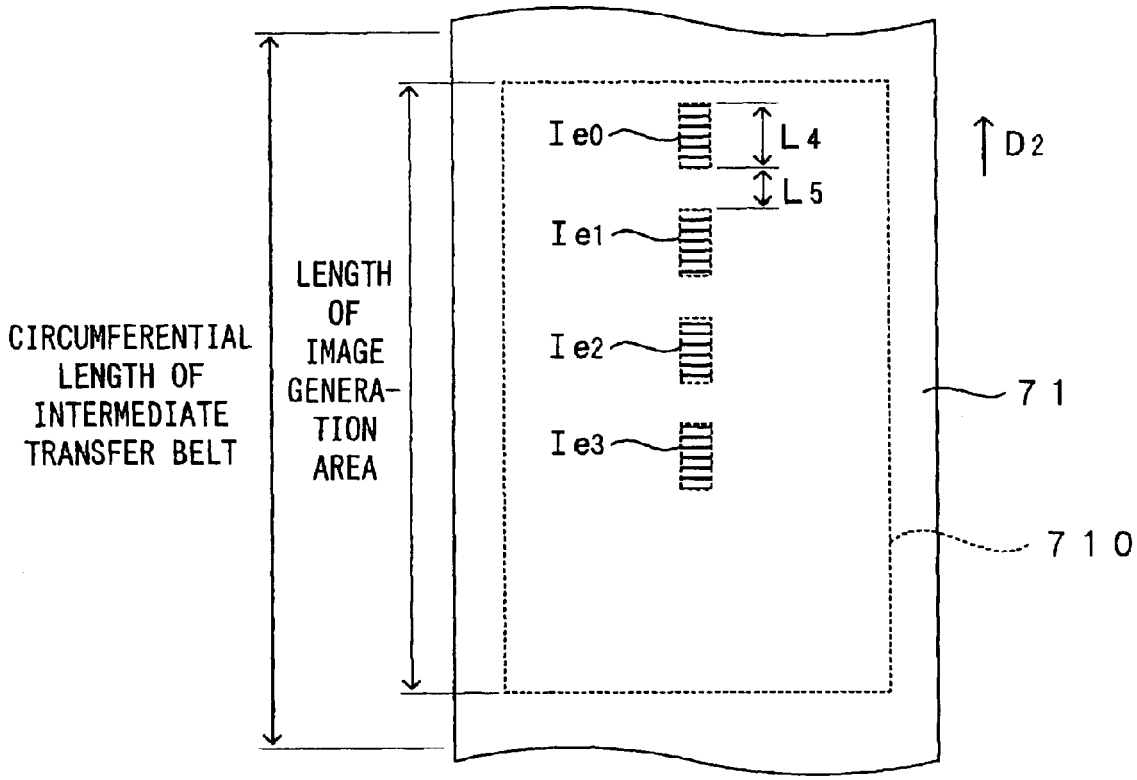
FIG. 18 is a drawing which shows a low-density patch image.
Figure 19:
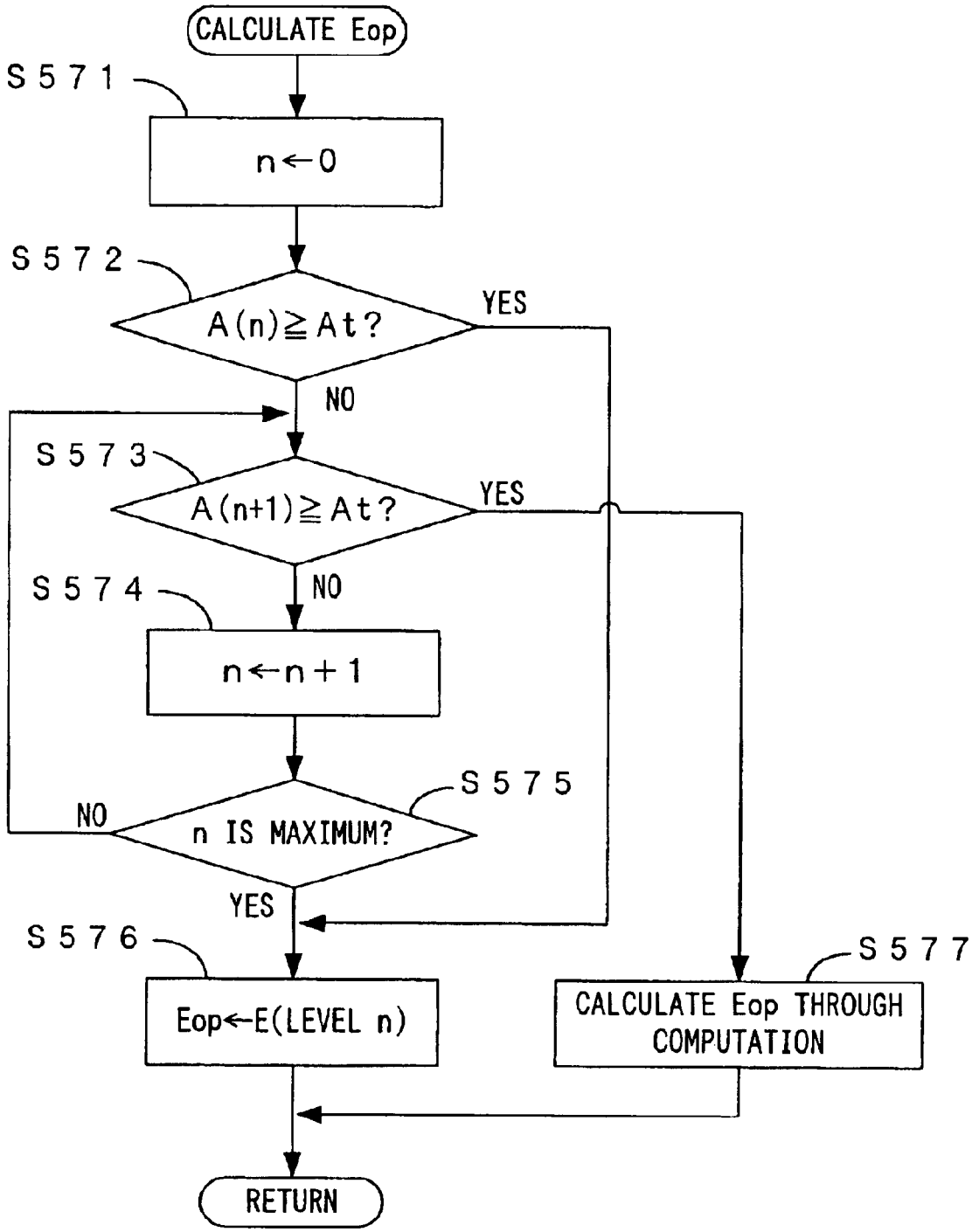
FIG. 19 is a flow chart which shows a process of calculating an optimal value of an exposure energy in the apparatus of FIG. 1.

FIG. 18 is a drawing which shows a low-density patch image. As described earlier, this embodiment requires to change the exposure energy E over four stages. In this example, one patch image at each level and four patch images Ie0 through Ie3 in total are formed. A pattern of the patch images used in this example is formed by a plurality of thin lines which are isolated from each other as shown in FIG. 18. To be more specific, the pattern is a 1-dot line pattern that one line is ON and ten lines are OFF. Although a pattern of a low-density patch image is not limited to this, use of a pattern that lines or dots are isolated from each other allows to express a change in exposure energy E as a change in image density and more accurately calculate the optimal value of the exposure energy E.

Further, a length L4 of each patch image is smaller than the length L1 of the high-density patch images (FIG. 16). This is because a density variation will not appear at the cycles of rotation of the photosensitive member 2 during the exposure energy setting process since the average developing bias Vavg has already been set to the optimal value Vop. In other words, present Vop is not the optimal value of the average developing bias Vavg if such a density variation appears even in this condition. However, considering a possibility that there may be density variations associated with deformation of the developer roller 44, it is preferable an average value covering a length which corresponds to the circumferential length of the developer roller 44 is used as the density of the patch image. A circumferential length of the patch image is therefore set to be longer than the circumferential length of the developer roller 44. When moving velocities (circumferential speeds) of the surfaces of the photosensitive member 2 and the developer roller 44 are not the same in an apparatus of the non-contact developing type, considering the circumferential speeds, a patch image whose length corresponds to one round of the developer roller 44 may be formed on the photosensitive member 2.

Gaps U between the respective patch images may be narrower than the gaps L2 shown in FIG. 16. This is because it is possible to change an energy density of the light beam L from the exposure unit 6 in a relatively short period of time, and particularly when a light source of the light beam is formed by a semiconductor laser, it is possible to change the energy density of the light beam in an extremely period of time. Such a shape and arrangement of the respective patch images, as shown in FIG. 18, permits to form all of patch images Ie0 through Ie3 over one round of the intermediate transfer belt 71, and hence, to shorten a processing time.

As for thus formed low-density patch images Ie0 through Ie3, evaluation values expressing the densities of these images are calculated in a similar manner to that described earlier for the high-density patch images. Based on the evaluation values and control target values derived from the look-up table (FIG. 14B) for low-density patch images separately prepared from the look-up table for high-density patch images, the optimal value Eop of the exposure energy is calculated. FIG. 21 is a flow chart which shows a process of calculating the optimal value of the exposure energy in this embodiment. During this process as well, as in the process of calculating the optimal value of the direct current developing bias shown in FIG. 16, the evaluation value is compared with a target value At on the patch images starting from the one formed at a low energy level, and a value of the exposure energy E which makes the evaluation value match with the target value is then calculated, thereby determining the optimal value Eop (Step S571 through Step S577).

However, since within a range of the exposure energy E which is usually used, a saturation characteristic (FIG. 17B) found on the relationship between the solid image densities and the direct current developing bias will not be found on a relationship between the line image densities and the exposure energy E, a process corresponding to the step S473 shown in FIG. 16 is omitted. In this manner, the optimal value Eop of the exposure energy E with which a desired image density will be obtained is calculated.

F. Post-process

As the optimal values of the average developing bias Vavg and the exposure energy E are calculated in the manner above, it is now possible to form an image to have a desired image quality. Hence, the optimization of the density control factors may be terminated at this stage, or the apparatus may be made remain on standby after stopping the rotations of the intermediate transfer belt 71 and the like, or further alternatively, some adjustment may be implemented to control still other density control factors. The post-process may be any desired process, and therefore, will not be described here.

(III) First Embodiment (Cancellation of Influence Exerted by Photosensitive Member 2)

In the image forming apparatus shown in FIG. 1, a density of a patch image cyclically changes in accordance with the rotating cycles of the photosensitive member 2. And therefore, not only a density changes caused by a change in image forming condition (developing bias) but also a density change due to such a cyclic change are superimposed over a toner density of the patch image calculated from a result of detection executed on a local section of the rotating cycles. Hence, in some cases, a toner density calculated in this manner fails to correctly represent the density of the patch image under this image forming condition. Noting this, the first embodiment requires to calculate a toner density of a patch image under this image forming condition based on a result of detection executed on a length of the patch image which corresponds to the circumferential length of the photosensitive member 2. Hence, it is possible to calculate a toner density of a patch image under this image forming condition without influenced of a cyclic density variation associated with rotations of the photosensitive member 2. This will now be described with reference to FIGS. 20 through 22.

Figure 20:
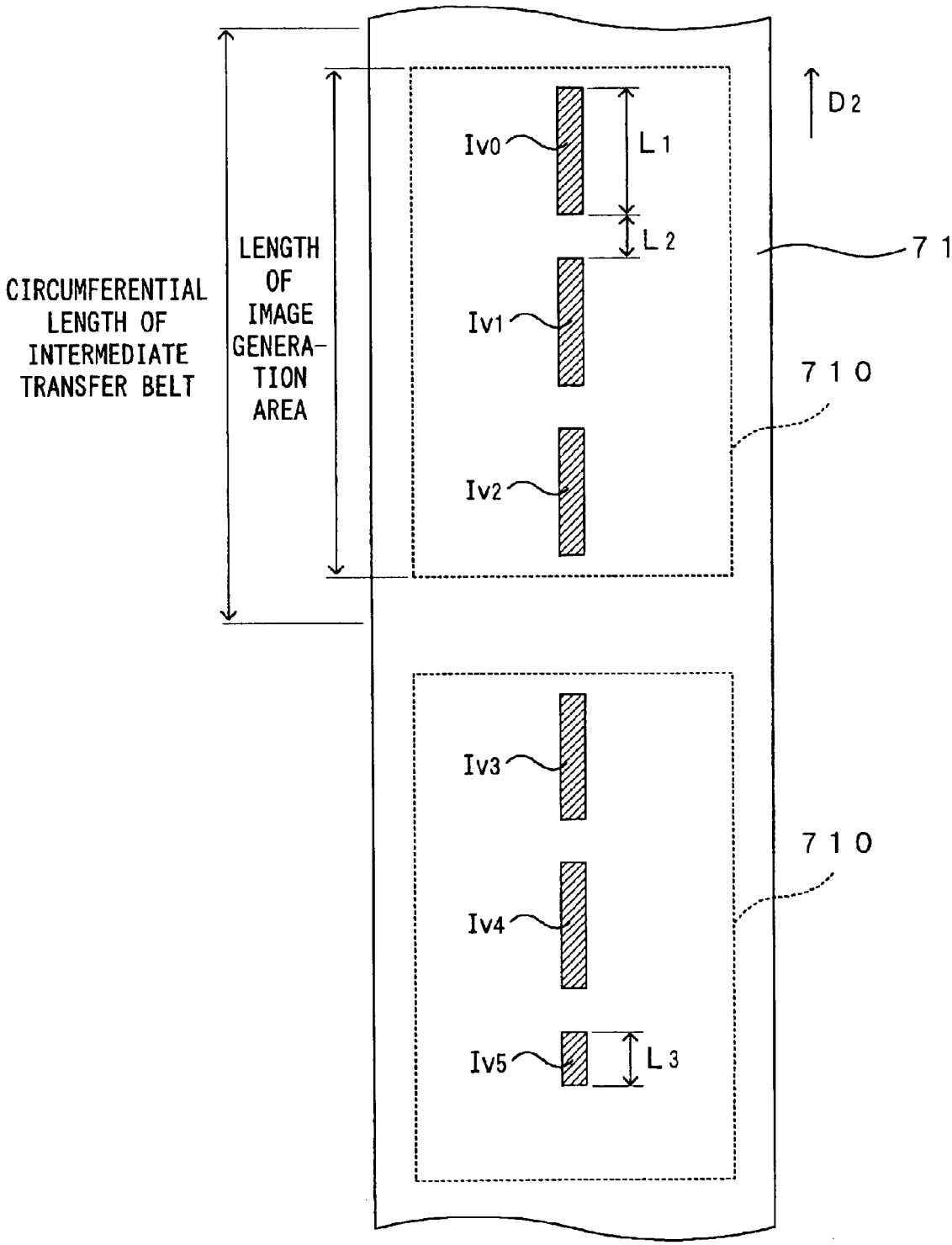
FIG. 20 is a drawing of a high-density patch image which is formed using the first embodiment of the image forming apparatus according to the present invention.

FIG. 20 is a drawing of a high-density patch image formed with the first embodiment of the image forming apparatus of the present invention. In the first preferred, as shown in FIG. 20, six patch images Iv0 through Iv5 are sequentially formed on the surface of the intermediate transfer belt 71 in accordance with the direct current developing bias Vavg which is changed over six levels. Of these, the first five patch images Iv0 through Iv4 have a length L1 in a patch length direction D2 which corresponds to a rotation direction in which the photosensitive member 2 rotates. The length L1 is set to be longer than the circumferential length of the photosensitive member 2 which has a cylinder-like shape. On the other hand, the last patch image Iv5 is formed to have a shorter length L3 than the circumferential length of the photosensitive member 2. The reason will be described later. Further, when the direct current developing bias Vavg is changed, there arises a slight delay until the potential of the developer roller 44 becomes uniform, and therefore, the patch images are formed at intervals L2 considering the delay. While an area within the surface of the intermediate transfer belt 71 which can carry a toner image is an image formation area 710 in reality which is shown in FIG. 20, since the patch images have such shapes and arrangement as described above, about three patch images can be formed in the image formation area 710. The six patch images are thus distributed over two rounds of the intermediate transfer belt 71 as shown in FIG. 20.

Figure 21A:
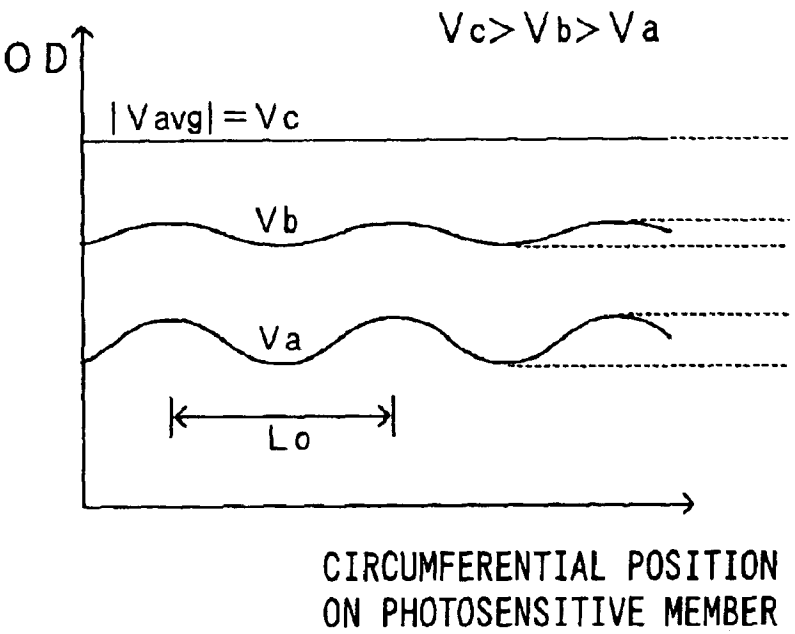
FIGS. 21A and 21B are drawings which show a variation in image density which appears at the cycles of the photosensitive member.
Figure 21B:
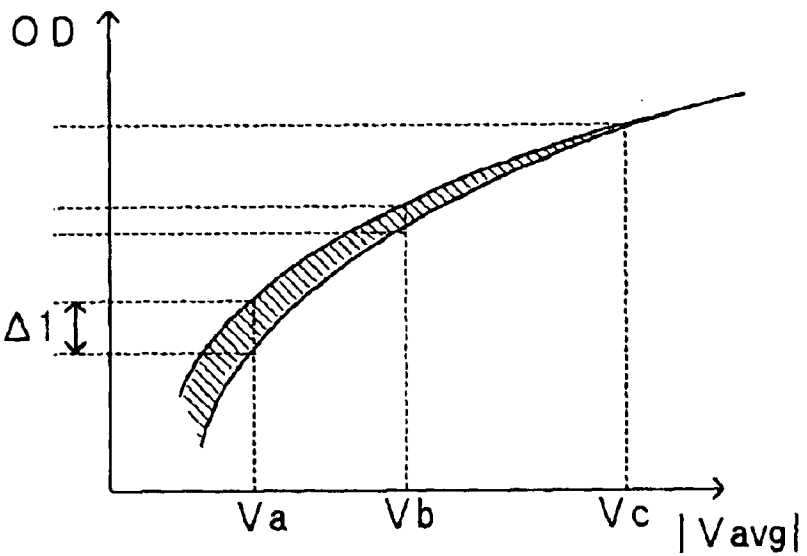

The reason that the lengths of the patch images are set as above will now be described with reference to FIGS. 1, 21A and 21B. FIGS. 21A and 21B are drawings which show a variation in image density which appears at the cycles of the photosensitive member. As shown in FIG. 1, while the photosensitive member 2 is formed in a cylindrical shape (with a circumferential length of L0), the shape may not sometimes be completely cylindrical or may sometimes have eccentricity due to a production-induced variation, thermal deformation, etc. In such a case, an image density of a toner image may include cyclic variations which correspond to the circumferential length L0 of the photosensitive member 2. This is because: in an apparatus of the contact developing type in which development with toner is achieved with the photosensitive member 2 and the developer roller 44 abutting on each other, the abutting pressure between the two changes; and in an apparatus of the non-contact developing type in which development using toner is achieved with the two located away from each other, the strength of an electric field which causes transfer of the toner between the two changes. A probability of a toner movement from the developer roller 44 to the photosensitive member 2 changes cyclically at the rotating cycles of the photosensitive member 2 in any apparatus. In addition, although it is desirable that the optical characteristics of the photosensitive member 2 are uniform within the surface of the photosensitive member 2 and remain stable independently of an environment such as an ambient temperature, there are local variation in characteristics in reality. Further, the characteristics change depending on a temperature. Such variations in optical characteristics of the photosensitive member 2 are also one cause of cyclic density variations.

The widths of the density variations are large particularly when the absolute value |Vavg| of the direct current developing bias Vavg is relatively small. The widths also decrease as the value |Vavg| increases as shown in FIG. 21A. For instance, when a patch image is formed with the absolute value |Vavg| of the direct current developing bias set to a relatively small value Va, as shown in FIG. 21B, the corresponding image density OD changes within the range of a width Δ1 depending on the location on the photosensitive member 2. In a similar manner, even when a patch image is formed with other direct current developing bias, an image density of the patch image changes within a certain range as denoted at the shadowed section in FIG. 21B. In this fashion, the density OD of the patch image varies depending on not only the direct current developing bias Vavg but also the position on the photosensitive member 2 at which the patch image is formed. Hence, to calculate an optimal value of the direct current developing bias Vavg from the image density of the patch image, it is necessary to eliminate an influence of density variations which correspond to the rotating cycles of the photosensitive member 2 exerted over the patch image.

Noting this, in this embodiment, a patch image whose length L1 exceeds the circumferential length L0 of the photosensitive member 2 is formed, and as described later, an average value of densities calculated over the length L0 is used as a density of the patch image. This allows to effectively suppress an influence of density variations which correspond to the rotating cycles of the photosensitive member 2 exerted over a density of each patch image, and hence, to properly calculate an optimal value of the direct current developing bias Vavg based on the density of each patch image. The reason will now be described in more detail with reference to FIG. 22.

Figure 22:
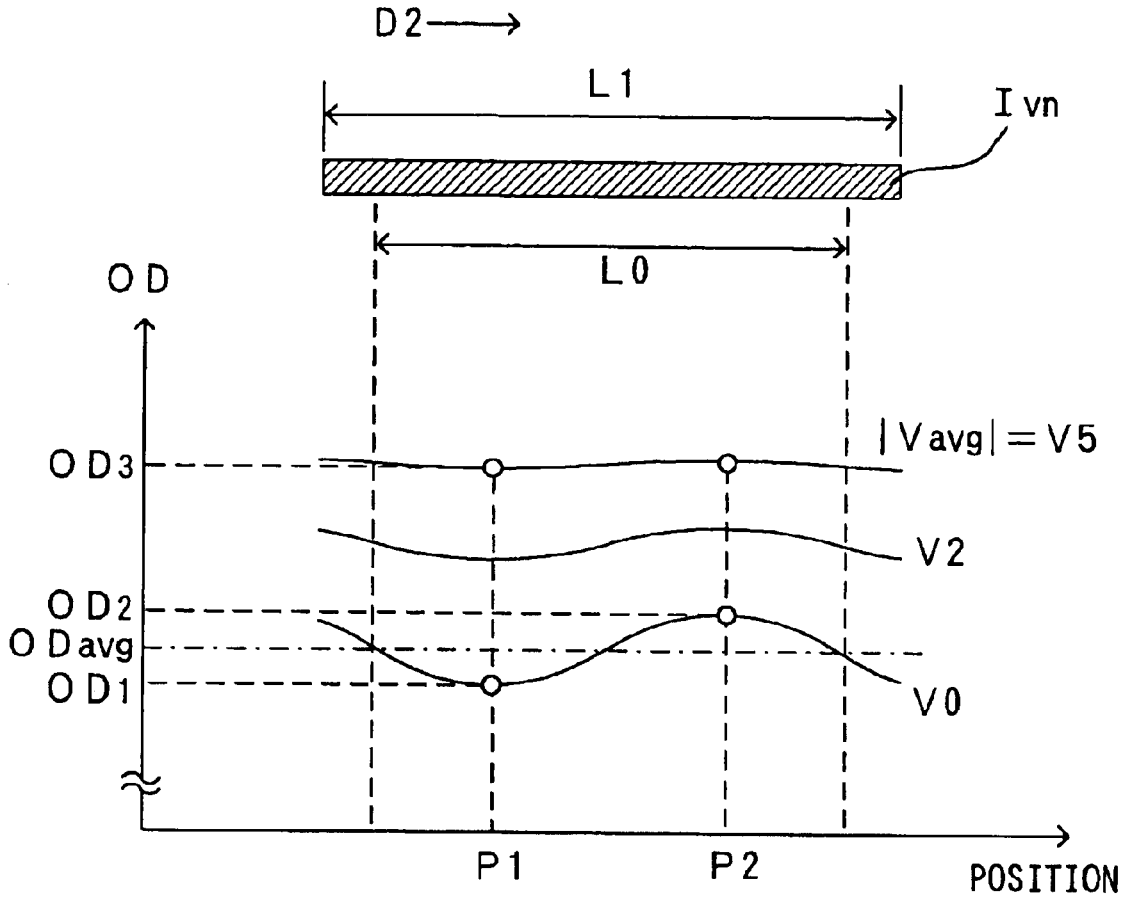
FIG. 22 is a drawing which shows an example of a density variation of a patch image.

FIG. 22 is a drawing which shows an example of a density variation of a patch image. As described above, an optical density OD of a patch image cyclically varies in accordance with the circumferential length L0 of the photosensitive member 2. The size of the variations becomes larger as the absolute value |Vavg| of the direct current developing bias becomes smaller. In short, as shown in FIG. 22, while the optical density OD greatly changes in a patch image which is formed at a direct current developing bias V0 whose absolute value is the smallest, the size of the variations shrinks at a larger direct current developing bias V2 than this. At a direct current developing bias V5 whose absolute value is the largest, the optical density OD rarely varies.

An example will now be considered that a density of a patch image which varies in such a manner is detected in a shorter section than the circumferential length L0 of the photosensitive member 2. For example, in a patch image Iv0 formed at the direct current developing bias V0, the optical density OD is a value OD1 at a position P1 which is shown in FIG. 22 but is a value OD2 at a position P2 which is shown in FIG. 22. Hence, a toner density detected by the density sensor 60 in the vicinity of the position P1 has a value which corresponds to the optical density OD1, but the toner density detected in the vicinity of the position P2 has a value which corresponds to the optical density OD2. Thus, the value becomes largely different depending on the position of detection.

In this manner, when a toner density detected only over a local section of the circumferential length L0 of the photosensitive member 2 is used as a toner density of a patch image Iv0, a toner density becomes largely different depending on a position at which the toner density is detected. This prevents to correctly calculate a correlation between the direct current developing bias Vavg, which serves as a density control factor, and a patch image density. As a result, it becomes impossible to properly calculate an optimal value of the direct current developing bias Vavg, which deteriorates an image quality.

In contrast, the apparatus of this embodiment executes the following steps. In the apparatus, the patch image Iv0, whose length L1 exceeds the circumferential length L0 of the photosensitive member 2 in the patch length direction D2, is formed. And thereafter, outputs from the density sensor 60 sampled at a plurality of points within the length L0 are averaged out and this average value is identified as a density of the patch image Iv0. Hence, the toner density of the patch image Iv0 thus calculated is a value which corresponds to an optical density ODavg which is shown in FIG. 22, which allows to uniquely identify a correlation between the direct current developing bias Vavg and a patch image density while eliminating an influence of a density variation. As a value of the direct current developing bias Vavg corresponding a desired image density is obtained based on the correlation, it is possible to set the direct current developing bias Vavg to an optimal value and form a toner image which has an excellent image quality.

As shown in FIG. 22, in the patch image Iv5 formed at the direct current developing bias V5 which is the maximum in the variable range of the direct current developing bias, density variations are small and the optical density OD of the patch image Iv5 has a value OD3 which is approximately constant regardless of positions. Hence, it is not necessary average out densities over the length L0 in the case of the patch image Iv5. Rather, a toner density of the patch image Iv5 may be calculated from detection results obtained on a shorter section. Noting this, in this embodiment, as shown in FIG. 20, the length 13 of the last patch image Iv5 is set to be shorter than the circumferential length L0 of the photosensitive member 2. In this manner, a period of time needed to form and process a patch image is shortened, and the amount of toner used for formation of the patch image is reduced.

While it is desirable to form a patch image having the same length as or a longer length than the circumferential length L0 of the photosensitive member 2 for the purpose of eliminating an influence of density variations which correspond to the rotating cycles of the photosensitive member exerted over optimization of density control factors, it is not always necessary that all patch images have such lengths. Instead, how many patch images should have such lengths is appropriately determined in accordance with the extent of density variations inherent in each apparatus, a demanded level of image quality, etc. For instance, in the event that an influence of density variations associated with the rotating cycles of the photosensitive member are relatively small, at least only one patch image, e.g., the patch image Iv0 formed under the condition that the direct current developing bias Vavg is the smallest, may have the length L1 and the other patch images Iv1 through Iv5 may be formed so as to have the shorter length L3 than this or other length.

Although all patch images may have the length L1, this leads to a problem that the processing time and the toner consumption increase. Even when the direct current developing bias Vavg is the maximum, to let density variations corresponding to the rotating cycles of the photosensitive member appear is not desirable in terms of image quality. In a condition that the direct current developing bias Vavg is set at least to the maximum value, the variable range of the direct current developing bias Vavg is supposed to be determined in such a manner that these density variations will not appear. When the variable range of the direct current developing bias Vavg is defined as such, density variations as those mentioned above will not appear at least at the maximum value of the direct current developing bias Vavg. Hence, it is not necessary that a patch image has the length L1.

Figure 23:
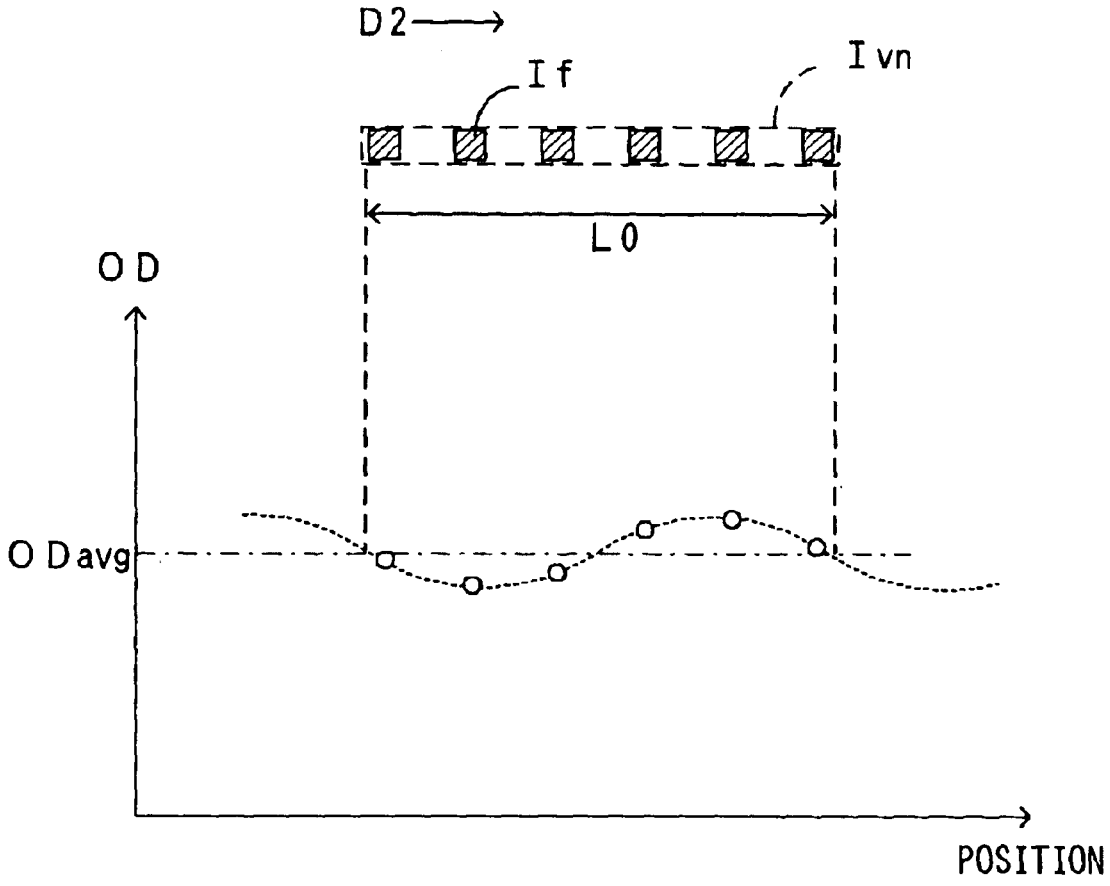
FIG. 23 is a drawing which shows other embodiment of a high-density patch image.

Further, each patch image Ivn does not have to be a strap-shaped image of a continuous pattern as those shown in FIG. 20. For example, as shown in FIG. 23, each patch image Ivn may be formed by a plurality of patch fragments If which are scattered within the range of the length L0 in the patch length direction D2. FIG. 23 is a drawing which shows other embodiment of a high-density patch image. Outputs from the density sensor 60 on each patch fragment If are sampled, and a toner density of the patch image Ivn is calculated from an average of the outputs. This simplifies the processing using less data and reduces the toner consumption as compared with where a patch image of a continuous pattern shown in FIG. 20 is formed. When density variations appear at shorter pitches, however, the accuracy slightly deteriorates. For this reason, which pattern a patch image Ivn should have must be appropriately determined in accordance with the specifications, a characteristic and the like of the apparatus.

As described above, the modified embodiment of the image forming apparatus executes the following steps to optimize the direct current developing bias Vavg. In the apparatus, patch images Ivn (where n=0, 1, . . . , 5) whose length L1 exceeds the circumferential length L0 of the photosensitive member 2 are formed. And thereafter, densities within the length L0 are averaged and a toner density of each patch image Ivn is calculated. Hence, it is possible to accurately calculate an optimal value of the direct current developing bias Vavg while canceling an influence of density variations which are created due to a variation in shape, characteristic and the like of the photosensitive member 2. In this embodiment, the direct current developing bias corresponds to a "density control factor" of the present invention, and then image forming condition including the direct current developing bias V0 (and further, an exposure energy, a charging bias and the like) corresponds to a "low-density side image forming condition" of the present invention.

In addition, the patch image Iv5 formed at the maximum value V5 of the direct current developing bias has the length L3 which is shorter than the circumferential length L0 of the photosensitive member 2, thereby shortening the processing time and reducing the toner consumption. In the embodiment, the image forming condition including the direct current developing bias V5 (and further, an exposure energy, a charging bias and the like) corresponds to a "high-density side image forming condition" of the present invention.

An optimal value Vop of the direct current developing bias is calculated based on the toner densities of the patch images thus calculated. The exposure energy E is optimized and an image is formed under the optimal direct current developing bias Vop. Hence, the image forming apparatus can form a toner image having an excellent image quality.

Although the embodiment above requires to dispose the density sensor 60 to face the surface of the intermediate transfer belt 71 and detect a density of a toner image primarily transferred as a patch image onto the intermediate transfer belt 71, this is not limiting. For instance, a density sensor may be disposed facing toward the surface of the photosensitive member 2 and detect a density of a toner image which has been developed on the photosensitive member 2.

Further, the embodiment above requires to form a patch image Ivn which is longer than the circumferential length L0 of the photosensitive member 2 during optimization of the direct current developing bias Vavg, sample outputs from the density sensor 60 over the length L0, and calculate a toner density of the patch image Ivn from a resulting average value. In short, how a density varies within a patch image is not taken into consideration. This is because it is possible to calculate an optimal value Vop of the direct current developing bias Vavg at a sufficient accuracy by calculating an average toner density of a patch image and eliminating an influence of cyclic density variations. However, a method of processing sampled data is not limited to such calculation of an average value. Depending on a situation, e.g., when it is necessary to identify a position at which an image density becomes the highest, how a density of a patch image varies in relation to the rotating cycles of the photosensitive member 2 must be identified. In such a case, it is possible to obtain desired information by other appropriate processing method of processing sampled data.

In addition, for example, a patch image whose length L4 is shorter than the circumferential length L0 of the photosensitive member 2 is formed for the purpose of optimization of the exposure energy E in the embodiment above. This is because at the time of optimization of the exposure energy E, density variations corresponding to the circumferential length L0 of the photosensitive member 2 rarely appear due to preceding optimization of the direct current developing bias Vavg. In other cases though, it is desirable to form a patch image which has a length equal to or longer than the circumferential length L0 of the photosensitive member 2 concurrently with optimization of the direct current developing bias, and to calculate a toner density based on the length L0 out of the length of the patch image.

Further, for example, although the direct current developing bias and the exposure energy which serve as density control factors are variable in the embodiment above, only one of these two may be changed for control of an image density, or other density control factor may be used. Further, although the electrifying bias changes in accordance with the direct current developing bias in the respective embodiments described above, this is not limiting. Instead, the electrifying bias may be fixed or changed independently of the direct current developing bias. With the length of a patch image set to be equal to or longer than the circumferential length of the photosensitive member when needed, it is possible to eliminate an influence of density variations attributed to the photosensitive member and accurately optimize a density control factor.

(IV) Second and Third Embodiments (Cancellation of Influence Exerted by Developer Roller 44)

Figure 24:
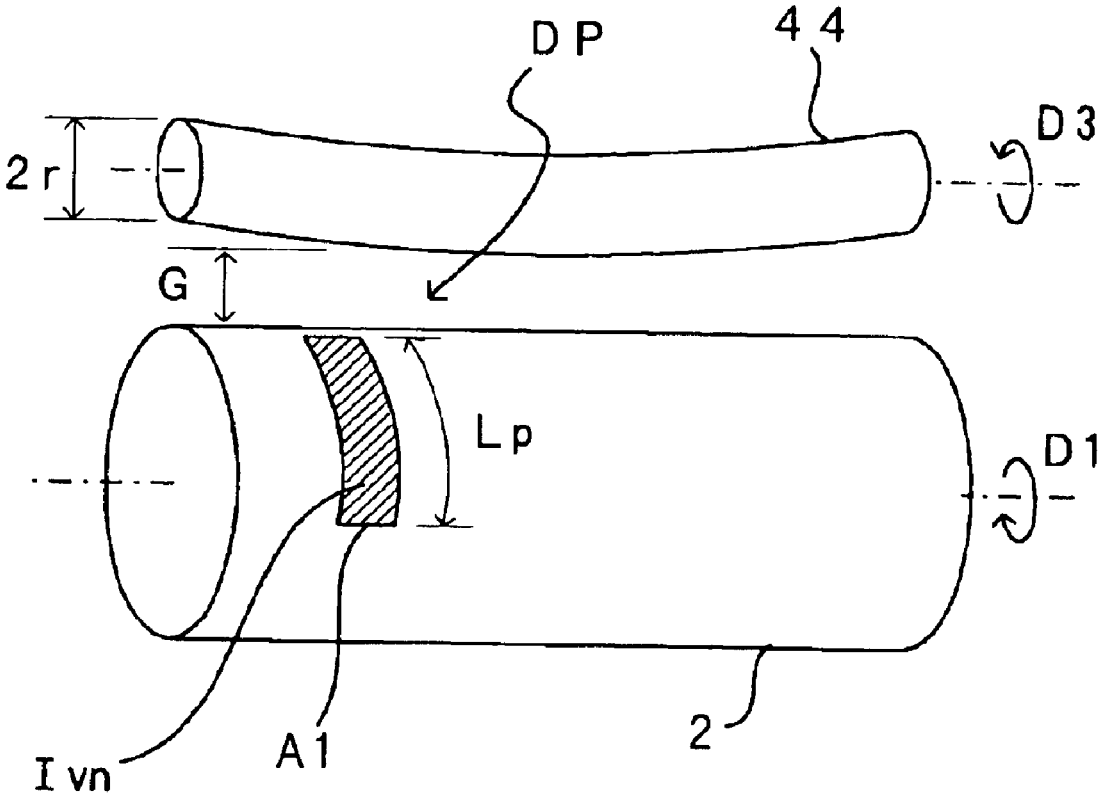
FIG. 24 is a drawing of a high-density patch image which is formed using a second embodiment of the image forming apparatus according to the present invention.

FIG. 24 is a drawing of a high-density patch image which is formed using a second embodiment of the image forming apparatus according to the present invention. In this embodiment, based on a patch image signal having a predetermined pattern, as shown in FIG. 24, a patch image Ivn (n=0 through 4) is formed in a surface area Al in the vicinity of an end of the cylindrical photosensitive member 2 in the longitudinal direction of the photosensitive member 2. The area Al corresponds to a "patch image area" of the present invention. A length Lp of the area A1 in the circumferential direction is determined in such a manner the developer roller 44 rotates beyond one round while the patch image area A1 moves passed a developing position DP in accordance with rotations of the photosensitive member 2 in the arrow direction D1. In short, since the developer roller 44 rotates at a circumferential speed which is 1.6 times as fast as that of the photosensitive member 2, the length Lp is defined as:

$$Lp>2\pi r/1.6=1.25\pi r$$

where the symbol r denotes the radius of the developer roller 44.

Figure 25A:
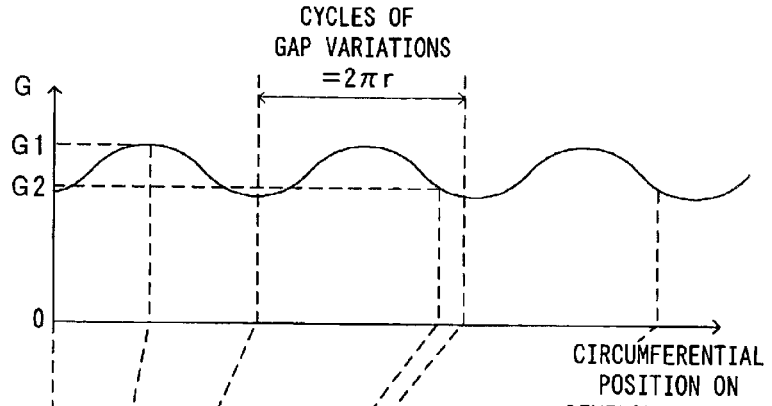
FIGS. 25A through 25C are graphs which show variations in gap and image density associated with rotations of a developer roller in the second embodiment.
Figure 25B:
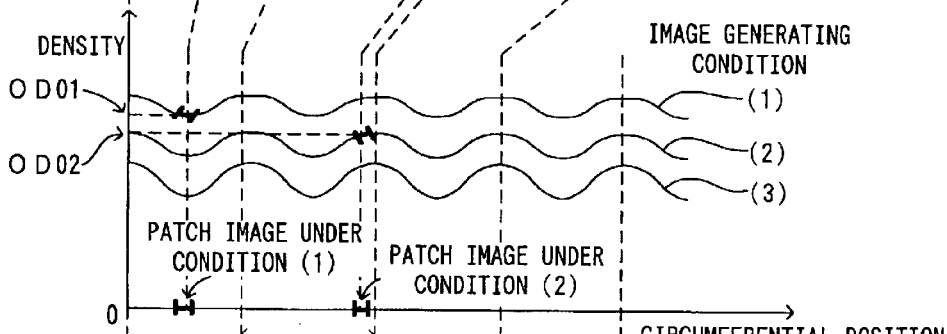
Figure 25C:
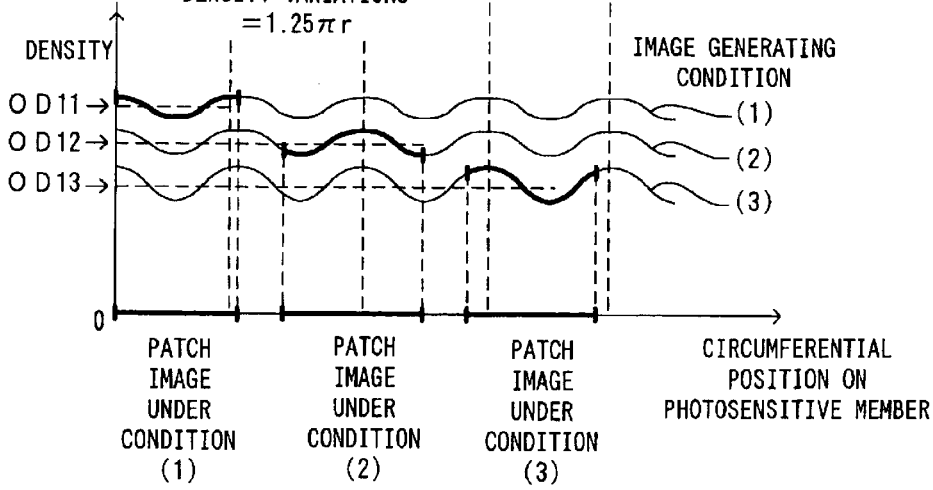
Figure 26A:
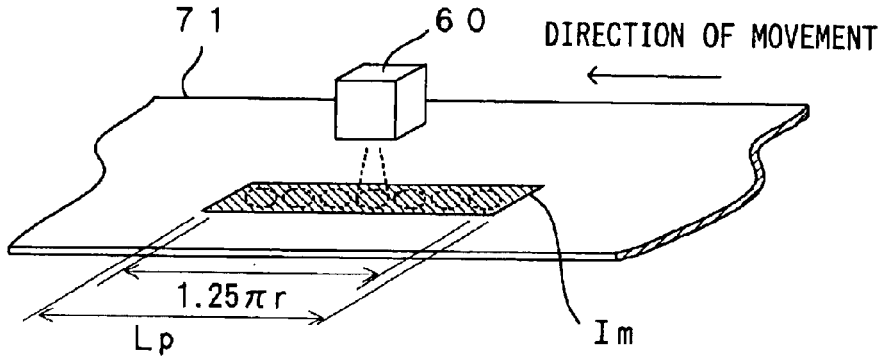
FIGS. 26A and 26B are drawings for describing a method of calculating an average value of patch image densities in the second embodiment.
Figure 26B:
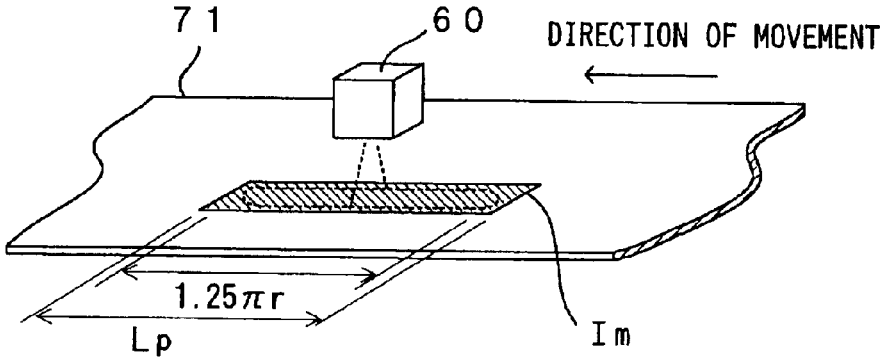

The reason of defining as such will now be described with reference to FIGS. 25A through 25C, 26A and 26B. FIGS. 25A through 25C are graphs which show variations in gap and image density associated with rotations of the developer roller. FIGS. 26A and 26B are drawings for describing a method of calculating an average value of patch image densities in the second embodiment.

The developer roller 44 is not always completely cylindrical, but instead often is deformed due to an irregular surface, bending, eccentricity, etc. While the following is related to an example that the developer roller 44 is bent as shown in FIG. 24 while processed, the description below similarly applies to other deformation. A gap G between the developer roller 44 and the photosensitive member 2 in the vicinity of the patch image area A1 cyclically changes in accordance with a circumferential length 2πr of the developer roller 44 as shown in FIG. 25A, due to such deformation. As the gap G varies in this manner, the intensity of an alternating field, which is developed at the developing position DP by the developing bias, varies. Hence the amount of toner transfer change. In consequence, even when images having the same pattern are formed under the respective image forming conditions, as shown in FIG. 25B, densities of the images become low as the gap G increases but become high as the gap G decreases, thus cyclically changing in accordance with variations of the gap G FIG. 25B shows image density variations in a situation that images having the same pattern are formed with the direct current developing biases V0 through V2 which are three types of image forming conditions (1) through (3) which are different from each other. The cyclic variations in the circumferential direction on the photosensitive member 2 are clearly 1.25πr, from a circumferential speed ratio of the circumferential speed of the photosensitive member 2 to the radius r of the developer roller 44.

As for optimization in a conventional image forming apparatus, a general approach is to form a patch image slightly larger than a detectable spot diameter of a patch sensor so that the patch sensor will be able to detect a density of the formed patch image without fail. However, in an actual apparatus, the size of a gap G during formation of a patch image largely influences an image density of the patch image. For example, as shown in FIG. 25B, there is almost no difference between an optical density OD01 of a patch image under an image forming condition (1) and an optical density OD02 of a patch image under an image forming condition (2). Densities may be detected oppositely in an extremely case. In this manner, when densities of patch images fail to correctly represent a difference between image forming conditions because of variations of a gap, it is impossible to correctly set optimal image forming conditions based on the optical densities of the patch images.

In contrast, in the embodiment of the image forming apparatus, the length Lp of a patch image is set to be longer than the cycle 1.25πr of density variations attributed to gap variations described above. Further, in this embodiment, a density of a patch image is an average value of optical densities in an area which corresponds to the length 1.25πr, which corresponds to one round of the developer roller 44, out of the length Lp along the circumferential direction of the patch image. Hence, as shown in FIG. 25C, an average value of patch image densities under the respective image forming conditions (developing bias) (FIG. 25C shows only three types of OD11 through OD13.) correctly represents a difference between image forming conditions without influenced by gap variations, and hence, it is possible to set an appropriate image forming condition based on the optical densities.

An average value of patch image densities as that described above can be calculated by various types of methods. For example, as shown in FIG. 26A, an image Im obtained by transferring a patch image on the photosensitive member 2 onto the intermediate transfer belt 71 may be sampled at several points, the density sensor 60 may detect an optical densities at each point, and an average value of the optical densities detected at the respective points may be calculated. Alternatively, as shown in FIG. 26B, densities may be detected continuously over a length 1.25πr on an image Im, and output voltages from the density sensor 60 during this may be integrated. Although a detectable spot of the density sensor 60 is circular in FIGS. 26A and 26B, this is not limiting.

Figure 27:
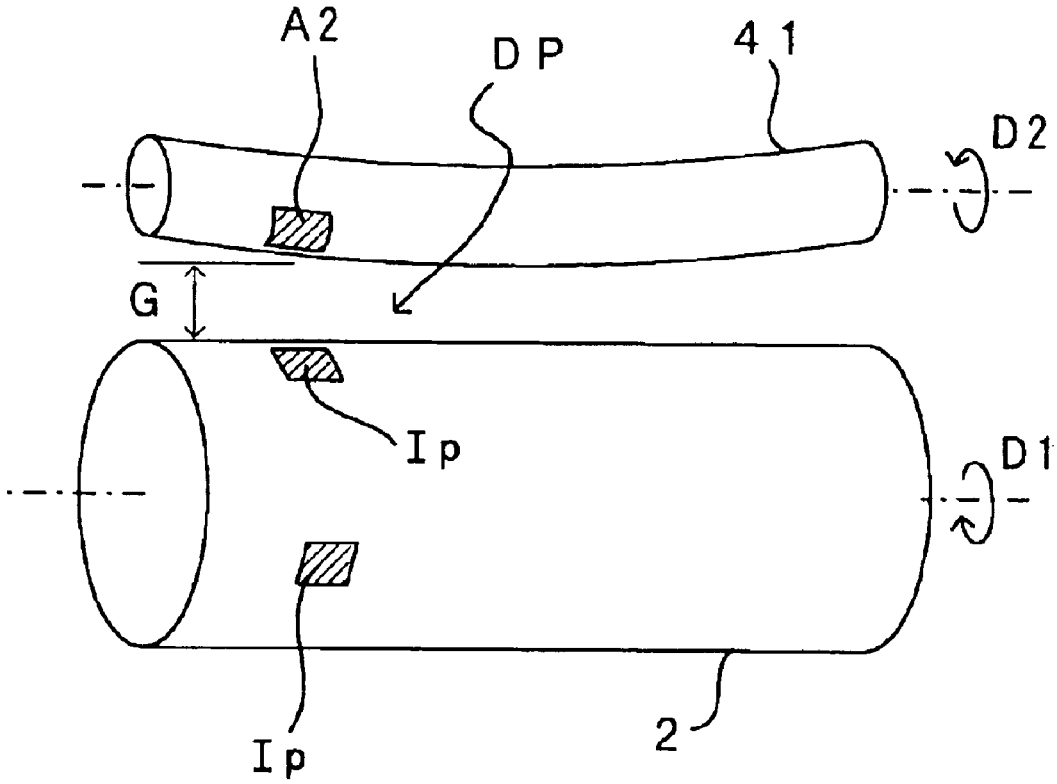
FIG. 27 is a drawing of a high-density patch image which is formed using a third embodiment of the image forming apparatus according to the present invention.
Figure 28A:
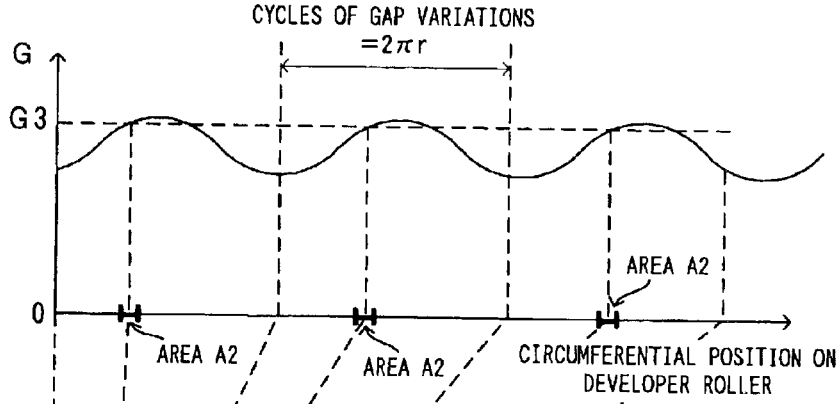
FIGS. 28A and 28B are graphs which show a variation in gap and image density associated with rotations of a developer roller in the third embodiment.
Figure 28B:
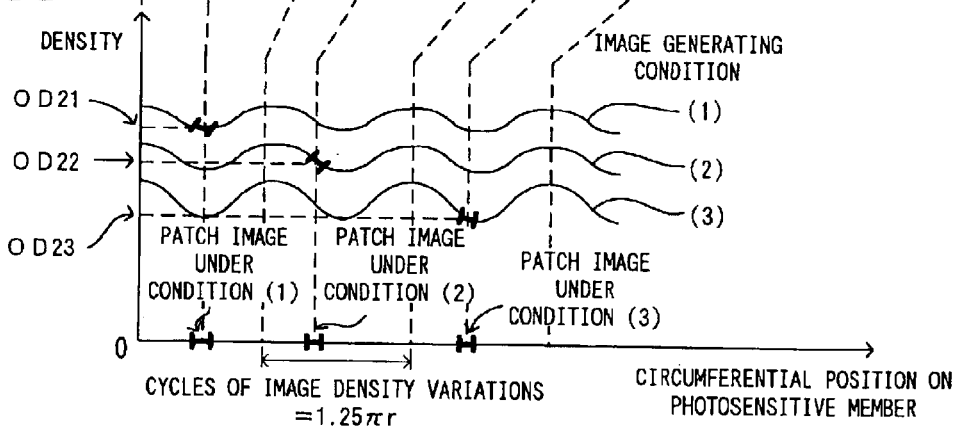

FIG. 27 is a drawing of a high-density patch image which is formed using a third embodiment of the image forming apparatus according to the present invention. FIGS. 28A and 28B are graphs which show a variation in gap and image density associated with rotations of a developer roller in the third embodiment. As shown in FIG. 27, a patch image Ip in this embodiment does not have a shape which extends in the circumferential direction as in the second embodiment, but is formed to be slightly larger than a detectable spot diameter of the density sensor 60. The patch image Ip is formed at a position on the photosensitive member 2 facing the same area A2 on the developer roller 44. In short, the position of the patch electrostatic latent image Ip on the photosensitive member 2 is determined so that when a patch electrostatic latent image formed on the photosensitive member 2 moves passed the developing position DP in accordance with a patch image signal under each image forming condition, the same area A2 on the developer roller 44 always faces this patch electrostatic latent image at the developing position DP. It is possible to determine such a positional relationship based on the numbers of revolutions and the like of the developer roller 44 and the photosensitive member 2 which are controlled by the engine controller 10.

Hence, as shown in FIG. 28A, the gap G is always the same gap G3 at the time of formation of each patch image Ip on the photosensitive member 2 facing the area A2. Image densities OD21, OD22 and OD23 of patch images formed under the image forming conditions (1) through (3) therefore represent a difference between the image forming conditions as shown in FIG. 28B. Thus, it is possible to appropriately set image forming conditions based on these image densities without influenced by variations of the gap.

As described above, in the second and the third embodiments, patch images are formed to have such shapes at such positions as described above, thereby eliminating an influence of gap variations over optimization of an image forming condition which is to be implemented based on image densities of the patch images. As an image is formed under the image forming condition thus properly set, it is possible to stably form a toner image which has an excellent image quality.

In addition, since these two embodiments have the following characteristics in accordance with the difference between the patch image forming conditions described above, either one of these embodiments may be used depending on the specifications and the like of the apparatus.

The apparatus of the second embodiment, forming a patch image over a length which corresponds to one round of the developer roller 44 or over a longer length and detecting a density of the patch image, can more finely control based on the density of the patch image. In other words, for instance, a density of a patch image corresponding to one round of the developer roller 44 may be continuously detected, and a gap profile, which represents the degree of gap variations associated with rotations of the developer roller 44, the maximum gap value, the minimum gap value, etc., may be calculated from changes of the detected density. As the engine controller 10 controls based on the gap profile during the subsequent operations, an image quality and the stability-of the apparatus are further improved.

Meanwhile, the apparatus of the third embodiment requires to form a spot-shaped patch image Ip in an area within the surface of the photosensitive member 2 which corresponds to the same area A2 on the developer roller 44. This necessitates detection of a density merely at one point per patch image, and therefore, allows to use relatively simple control and process in a short period of time. In addition, since a patch image can be formed for every rotation of the developer roller 44, it is possible to further shorten the processing time.

In addition, while the second and the third embodiments described above demand that the circumferential speed ratio of the photosensitive member 2 to the developer roller 44 is 1:1.6 for the purpose of supplying a predetermined amount of toner at the developing position DP, the circumferential speed ratio of the two is not limited only to this but may be any desired ratio. In the embodiment, the length Lp of a patch image may be appropriately determined based on the circumferential speed ratio.

Further, in the apparatus of the third embodiment described above for example, although a correlation between image densities of patch images is not influenced by gap variations, since the absolute image density of each patch image changes depending on the size of the gap G3 during formation of the patch image, for the purpose of more accurately controlling an image forming condition, it is preferable that the gap G3 has a known value. Noting this, a structure or processing to calculate this gap G3 may be further added.

Further, although the second and the third embodiments described above use the developer roller 44 and the photosensitive member 2 which are each formed in the cylindrical shape, these may have other shape. For instance, a belt running across a plurality of rollers may be used.

(V) Fourth Embodiment (Cancellation of Influence Exerted by Photosensitive Member 2 and Developer Roller 44)

In the image forming apparatus shown in FIG. 1, a density of a toner image developed at the developing position changes somewhat, depending on a variation of the structures or characteristics of the photosensitive member 2 and the developer roller 44, etc. Further, since these elements each rotate and move, a density of a toner image formed as a patch image shows a complex variation in accordance with variations of the structures or characteristics of the photosensitive member 2 and the developer roller 44 and the rotating cycles of these elements.

Noting this, in the fourth embodiment, influence exerted by the structure, the characteristics and the like of the photosensitive member 2 are separately extracted from influence exerted by structure, the characteristics and the like of the developer roller 44. In short, while density variations at the rotating cycles of the developer roller 44 and density variations at the rotating cycles of the photosensitive member 2 superimposed with each other reveal themselves in a toner density at each point on a patch image, density variations at the rotating cycles of the developer roller 44 reveal themselves within a length of the patch image which corresponds to the circumferential length of the developer roller 44. Hence, as a toner density of the patch image is calculated within a detection area whose length corresponds to the circumferential length of the developer roller 44, it is possible to identify how a density varies at the rotating cycles of the developer roller 44. On the other hand, since variations at the rotating cycles of the photosensitive member 2 are superimposed over a toner density detected in each detection area, it is possible to identify how a density varies at the rotating cycles of the photosensitive member 2 by examining a density difference between a plurality of detect areas which are positioned at different positions from each other.

Hence, the fourth embodiment makes it possible to individually deal with density variations which arise because of variations of the structure, the characteristics and the like of each one of the photosensitive member 2 and the developer roller 44. It is possible to eliminate an influence of density variations over a patch image, by appropriately processing the influence of the density variations. As a result, it is possible to set a density control factor to an optimal state and stably form a toner image which has an excellent image quality. This will be described in detail with reference to associated drawings.

Figure 29:
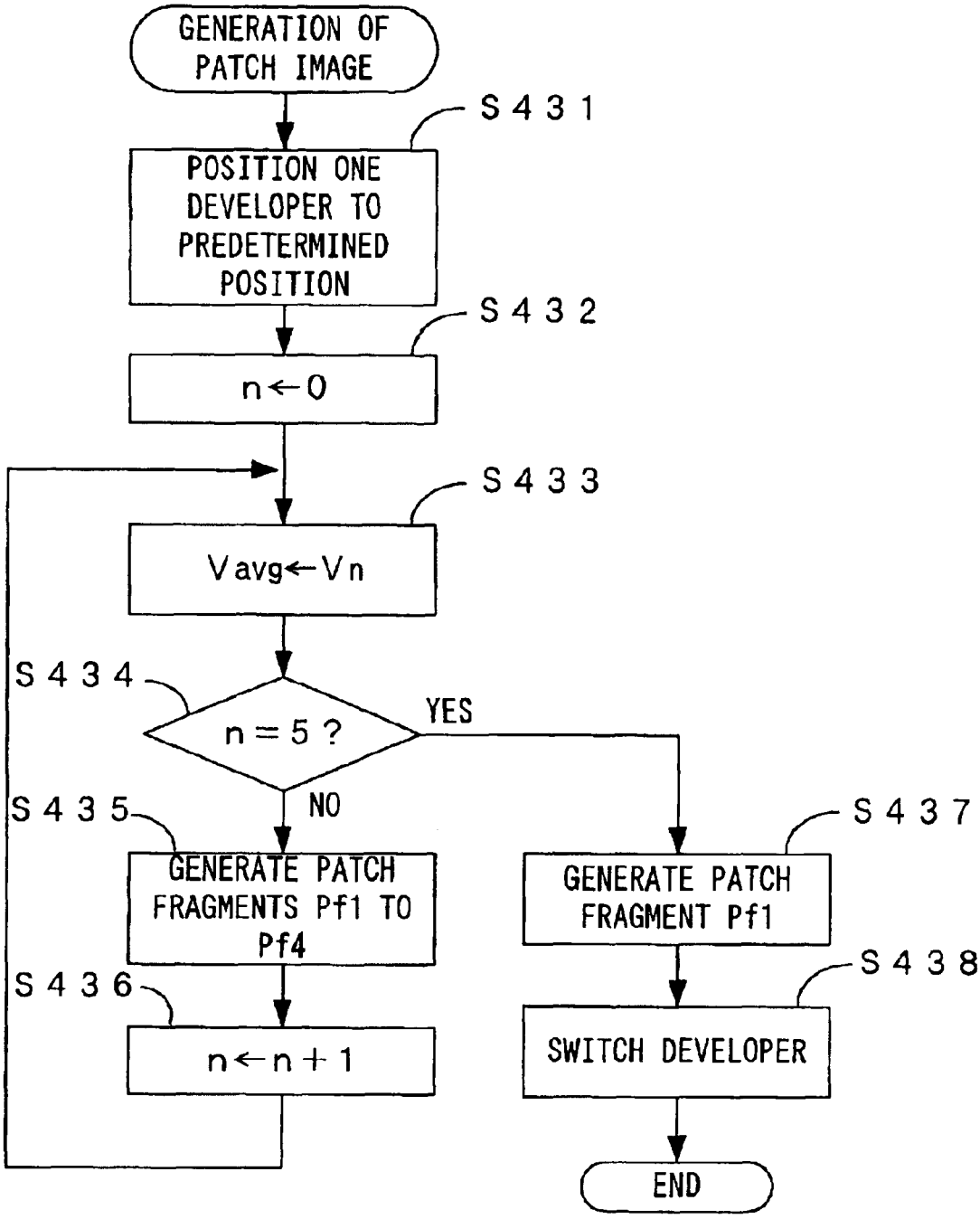
FIG. 29 is a flow chart which shows an operation of forming a patch image in a fourth embodiment.
Figure 30:
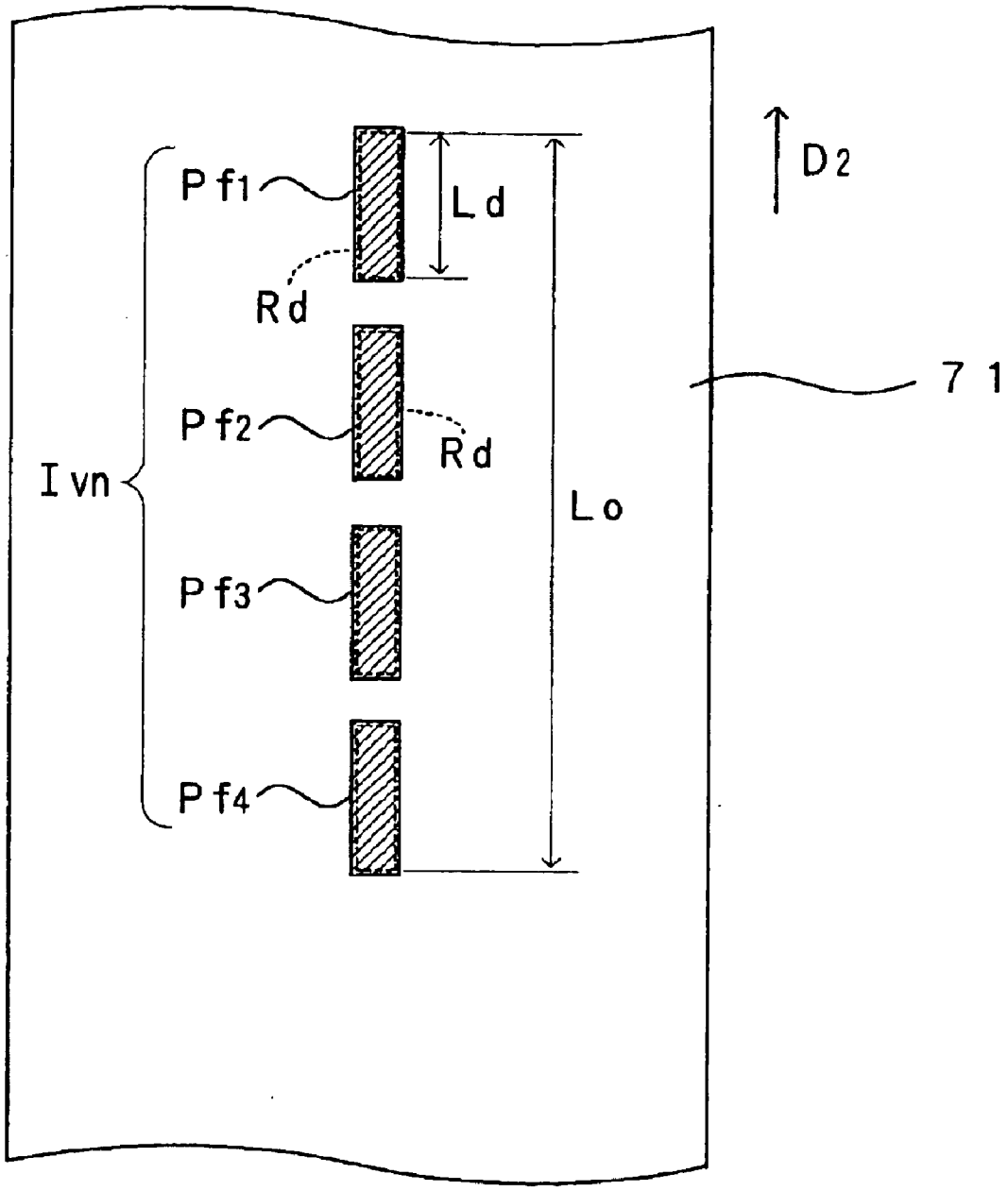
FIG. 30 is a drawing of a patch image transferred onto a surface of an intermediate transfer belt in the fourth embodiment.

FIG. 29 is a flow chart which shows an operation of forming a patch image in the fourth embodiment. In the fourth embodiment, the direct current developing bias Vavg is variable over six levels of V0, at which the absolute value |Vavg| is the smallest, to V5 at which the absolute value |Vavg| is the largest, and a patch image is formed at each level. First, one toner color, e.g., the yellow color, is selected from the four colors, and the developer unit 4 is rotated to position the developer roller 44 disposed to the developer 4Y which corresponds to the selected color at an opposed position facing the photosensitive member 2 (Step S431). Next, a count value n of an internal counter disposed inside the CPU 101 is reset (Step S432). The direct current developing bias Vavg is set to Vn (Vn=V0 since n=0) (Step S433). Whether the count value n is 5 is determined at this stage (Step S434). Since n=0, the apparatus proceeds to a Step S435, to thereby form a patch image Iv0 which is formed by four patch fragments Pf1 through Pf4 which are shown in FIG. 30. FIG. 30 is a drawing of a patch image transferred onto the surface of the intermediate transfer belt in the fourth embodiment. The patch image may have any desired image pattern, such as a solid image, a halftone image, etc. The reason of defining the patch image will be described later in detail.

The count value n is incremented (Step S436), the apparatus returns to the step S433, and the steps S433 through S436 are repeated until the count value n becomes 5.

On the contrary, when the count value n is 5 at the step S434, the apparatus proceeds to a Step S437, to thereby form a patch image Iv5 which is formed only by the patch fragment Pf1. The developer is then switched (Step S438). To be more specific, the developer unit 4 shown in FIG. 1 is rotated 90 degrees to the left hand side. The cyan developer 4C, instead of the yellow developer 4Y, is consequently positioned at the opposed position facing the photosensitive member 2.

As a result of patch image formation at the respective developing biases, on the intermediate transfer belt 71, five types of patch images Ivn (n=0, 1, . . . , 4), which are formed at the five levels of the developing bias Vn (n=0, 1, . . . , 4) and formed by four patch fragments Pf1 through Pf4, and a patch image Iv5, which is formed at the developing bias V5 and formed by one patch fragment Pf1, line up in the direction D2 in which the intermediate transfer belt 71 moves. The number of the patch fragments is 21 in total. Shown in FIG. 30 is a representative example of a patch image Ivn alone which is formed at one developing bias Vn and formed by the four patch fragments Pf1 through Pf4.

Figures 31A, 31B, 31C:
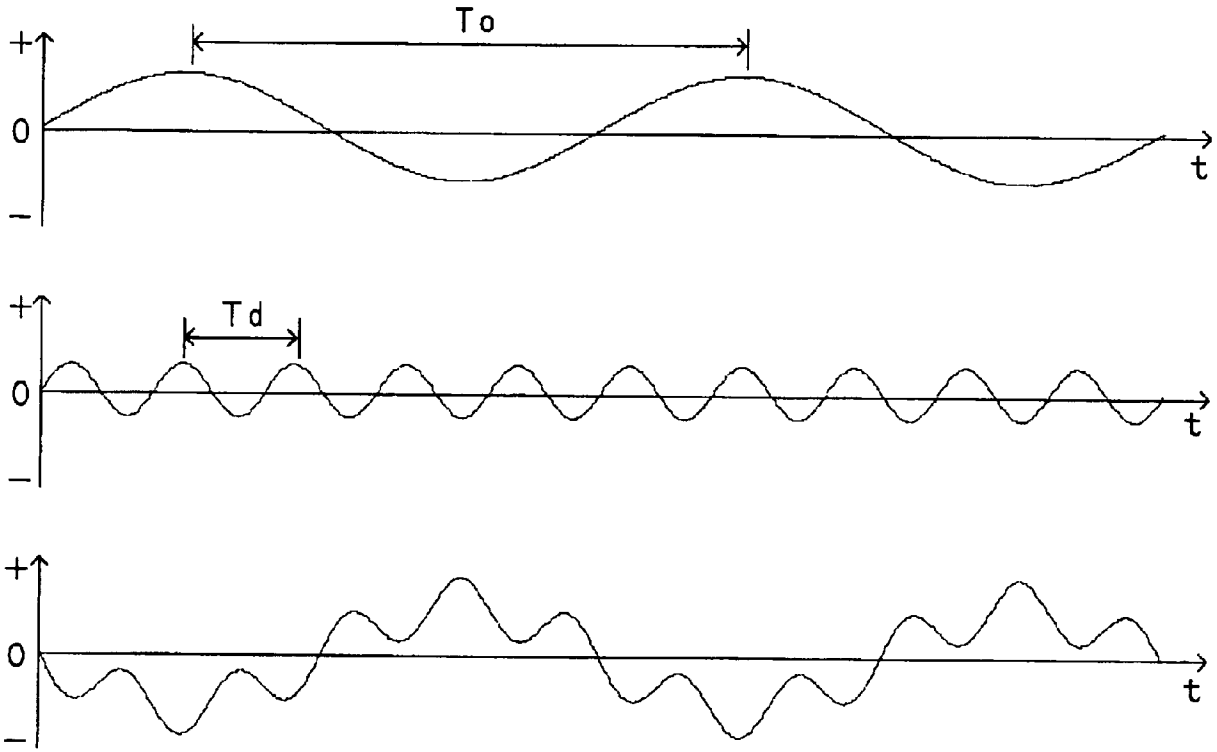
FIGS. 31A through 31C are graphs which show eccentricity of a photosensitive member and a developer roller and variations of a gap between the two based on the eccentricity.
Figure 32:
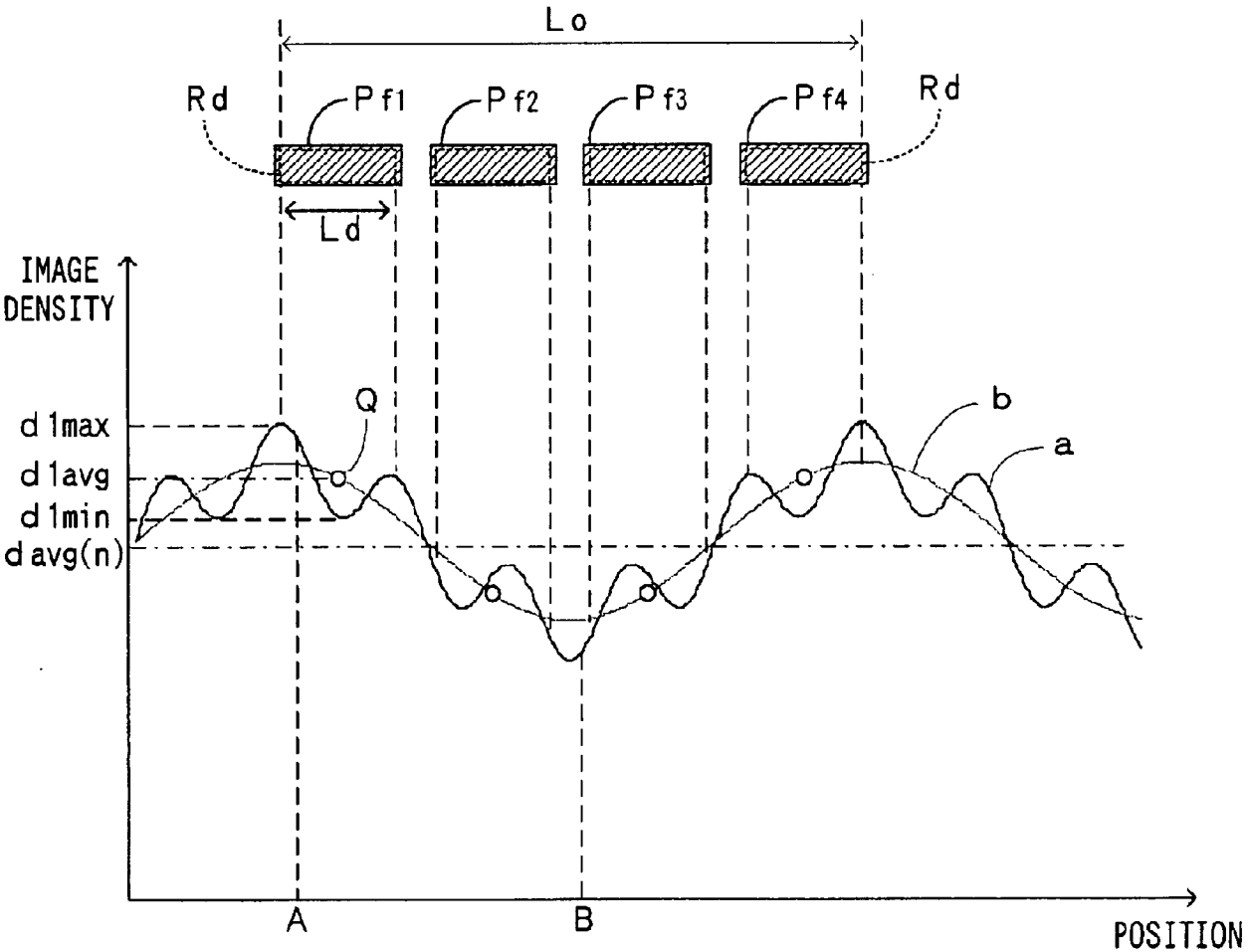
FIG. 32 is a drawing which shows density variations of a patch image which are created in accordance with variations in gap.

The reason of forming a patch image Ivn at each developing bias Vn in such a shape above will now be described with reference to FIGS. 31A through 31C and 32. FIGS. 31A through 31C are graphs which show eccentricity of the photosensitive member and the developer roller and variations of a gap between the two based on the eccentricity. FIG. 32 is a drawing which shows density variations of a patch image which are created in accordance with variations in gap. As described earlier, in this type of image forming apparatus, an image density may sometimes vary in synchronization to the rotating cycles of the photosensitive member 2 and the developer roller 44. As one example of causes of such density variations, eccentricity of the photosensitive member 2 and the developer roller 44 will now be described. Causes of cyclic density variations may include friction-induced deformation, a scratch and dirt on the surfaces of the photosensitive member and the developer roller, variation in sensitivity within the surface of the photosensitive member 2 and the like, in addition to the eccentricity of the photosensitive member 2 and the developer roller 44. While the extent of density variations attributed to these causes is different, since the density varies the rotating cycles of the photosensitive member 2 and the developer roller 44, influences of these may be understood in a similar manner to the eccentricity which will be described below.

In the event that the photosensitive member 2 has eccentricity, the radius of a portion facing the developing position DP cyclically increases and decreases with time t as shown in FIG. 31A in synchronization to rotating cycles T0. The amount of the eccentricity of the photosensitive member 2 referred to here is a difference between an average radius of the photosensitive member 2 and the radius of the photosensitive member 2 on a virtual line linking a central axis of the photosensitive member 2 and that of the developer roller 44. On the other hand, since the developer roller 44 rotates five rounds while the photosensitive member 2 rotates one round, rotating cycles Td of the developer roller 44 is ⅕ of rotating cycles T0 of the photosensitive member 2. Hence, eccentricity-induced radius variations are as shown in FIG. 31B for instance. As a result, the gap G between the photosensitive member 2 and that of the developer roller 44 at the developing position DP (FIG. 4) shows complex variations as shown in FIG. 31C.

In an image forming apparatus of the non-contact developing type, since the amount of toner transfer with the gap G changes in accordance with the intensity of an alternating field which is developed within the gap G. such gap variations lead to changes in image density. In other words, as denoted at the curve a in FIG. 32, a density of an image cyclically changes in accordance with variations of the gap G Hence, a density of a patch image, too, which is formed as an index for optimization of a density control factor changes depending on a position at which the patch image is formed, and thus created density variations may influence the optimization in some cases. For example, even when direct current developing bias Vavg serving as a density control factor is set to a constant value, there arises a big difference in image density between a patch image formed at a position A and a patch image formed at a position B shown in FIG. 32, and therefore, as an optimal value of the direct current developing bias Vavg is calculated based on these image densities, thus calculated optimal values become very different from each other.

In this apparatus, noting that density variations described above appear in synchronization to the rotating cycles of the photosensitive member 2 and the developer roller 44, a patch image Ivn formed under one image forming condition (which is determined by a value of the direct current developing bias Vavg in this embodiment) is formed by four patch fragments Pf1 through Pf4 as shown in FIG. 30. The patch images Pf1 and the like are disposed at equal intervals in a section which corresponds to the circumferential length L0 of the photosensitive member 2 in such a manner that the patch fragments cover four detection areas Rd whose length Ld (i.e., a value obtained by multiplying the circumferential length of the developer roller 44 by the circumferential speed ratio 1.6) corresponds to the circumferential length of the developer roller 44. To be more specific, considering positional deviations during image formation or toner density detection and the like, the respective patch fragments Pf1 through Pf4 are formed as a rectangle which is slightly larger than the detection areas Rd. This ensures that density variations at the rotating cycles of the developer roller 44 appear as density variations within each patch fragment while density variations at the rotating cycles of the photosensitive member 2 appear as density differences between the patch fragments, which permits to process these density variations separately from each other. The detection areas Rd are virtual areas which aim at defining an area for detection of a toner density with the density sensor 60, and as such, do not require any special structure to be disposed on the surface of the photosensitive member 2 or the intermediate transfer belt 71.

Density variations as those shown in FIG. 32 for instance appear in each one of thus formed patch fragments Pf1 through Pf4, in accordance with variations of the gap G. In short, in the patch fragment Pf1 for example, an image density of this patch fragment varies between the maximum density d1max and the minimum density d1min depending on a position. These density variations include superimposition of density variations attributed to the photosensitive member 2 (denoted at the curve b in FIG. 32) and those attributed to the developer roller 44. As for the cyclic density variations attributed to the developer roller 44, it is possible to cancel out an influence of these by averaging out over the length Ld which corresponds to the circumferential length of the developer roller 44. That is, when an average image density d1avg over the length Ld within the patch fragment Pf1 is calculated, as denoted at the circle Q in FIG. 32, the average value d1avg is approximately on the curve b which represents the density variations attributed to the photosensitive member 2.

In a similar manner, average image densities over the length Ld are calculated also for the other patch fragments Pf2, Pf3 and Pf4, thereby canceling the density variations arising at the rotating cycles of the developer roller 44. These values, as denoted at the circles in FIG. 32, represent the density variations arising at the rotating cycles of the photosensitive member 2. The four average image densities thus calculated as for the respective patch fragments Pf1 through Pf4 are averaged, whereby an average image density davg(n) of the patch image Ivn is calculated from which the influence of the density variations arising at the rotating cycles of the photosensitive member 2 has been eliminated.

Meanwhile, one patch fragment Pf1 forms the patch image Iv5 which is formed at the maximum value V5 within the variable range of the direct current developing bias Vavg. This is because density variations become small as an image density increases in accordance with an increase in direct current developing bias Vavg, and therefore, the density variations are less influential in an area where the direct current developing bias Vavg is large and the patch image does not always need to have such a structure as that described above. Requiring to form the patch image Iv5 which is formed only by one patch fragment when the direct current developing bias Vavg has the maximum value V5, the fourth embodiment reduces the toner consumption.

As described above, in the fourth embodiment, patch images Ivn formed by four patch fragments Pf1 through Pf4 are formed at the five bias values V0 through V4, with which an image density is lower, out of the six levels V0 through V5 of the direct current developing bias. Thus, the image forming condition that the direct current developing bias Vavg is set to any one of the values V0 through V4 corresponds to a "selective image forming condition" of the present invention. Which one of the multiple image forming conditions, is to be used as a selective image forming condition is not limited to the above but may be freely determined. Since density variations are remarkable under a condition which makes an image density relatively low as described above, it is desirable that a patch image has such a structure as described above at least under a low-density side image forming condition which makes an image density the lowest.

Figure 33:
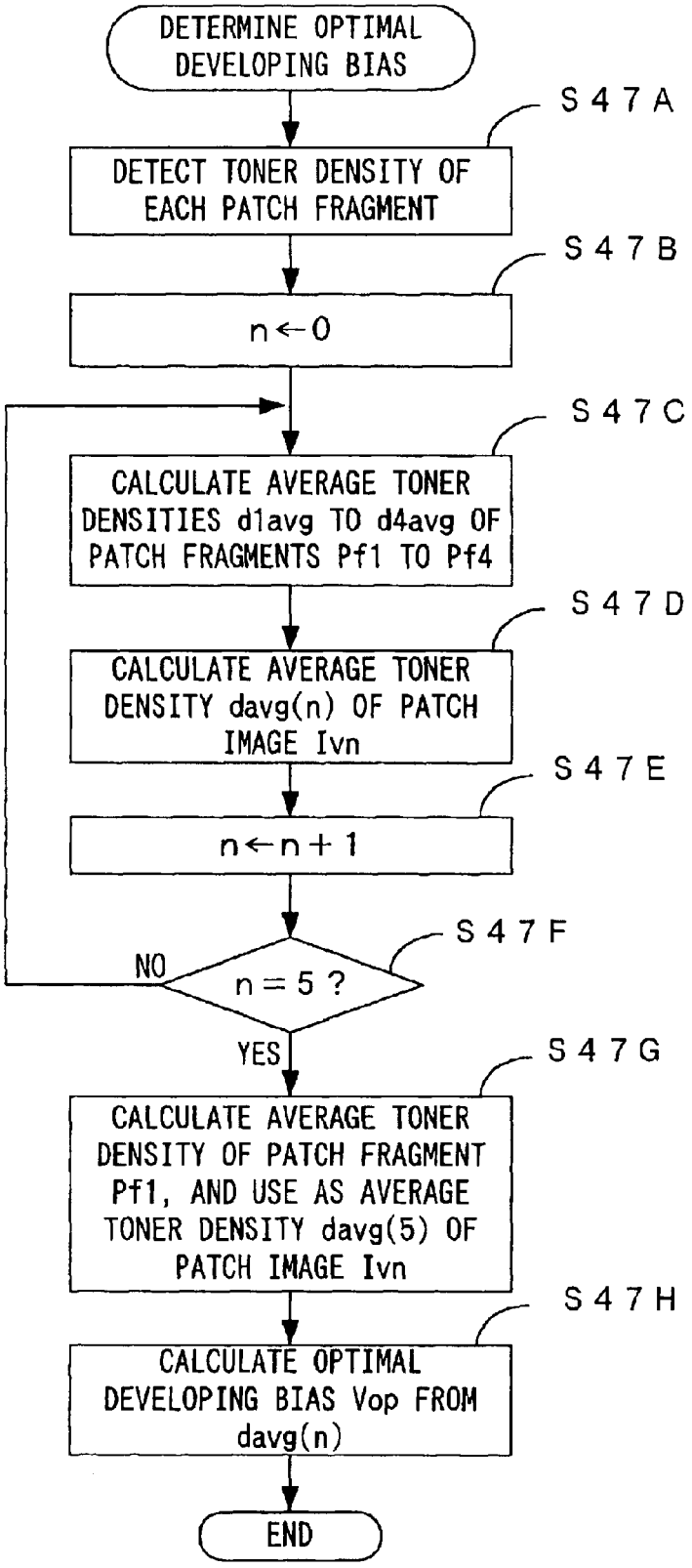
FIG. 33 is a flow chart which shows an operation of determining an optimal developing bias in the fourth embodiment.

Next, a method of determining an optimal developing bias while eliminating an influence of density variations over a patch image will now be described based on the consideration above. FIG. 33 is a flow chart which shows an operation of determining an optimal developing bias in the fourth embodiment. As for the total of 21 patch fragments formed in the manner described above, at the timing that each patch fragment arrives at the opposed position facing the density sensor 60 as the intermediate transfer belt 71 moves, the density sensor 60 detects a toner density of the patch fragment (Step S47A). At this stage, since the CPU 101 is sampling output signals from the density sensor 60 at constant cycles, the toner density of each patch fragment is detected at a plurality of mutually different detection positions in the patch length direction D2 of the patch fragment.

Average toner densities d1avg through d4avg of the four patch fragments Pf1 through Pf4 formed with the respective developing biases Vn are calculated (Step S47C) while increasing the count value n of the internal counter of the CPU 101 from 0 to 4 by 1 each time (Step S47B, Step S47E). To be more specific, of toner density data sampled at a plurality of positions of the patch fragment Pf1 for instance, an average value of data detected within a range which corresponds to the length Ld, which corresponds to the circumferential length of the developer roller 44,is used as the average toner density d1avg of this patch fragment Pf1. In a similar manner, the average toner density d2avg and the like of the patch fragments Pf2 and the like are calculated.

Next, an average value of the average toner densities d1avg through d4avg of the respective patch fragments Pf1 through Pf4 thus obtained is calculated, and used as an average toner density davg(n) of a patch image Ivn (Step S47D). The steps S47C and S47D are repeated while incrementing the count value n until it is determined at the step S16 that n=5, thereby calculating average toner densities davg(0) through davg(4) of the patch images Iv0 through Iv4 formed at the direct current developing biases V0 through V4.

Meanwhile, with respect to the patch image Iv5 which is formed at the direct current developing bias V5 and formed only by one patch fragment Pf1, the average toner density of the patch fragment Pf1 is used as an average toner density davg(5) of the patch image Iv5 (Step S47G).

Figure 34:
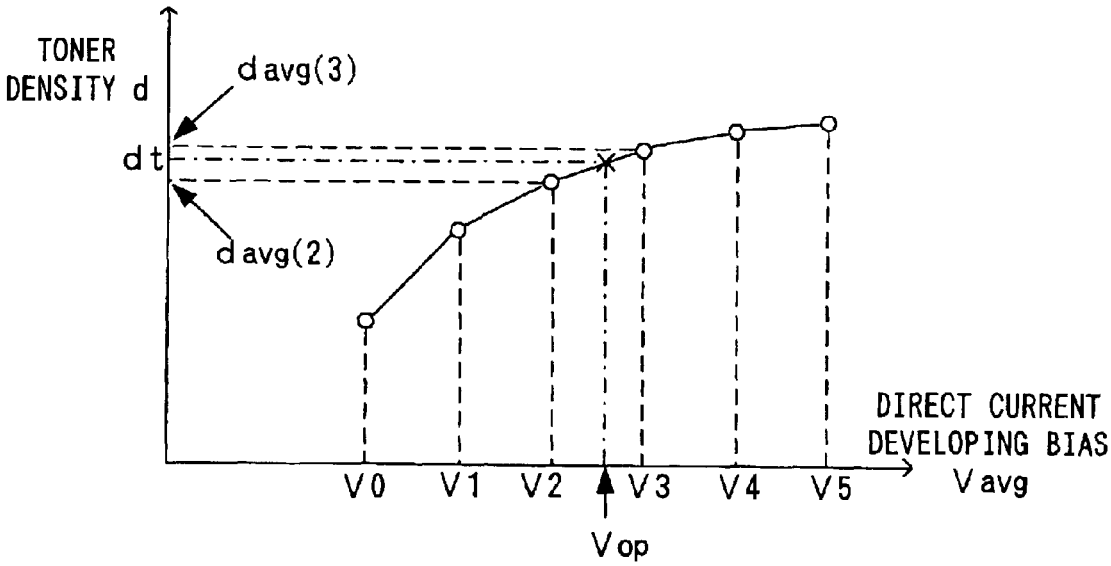
FIG. 34 is a drawing of a plotted toner density davg(n) of a patch image Ivn which is formed with each direct current developing bias Vn.

From the average toner densities davg(n) of the respective patch images Ivn thus calculated, an optimal value Vop of the direct current developing bias Vavg is calculated based on a principle as that shown in FIG. 34 for instance (Step S47H). FIG. 34 is a drawing of a plotted toner density davg(n) of a patch image Ivn which is formed with each direct current developing bias Vn. As an average toner density davg(n) of each patch image Ivn is calculated in the manner described above, a relationship between the direct current developing bias Vavg and a patch image density is determined. A direct current developing bias which makes a toner density become a predetermined target density dt is calculated from this result, and thus calculated bias is used as the optimal value Vop of the direct current developing bias Vavg. In the example in FIG. 34, since the target density dt is located between the density davg(2) of the patch image Iv2 formed with the direct current developing bias V2 and the density davg(3) of the patch image Iv3 formed with the direct current developing bias V3, an area between these two plotting points is interpolated with a linear function or other appropriate function, whereby the optimal value Vop is obtained as a value of the direct current developing bias which corresponds to an intersection (denoted at the x mark) with a linear line which expresses the density dt.

As the optimal value Vop of the direct current developing bias Vavg is calculated which permits to obtain a desired image density in one toner, the calculated value is stored in a memory 127. In the subsequent image formation, a developing bias which is set based on the value stored in the memory 127 is applied upon the developer roller 44.

With the processing above repeated for each one of the four toner colors, an optimal value Vop of the direct current developing bias Vavg for each toner color is calculated. Executing image formation under thus optimized image forming condition, this image forming apparatus stably forms a toner image which has an excellent image quality. As shown in FIG. 1, since a position on the intermediate transfer belt 71 at which a toner image is formed as a patch image (primary transfer region TR1) is considerably far away from a position at which a toner density of the toner image is detected (the opposed position facing the density sensor 60), and since the two processes of patch image formation and toner density detection can be performed independently of each other, it is possible to execute the two processes in parallel at these two positions at the same time. Hence, the processes in the respective toner colors may be executed in parallel, e.g., patch image formation in the cyan color may be executed during detection of a density of a patch image formed in the yellow color, whereby a period of time needed for the entire process is shortened.

As described above, in the image forming apparatus of this embodiment, the direct current developing bias Vavg functions as a density control factor. Patch images are formed while varying the direct current developing bias Vavg, toner densities of the patch images are detected, and an optimal value Vop of the direct current developing bias Vavg is calculated based on the results of the detection. Further, each patch image is formed by a plurality of patch fragments which are disposed at equal intervals in a section of the intermediate transfer belt 71 which corresponds to the circumferential length L0 of the photosensitive member 2, and each patch fragment has the length Ld which corresponds to the circumferential length of the developer roller 44. Toner densities detected on thus formed patch fragments are averaged out, and an average toner density of each patch fragment is calculated, thereby calculating a toner density of each patch image. This allows to cancel out an influence of the cyclic density variations attributed to the structures of the photosensitive member 2 and the developer roller 44. In consequence, it is possible to set the direct current developing bias Vavg to an optimal state based on a patch image density and to stably form a toner image which has an excellent image quality.

Although the fourth embodiment described above demand to form a patch image Ivn which is formed by four patch fragments Pf1 through Pf4, the number of patch fragments which form one patch image is not limited to this but may be appropriately determined in accordance with a dimensional ratio of the photosensitive member to the developer roller or the extent of density variations which appear at the rotating cycles of each one of these. However, in order to accurately extract density variations appearing at the rotating cycles of the photosensitive member, it is desirable that there are at least two detection areas for one round of the photosensitive member.

Figure 35:
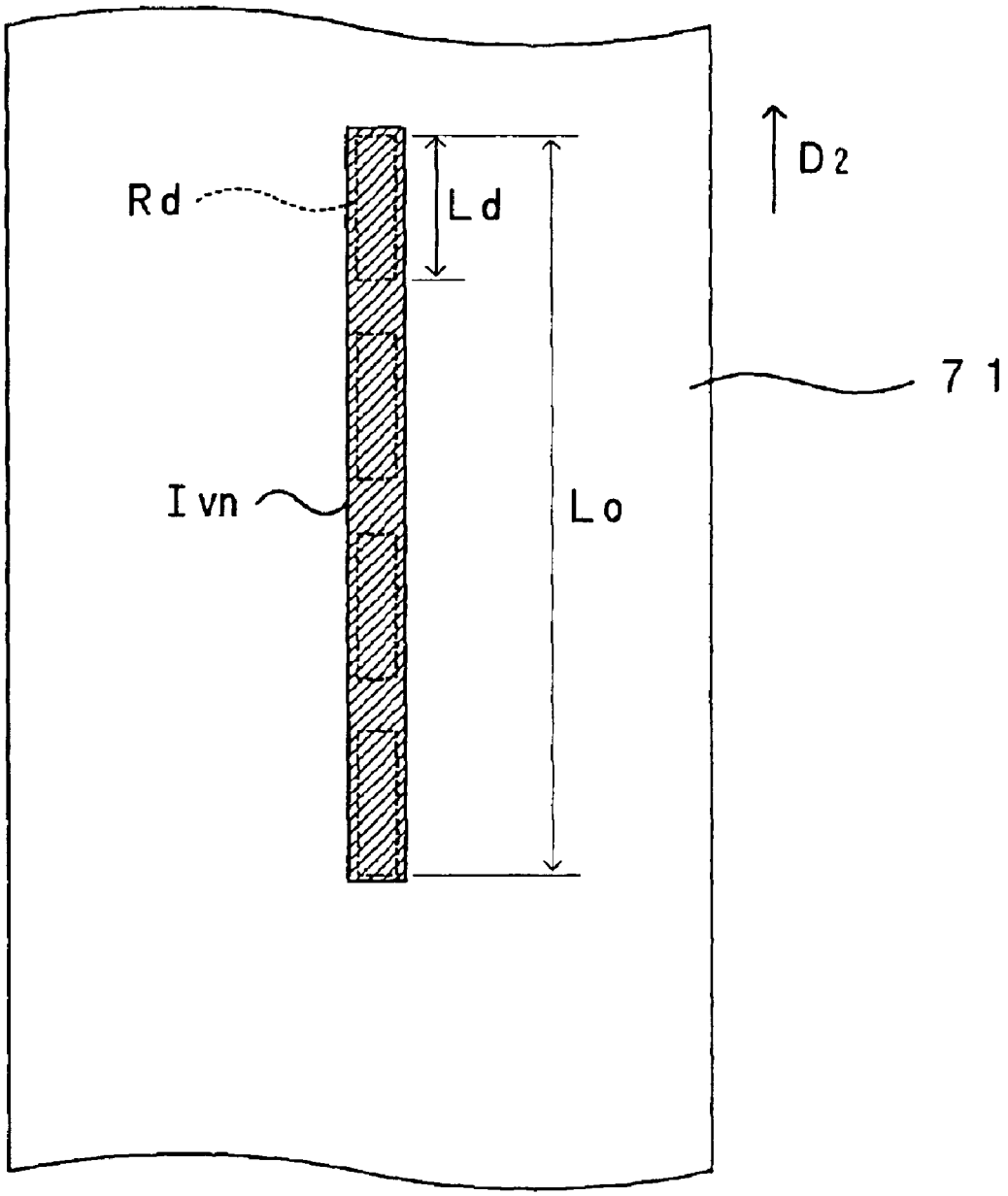
FIG. 35 is a drawing which shows an example of a patch image which is structured as a continuous image.

Further, a patch image may be a strap-shaped continuous image which covers a plurality of detection areas as a whole for instance. FIG. 35 is a drawing which shows an example of a patch image which is structured as a continuous image. In the present invention, although a patch image Ivn is structured so as to entirely cover a plurality of detection areas Rd, but may have any desired structure in the other area. Hence, as shown in FIG. 35, a patch image Ivn may be a continuous image which entirely covers all of the plurality of detection areas Rd. Alternatively, such patch fragments may be formed each covering two detection areas of the plurality of detection areas Rd.

From a comparison of two types of patch images shown in FIGS. 30 and 35, it is seen that the one shown in FIG. 35 demands a greater amount of toner for formation of the patch image. Hence, in the event that the dimensional ratio of the photosensitive member to the developer roller is large or that the intervals between the detection areas Rd are long since the number of patch fragments to be formed is small or for other reason for instance, as a patch image formed by a plurality of patch of fragments is formed as shown in FIG.

30, it is possible to reduce the toner consumption. On the contrary, when the intervals between the detection areas are relatively short, there is merely a small number of advantages to implement the above. Considering a positioning accuracy of aligning a patch image formation position and a toner density detection position, a detection error at an edge of an image due to a density variation, etc., a continuous image as that shown in FIG. 35 is more preferable.

Further, the circumferential speed ratio of the photosensitive member 2 to the developer roller 44 is 1.6, that is, the developer roller 44 rotates at a circumferential speed which is 1.6 times as fast as the circumferential speed of the photosensitive member 2 in the embodiments described above, the circumferential speed ratio of the two may have other value. However, in such a case, the length of the patch fragments Pf1, . . . need to increase and decrease in accordance with the circumferential speed ratio. For instance, in an apparatus that the two rotate at the same circumferential speed, a "length which corresponds to the circumferential length of the developer roller" is equal to the circumferential length of the developer roller. Hence, the length of the respective detection areas Rd may be equal to the circumferential length of the developer roller in this case.

In addition, while the circumferential length of the developer roller 44 is 0.32 times as long as the circumferential length of the photosensitive member 2 in the embodiment described above, the dimensional ratio of the two may have other value than this.

Further, although the embodiments described above require that the density sensor 60 is disposed facing the surface of the intermediate transfer belt 71 and detects a density of a patch image which is carried by the intermediate transfer belt 71 for instance, this is not limiting. A density sensor may be disposed facing toward the surface of the photosensitive member 2 and detect a density of a patch image which has been developed on the photosensitive member 2, for example.

Further, although the embodiments described above require that the density sensor 60 is formed by a reflection-type photosensor which irradiates light toward the surface of the intermediate transfer belt 71 and detects the amount of reflection light from the surface of the intermediate transfer belt 71, this is not limiting. For instance, the light emitter element and the light receiver element of the density sensor for instance may be disposed facing each other across the intermediate transfer belt and may detect the amount of light which is transmitted by the intermediate transfer belt.

Further, although the embodiments described above require that an average value of toner density data sampled at a plurality of mutually different positions in reach patch fragment for the purpose of calculating an average toner density of each patch fragment, this is not limiting. For instance, output voltages from the density sensor 60 may be detected continuously in the respective detection areas Rd and an average toner density may be calculated from an integrated value of these.

(VI) Others

The present invention is not limited to the embodiments above, but may be modified in various manners in addition to the embodiments above, to the extent not deviating from the object of the invention. For instance, while the embodiments described above use the direct current developing bias as a density control factor, in addition to this, an amplitude Vpp of the developing bias, the electrifying bias applied upon the charger unit 3, an energy density of the light beam L and the like may function as density control factors.

Further, while the embodiments described above are directed to an image forming apparatus of the non-contact developing type in which the photosensitive member 2 and the developer roller 44 are disposed with the gap G so as to face with each other, the present invention is applicable also to an apparatus of the contact developing type which executes development with these two abutting on each other. Although an apparatus of the contact developing type does not have a problem that the gap G varies unlike in the embodiments described above, an abutting pressure between the photosensitive member and the developer roller may sometimes cyclically vary because of eccentricity of these or for other reason. Thus, with respect to variations of the characteristics of the photosensitive member, there is a similar problem to that of an apparatus of the non-contact developing type. Hence, even in an image forming apparatus of the contact developing type, cyclic density variations may appear in a similar fashion, which however can be eliminated if the present invention is applied.

Further, while the embodiments described above are directed to an image forming apparatus which comprises the intermediate transfer belt 71 which serves as an intermediate medium which temporarily carries a toner image which has been developed on the photosensitive member 2, the present invention is applicable also to an image forming apparatus comprising other intermediate medium such as a transfer drum and a transfer roller and an image forming apparatus which comprises an intermediate medium and is structured such that a toner image which has been formed on the photosensitive member 2 is transferred directly onto the sheet S which is a final transfer member.

Further, while the embodiments described above are directed to an image forming apparatus which is capable of forming a full-color image using toner in the four colors of yellow, cyan, magenta and black, the colors of toner to use and the number of the toner colors are not limited to this but may be freely determined. For example, the present invention is applicable also to an apparatus which forms a monochrome image using only black toner.

In addition, while the respective embodiments described above are an application of the present invention to a printer which executes the image forming operation based on an image signal fed from an external apparatus, the present invention is of course applicable also to a copier machine which internally forms an image signal in accordance with a user's image formation request, which may be pressing of a copy button for instance, and executes the image forming operation based on the image signal, and to a facsimile machine which executes the image forming operation based on an image signal which is fed on a communications line.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

an image carrier which has an endless shape and rotates in a predetermined direction, to thereby transport an electrostatic latent image which is carried on a surface of said image carrier;

developing means which supplies toner to said electrostatic latent image, visualizes said electrostatic latent image with said toner and accordingly forms a toner image; and density detecting means which detects a toner density of a toner image which is formed as a patch image, wherein:

while a density control factor, which influences an image density, set to be variable over multiple levels, a patch image is formed at each level of said image forming condition, said density detecting means detects toner densities of said patch images, and said density control factor is optimized based on the detection results; and a low-density patch image formed under a low-density side image forming condition, which makes an image density the lowest among said multiple levels of said image forming condition, has a length which is equal to or longer than a circumferential length of raid image carrier in a patch length direction which corresponds to a direction in which said image carrier moves, said density detecting means detects a density in a portion of said low-density patch image which corresponds to said circumferential length of said image carrier, and a toner density of said low-density patch image is calculated.

2. The image forming apparatus of claim 1, wherein said low-density patch image has a strap shape which continuously extends in said patch length direction.

3. The image forming apparatus of claim 2, wherein said toner density of said low-density patch image is an average value of toner densities at respective detection positions of said low-density patch image, said detection positions being in said patch length direction and different from each other.

4. The image forming apparatus of claim 1, wherein said low-density patch image is formed by a plurality of patch fragments which are in said patch length direction.

5. The image forming apparatus of claim 4, wherein said toner density of said low-density patch image is an average value of toner densities of said plurality of patch fragments.

6. The image forming apparatus of claim 1, wherein the length along said patch length direction of a high-density patch image formed under a high-density side image forming condition, which makes an image density the highest among said multiple levels of said image forming condition, is shorter than said circumferential length of said image carrier.

7. The image forming apparatus of claim 1, wherein said surface of said image carrier is formed by a photosensitive member, said electrostatic latent image is formed as a surface of said photosensitive member is exposed with a light beam.

8. The image forming apparatus of claim 1, further comprising bias applying means which applies a predetermined developing bias upon said developing means to thereby move said toner from said developing means to said image carrier, wherein said developing bias is used as said density control factor.

9. The image forming apparatus of claim 1, further comprising an intermediate member which is structured so as to be able to temporarily carry a visualized toner image on said surface of said image carrier, wherein said density detecting means detects a toner density of a toner image which is carried as a patch image on a surface of said intermediate member.

10. An image forming apparatus, comprising:

an image carrier which has an endless shape and rotates in a predetermined direction, to thereby transport an electrostatic latent image which is carried on a surface of said image carrier;

developing means which supplies toner to said electrostatic latent image, visualizes said electrostatic latent image with said toner and accordingly forms a toner image; and density detecting means which detects a toner density of a toner image which is formed as a patch image, wherein:

while a density control factor, which influences an image density, set to be variable over multiple levels, a patch image is formed at each level of said image forming condition, said density detecting means detects toner densities of said patch images, and said density control factor is optimized based on the detection results;

at least one or more of said patch images has a length along said patch length direction, which corresponds to a direction in which said image carrier moves, is equal to or longer than said circumferential length of said image carrier; and said toner densities of said patch images are found as said density detecting means detects densities in portions of said patch images which correspond to said circumferential length of said image carrier.

11. An image forming method in which an electrostatic latent image is formed on a surface of an image carrier which is formed in an endless shape and rotates in a predetermined direction, toner is supplied to said electrostatic latent image, said electrostatic latent image is visualized with said toner, and a toner image is accordingly formed, said method comprising the steps that:

while a density control factor, which influences an image density, set to be variable over multiple levels, a patch image is formed at each level of said image forming condition, a density detecting means detects toner densities of said patch images, and said density control factor is optimized based on the detection results; and a low-density patch image formed under a low-density side image forming condition, which makes an image density the lowest among said multiple levels of said image forming condition, has a length which is equal to or longer than a circumferential length of said image carrier in a patch length direction which corresponds to a direction in which said image carrier moves, said density detecting means detects a density in a portion of said low-density patch image which corresponds to said circumferential length of said image carrier, and a toner density of said low-density patch image is calculated.

12. The image forming method of claim 11, wherein:

a predetermined developing bias is applied upon developing means, said toner is made move to said image carrier from said developing means, and said electrostatic latent image is visualized with said toner; and said developing bias is used as said density control factor.

13. An image forming apparatus, comprising;

an image carrier which carries an electrostatic latent image on a surface of said image carrier;

a toner carrier which transports toner carried on a surface of said toner carrier to a developing position facing said image carrier, while rotating in a predetermined rotation direction; and control means which moves said toner carried on said surface of said toner carrier to said image carrier while feeding said surface of said image carrier which carries said electrostatic latent image to said developing position, to thereby visualize said electrostatic latent image with said toner and accordingly form an image, wherein:

said control means controls an image forming condition based on an image density of a patch image which is formed in a patch image area on said image carrier; and while said patch image area moves passed said developing position, said toner carrier rotates one round or more.

14. The image forming apparatus of claim 13, wherein said control means controls said image forming condition based on an image density within an area of said patch image which moves passed said developing position while said toner carrier rotates one round.

15. The image forming apparatus of claim 13, wherein said control means applies an alternating voltage upon said toner carrier and makes said toner carried by said toner carrier transfer toward said image carrier.

16. The image forming apparatus of claim 13, wherein said toner carrier is disposed facing said surface of said image carrier with a predetermined gap from said surface of said image carrier.

17. An image forming apparatus, comprising:

an image carrier which carries an electrostatic latent image on a surface of said image carrier;

a toner carrier which transports toner carried on a surface of said toner carrier to a developing position facing said image carrier, while rotating in a predetermined rotation direction; and control means which moves said toner carried on said surface of said toner harrier to said image carrier, to thereby visualize said electrostatic latent image with said toner and accordingly form an image, wherein:

said control means forms a patch image within an area of said surface of said image carrier which faces a predetermined area on said toner carrier at said developing portion, and controls said image forming condition based on an image density of said patch image.

18. The image forming apparatus of claim 17, wherein said control means applies an alternating voltage upon said toner earner and makes said toner carried by said toner carrier transfer toward said image carrier.

19. The image forming apparatus of claim 17, wherein said toner carrier is disposed faring said surface of said image carrier with a predetermined gap from said surface of said image carrier.

20. An image forming method in which while feeding a surface of an image carrier on which an electrostatic latent image is formed to a predetermined developing position, toner carried on a surface of a toner carrier is transported to said developing position, said toner is made move to said image carrier, and said electrostatic latent image is visualized with said toner, said method comprising the steps that:

an image forming condition is controlled based on an image density of a patch image which is formed in a patch image area on said image carrier; and while said patch image area moves passed said developing position, said toner carrier rotates one round or more.

21. An image forming method in which while feeding a surface of an image carrier on which an electrostatic latent image is formed to a predetermined developing position, toner carried on a surface of a toner carrier is transported to said developing position, said toner is made move to said image carrier, and said electrostatic latent image is visualized with said toner, said method comprising the step that:

a patch image is formed in an area within said surface of said image carrier which faces a predetermined area on said toner carrier at said developing position, and an image forming condition is controlled based on an image density of said patch image.

22. An image forming apparatus, comprising:

an image carrier which has an endless shape and rotates in a predetermined direction, to thereby transport an electrostatic latent image which is carried on a surface of said image carrier to a predetermined developing position;

a toner carrier which rotates in a predetermined direction while carrying toner on a surface of said toner carrier, to thereby transport said toner to said developing position; and control means which moves said toner carried on said toner carrier to said image carrier, to thereby visualize said electrostatic latent image with said toner and accordingly form a toner image, wherein:

while a density control factor, which influences an image density, set to be variable over multiple levels, a patch image is formed at each level of said image forming condition, said density detecting means detects toner densities of said patch images, and said density control factor is optimized based on the detection results; and under at least one selective image forming condition among said multiple levels of said image forming condition, said patch image is formed covering all of a plurality of detection areas which are at mutually different positions on an outer circumferential surface of said image carrier in a circumferential direction of said image carrier, each one of said plurality of detection areas has a length which corresponds to a circumferential length of said toner carrier in a patch length direction which corresponds to a direction in which said image carrier moves, and toner densities within said detection areas are detected, and a toner density of said patch image is calculated.

23. The image forming apparatus of claim 22, wherein under raid selective image forming condition, an average value of toner densities at mutually different detection positions obtained from the detection results within one of said plurality of detection areas is used as a toner density of said patch image within this detection area.

24. The image forming apparatus of claim 23, wherein under said selective image forming condition, an average value of toner densities found in said detection areas is used as a toner density of said patch image.

25. The image forming apparatus of claim 24, wherein said detection areas are disposed at equal intervals within a range of length which corresponds to a circumferential length of said image carrier.

26. The image forming apparatus of claim 22, wherein said patch image formed under said selective image forming condition is formed by a plurality of patch fragments which respectively correspond to said detection areas.

27. The image forming apparatus of claim 22, wherein under said selective image forming condition, said patch image has a strap shape which continuously extends in said patch length direction and entirely covers said plurality of detection areas.

28. The image forming apparatus of claim 22, wherein a circumferential length of said image carrier is an integer times as long as a length which corresponds to said circumferential length of said toner carrier.

29. The image forming apparatus of claim 22, wherein said selective image forming condition is a low-density side image forming condition which makes an image density the lowest among said multiple levels of said image forming condition.

30. The image forming apparatus of claim 22, wherein said surface of said image carrier is formed by a photosensitive member, said electrostatic latent image is formed as a surface of said photosensitive member is exposed with a light beam.

31. The image forming apparatus of claim 22, further comprising bias applying means which applies a predetermined developing bias upon said toner carrier, wherein said developing bias is used as said density control factor.

32. The image forming apparatus of claim 22, further comprising an intermediate member which is structured so as to be able to temporarily carry a visualized toner image on said surface of said image carrier, wherein said image forming apparatus is structured so as to detect a toner density of a toner image carried as a patch image on a surface of said intermediate member.

33. An image forming apparatus, comprising:

an image carrier which has an endless shape and rotates in a predetermined direction, to thereby transport an electrostatic latent image which is carried on a surface of said image carrier;

a toner carrier which rotates in a predetermined direction while carrying toner on a surface of said toner carrier, to thereby transport said toner to said developing position; and control means which moves said toner carried on said toner carrier to an electrostatic latent image on said image carrier at said developing position, accordingly forms a toner image of said electrostatic latent image as a patch image, and controls respective portions of said apparatus are controlled based on a toner density of said patch image, wherein:

toner densities at a plurality of positions in said patch image which serve as detection areas are detected, and a toner density of said patch image is calculated based on said toner densities in said plurality of detection areas; and each one of said plurality of detection areas has a length which corresponds to a circumferential length of said toner carrier in a patch length direction which corresponds to a direction in which said image carrier moves.

34. The image forming apparatus of claim 33, wherein said patch image is formed by a plurality of patch fragments which are formed in such a manner that said patch fragments respectively correspond to said plurality of detection areas.

35. The image forming apparatus of claim 33, wherein said patch image has a strap shape which continuously extends in said patch length direction.

36. An image forming method in which an electrostatic latent image is formed on a surface of an image earner which has an endless shape and rotates in a predetermined direction, toner moves to said image carrier from a toner carrier which rotates in a predetermined direction while carrying toner on a surface of said toner earner, said electrostatic latent image is visualized with said toner, and a toner image is accordingly formed, said method comprising the steps that:

while a density control factor, which influences an image density, set to be variable over multiple levels, a patch image is formed at each level of said image forming condition, a density detecting means detects toner densities of said patch images, and said density control factor is optimized based on the detection results; and under at least one image forming condition among said multiple levels of said image forming condition, in a patch length direction which corresponds to a direction in which said image carrier moves, said patch image is formed covering all of a plurality of detection areas which are at mutually different positions on an outer circumferential surface of said image carrier in a circumferential direction of said image carrier, toner densities within said detection areas are detected, a toner density of said patch image is accordingly calculated.

* * * * *